US009708836B2

(12) United States Patent
Corwin et al.

(10) Patent No.: US 9,708,836 B2
(45) Date of Patent: Jul. 18, 2017

(54) RELEASE HANDLE ASSEMBLY HAVING INERTIAL BLOCKING MEMBER

(71) Applicants: Cort Corwin, Grand Haven, MI (US); Jeffrey Craig Stokes, Milan, MI (US); Drew Fouchea, Cedar Springs, MI (US); Eric Allyn VandenBrink, Holland, MI (US)

(72) Inventors: Cort Corwin, Grand Haven, MI (US); Jeffrey Craig Stokes, Milan, MI (US); Drew Fouchea, Cedar Springs, MI (US); Eric Allyn VandenBrink, Holland, MI (US)

( * ) Notice: Subject to any disclaimer, the term of this patent is extended or adjusted under 35 U.S.C. 154(b) by 461 days.

(21) Appl. No.: 14/046,345

(22) Filed: Oct. 4, 2013

(65) Prior Publication Data

US 2014/0167427 A1 Jun. 19, 2014

Related U.S. Application Data

(63) Continuation-in-part of application No. 12/371,106, filed on Feb. 13, 2009, now Pat. No. 8,894,108.
(Continued)

(51) Int. Cl.
*E05B 3/00* (2006.01)
*E05B 77/06* (2014.01)
(Continued)

(52) U.S. Cl.
CPC ..... *E05B 77/06* (2013.01); *E05B 85/10* (2013.01); *E05B 85/16* (2013.01); *E05B 85/18* (2013.01); *Y10T 292/57* (2015.04)

(58) Field of Classification Search
CPC ..... E05B 77/02; E05B 77/04; E05B 77/06; E05B 85/10; E05B 85/16; E05B 85/18
(Continued)

(56) References Cited

U.S. PATENT DOCUMENTS 2,864,641 A * 12/1958 Leslie ..... E05B 1/0038 180/286
3,453,015 A * 7/1969 Miller ..... E05B 77/12 180/281
(Continued)

FOREIGN PATENT DOCUMENTS

DE 19858416 A1 * 6/2000 ..... E05B 77/06

*Primary Examiner* — Alyson M Merlino
(74) *Attorney, Agent, or Firm* — Dickinson Wright PLLC

(57) ABSTRACT

An inertial blocking member subassembly comprising: an inertial blocking member associated with a release handle assembly framework, the blocking member having a center of gravity offset from an axis of rotation, and the blocking member being rotationally and translationally movable between an at-rest position, in which the blocking member does not prevent actuation of the release handle, and an engaged position, in which the blocking member prevents actuation of a release handle. A biasing element biases the blocking member into the engaged position. As a result of an acceleration force acting on the blocking member center of gravity, the blocking member is rotationally and translationally moved from the at-rest position to the engaged position, and in which engaged position the blocking member is retained by a blocking member retainer until disengagement of the blocking member retainer from one of the release handle assembly framework and the blocking member.

7 Claims, 54 Drawing Sheets

Related U.S. Application Data

(60) Provisional application No. 61/709,410, filed on Oct. 4, 2012, provisional application No. 61/788,155, filed on Mar. 15, 2013.

(51) Int. Cl.
*E05B 85/10* (2014.01)
*E05B 85/16* (2014.01)
*E05B 85/18* (2014.01)

(58) Field of Classification Search
USPC ..... 292/92, 93, 336.3, DIG. 22, DIG. 65, 292/DIG. 23
See application file for complete search history.

(56) References Cited

U.S. PATENT DOCUMENTS 3,583,741 A * 6/1971 Breitschwerdt ..... E05B 77/06 180/281
3,719,248 A * 3/1973 Breitschwerdt ..... E05B 77/06 180/271
3,799,596 A * 3/1974 Nozomu ..... E05B 77/06 180/286
3,858,921 A * 1/1975 Kuki ..... E05B 85/18 292/336.3
3,967,844 A * 7/1976 Torii ..... E05B 85/18 292/336.3
5,669,642 A * 9/1997 Kang ..... E05B 77/06 292/336.3
5,865,481 A * 2/1999 Buschmann ..... E05B 77/06 292/169.11
6,007,122 A * 12/1999 Linder ..... E05B 85/10 292/216
6,010,167 A * 1/2000 Tanimoto ..... E05B 77/06 292/336.3
6,042,159 A * 3/2000 Spitzley ..... E05B 77/06 16/111.1
6,070,923 A * 6/2000 Tanimoto ..... E05B 77/06 292/336.3
6,099,052 A * 8/2000 Spitzley ..... E05B 77/06 292/336.3
6,241,294 B1 * 6/2001 Young ..... E05B 77/04 292/251.5
6,382,688 B1 * 5/2002 Agostini ..... E05B 77/06 292/336.3
6,464,270 B1 * 10/2002 Sloan ..... E05B 77/06 292/336.3
6,554,331 B2 * 4/2003 Ciborowski ..... E05B 85/16 292/336.3
6,565,134 B1 * 5/2003 Stuart ..... E05B 77/06 292/336.3
6,648,382 B1 * 11/2003 Monig ..... E05B 77/06 292/336.3
6,712,409 B2 * 3/2004 Monig ..... E05B 77/06 292/336.3
6,880,870 B2 * 4/2005 Costigan ..... E05B 85/16 292/336.3
7,029,042 B2 * 4/2006 Belchine, III ..... E05B 77/06 292/230
7,070,216 B2 * 7/2006 von zur Muehlen ... E05B 77/06 292/336.3
7,091,836 B2 * 8/2006 Kachouh ..... E05B 81/14 307/10.1
7,163,240 B2 * 1/2007 Odahara ..... E05B 77/06 292/347
7,173,346 B2 * 2/2007 Aiyama ..... B60R 21/0136 307/10.1
7,210,716 B2 * 5/2007 Mueller ..... E05B 77/06 292/336.3
7,216,402 B2 * 5/2007 Nishiyama ..... E05B 85/12 16/412
7,232,164 B2 * 6/2007 Lee ..... E05B 77/06 292/336.3
7,478,848 B2 * 1/2009 Kim ..... E05B 77/06 292/336.3
7,481,468 B2 * 1/2009 Merideth ..... E05B 77/06 292/137
7,607,702 B2 * 10/2009 Pereverzev ..... E05B 77/06 292/201
7,648,192 B2 * 1/2010 Herline ..... E05B 77/04 292/92
8,469,411 B2 * 6/2013 Costigan ..... E05B 85/16 292/336.3
2005/0161959 A1 * 7/2005 Belchine ..... E05B 77/06 292/336.3
2006/0049647 A1 * 3/2006 von zur Muehlen ... E05B 77/06 292/336.3
2007/0069533 A1 * 3/2007 Cummins ..... E05B 47/004 292/336.3
2007/0085349 A1 * 4/2007 Merideth ..... E05B 77/06 292/183
2007/0284894 A1 * 12/2007 Rodawold ..... E05B 77/06 292/336.3
2008/0032619 A1 * 2/2008 Voit ..... B60H 1/00378 454/158
2010/0207404 A1 8/2010 Corwin et al.
2011/0298228 A1 * 12/2011 Lesueur ..... E05B 77/06 292/336.3
2013/0056999 A1 † 3/2013 Beck

* cited by examiner
† cited by third party

RELEASE HANDLE ASSEMBLY HAVING INERTIAL BLOCKING MEMBER

RELATED APPLICATION DATA

This application is a continuation-in-part of, and claims the benefit of priority from, U.S. patent application Ser. No. 12/371,106, filed 13 Feb. 2009, and further claims the benefit of priority from U.S. Provisional Application Ser. No. 61/709,410, filed 4 Oct. 2012, and U.S. Provisional Application Ser. No. 61/788,155, filed 15 Mar. 2013, the disclosures of which applications are incorporated herein by reference in their entireties.

FIELD OF THE INVENTION

The invention relates to vehicle door release handle assemblies incorporating inertial blocking subassemblies with retaining elements for preventing the unintended opening of the vehicle door in the event of an impact.

BACKGROUND OF THE INVENTION

Vehicle door latch assemblies frequently incorporate a door handle grip that is pulled away from the door in order to operate the latch mechanism and open the door. In the event of an impact event such as a collision, particularly one that generates an impact force vector perpendicular to the side of the vehicle, the acceleration of the vehicle in the direction of the side-acting force vector can cause the door (plus the rest of the vehicle) to accelerate away from the door handle grip due to the inertia of the door handle grip. Such impact events typically consist of two phases: an acceleration phase and a deformation phase.

The acceleration phase corresponds to a period of time commencing with the initial impact. During this time, which is typically about 40 msec duration but can extend to about 300 msec duration, a release handle assembly in the area of the impact can experience relatively high accelerations, and, consequently, relatively high acceleration forces, associated with primarily lateral movement of the vehicle door. This generates relative movement analogous to pulling on the door handle grip to open the door.

During the deformation phase, which ensues after the acceleration phase, crushing and deformation of the side structure of the vehicle occurs in the area affected by impact forces. During this time, acceleration of the door latch assembly is somewhat asymptotically reduced to zero. Nevertheless, depending upon specific impact event parameters, the potential for the vehicle door to open still exists during the deformation phase. As well, the vehicle door may be able to open during the end of the acceleration phase in certain events having an extended acceleration phase.

In order to minimize the potential for unintended impact-induced door opening, vehicle door release handle suppliers have developed inertial blocking member subassemblies that impede the unintended movement of the release handle assembly and/or door opening actuator resulting from an impact to the vehicle. These subassemblies are activated between an at-rest position, wherein the door, if functional, can be opened by operating the release handle assembly, and a blocking position, wherein opening of the door is prevented by impact-generated inertial forces. Impeding the movement of the release handle assembly or door opening actuator can thus be accomplished by controlling impact-based acceleration and inertial effects associated with the inertial blocking member subassembly.

Known inertial blocking member subassemblies are configured, generally with a biasing element, to return to the at-rest position, which enables the door to be opened in the usual manner in the absence of, or after, an impact event. However, known inertial blocking member subassemblies are typically only effective during the acceleration phase; they generally return to their at-rest position during or after the deformation phase, which enables the release handle assembly to operate, thereby enabling occupants to exit the vehicle and emergency personnel to readily access occupants remaining in the vehicle. This functionality can also enable the door to be unintentionally opened during the deformation phase of an impact event.

Unintended post-impact door opening can be minimized by an inertial blocking member subassembly that maintains its "blocking" position for a selected time after the impact event has terminated, rather than enabling the subassembly to return to an at-rest position. However, to extend the duration of the blocking action by controlling the return of the inertial blocking member to its at-rest position may prevent opening of the door after the impact event has terminated, which may be a potentially serious threat to occupants remaining in the vehicle.

An inertial blocking member subassembly configured to prevent the unintended opening of the door during the acceleration and deformation phases, while enabling the operation of the door release handle to open the door after the end of the impact event, would be desirable.

SUMMARY OF THE INVENTION

In one embodiment, there is provided an inertial blocking member subassembly for a vehicle-door release handle mechanism includes a release handle framework supporting a bell crank assembly and a manually actuatable door handle grip, the door handle grip operatively coupled to the bell crank assembly. The inertial blocking member subassembly comprises: an inertial blocking member associated with the release handle assembly framework, the blocking member having a center of gravity which is offset from an axis of rotation, and the blocking member being rotationally and translationally movable between an at-rest position, in which the blocking member does not prevent actuation of the release handle, and an engaged position, in which the blocking member prevents actuation of the release handle; a biasing element associated with the blocking member, the biasing element biasing the blocking member into the engaged position; and a blocking member retainer provided on at least one of the release handle assembly framework and the blocking member. As a result of the acceleration force acting on the blocking member center of gravity, the blocking member is rotationally and translationally moved from the at-rest position to the engaged position, and in which engaged position the blocking member is retained by the blocking member retainer until disengagement of the blocking member retainer from the at least one of the release handle assembly framework and the blocking member.

Per one feature of the invention, the center of gravity of the blocking member is, in the engaged position of the blocking member, approximately aligned with the vector of the acceleration force and the axis of rotation.

Per another feature, the biasing element may be a helical torsion spring.

Per a further feature, the blocking member intercepts and prevents activation of the bell crank assembly when the blocking member is in the engaged position, and permits activation of the bell crank assembly when the blocking member is in the at-rest position.

According to still another feature, disengagement of the blocking member retainer from the at least one of the release handle assembly framework and the blocking member is effected by operating the release handle assembly.

According to yet another feature, the blocking member retainer is associated with each of the release handle framework and the blocking member. In one embodiment, the blocking member retainer comprises each of a projection provided on one of the release handle framework or the blocking member, and a recess provided on the other of the release handle framework or the blocking member, the projection being at least partially received in the recess in the engaged position of the blocking member.

In another embodiment of the invention, there is provided an inertial blocking member subassembly for a vehicle-door release handle mechanism including a release handle framework supporting a bell crank assembly and a manually actuatable door handle grip, the door handle grip operatively coupled to the bell crank assembly, the inertial blocking member subassembly comprising: an inertial blocking member associated with the release handle assembly framework, the blocking member having a center of gravity which is offset from an axis of rotation, and the blocking member being rotationally and translationally movable between an at-rest position, in which the blocking member does not prevent actuation of the release handle, and an engaged position, in which the blocking member prevents actuation of the release handle; a biasing element associated with the blocking member, the biasing element biasing the blocking member along a translational axis into the engaged position from the at-rest position, and the biasing element further biasing the blocking member along a rotational axis into the at-rest position from the engaged position; and a blocking member retainer provided on at least one of the release handle assembly framework and the blocking member, the blocking member retainer comprising each of a projection provided on one of the release handle framework or the blocking member, and a recess provided on the other of the release handle framework or the blocking member, the projection being at least partially received in the recess in the engaged position of the blocking member. The recess includes a ramped portion disposed so as to provide a resistance surface for the projection to resist rotational movement of the blocking member from the engaged position to the at-rest position. As a result of the acceleration force acting on the blocking member center of gravity, the blocking member is rotationally and translationally moved from the at-rest position to the engaged position, and in which engaged position the blocking member is held by the resistance surface until the acceleration force has attenuated sufficiently so that the biasing element can move the blocking member to the at-rest position.

According to one feature, the center of gravity of the blocking member is, in the engaged position of the blocking member, approximately aligned with the vector of the acceleration force and the axis of rotation.

According to another feature, the biasing element is a helical torsion spring.

Per a still further feature, the blocking member intercepts and prevents activation of the bell crank assembly when the blocking member is in the engaged position, and permits activation of the bell crank assembly when the blocking member is in the at-rest position.

According to still another embodiment, there is provided a release handle mechanism for latching and unlatching a vehicle door, the release handle mechanism comprising: a release handle framework supporting a bell crank assembly and a manually actuatable door handle grip, the door handle grip operatively coupled to the bell crank assembly; an inertial blocking member subassembly activated by an acceleration force associated with an impact event, the blocking member subassembly comprising an inertial blocking member associated with the release handle assembly framework for rotational and translational movement relative thereto, the blocking member having a center of gravity which is offset from an axis of rotation, and the blocking member being rotationally and translationally movable between an at-rest position, in which the blocking member does not prevent actuation of the release handle, and an engaged position, in which the blocking member prevents actuation of the release handle; a biasing element biasing the blocking member into the at-rest position; and a projection provided on the blocking member, the projection being at least partially received in a recess provided in the release handle framework in the engaged position of the blocking member, and wherein the projection and recess are out of alignment in the at-rest position of the blocking member. As a result of the acceleration force acting on the blocking member center of gravity, the blocking member is rotationally moved to a position where the projection is aligned with the recess and the blocking member interferes with activation of the bell crank assembly, in which position the blocking member is translationally moved to the engaged position by the bell crank assembly, and in which engaged position the projection is at least partially received in the recess to thereby inhibit rotational movement of the blocking member back to the at-rest position until the acceleration force has attenuated sufficiently for the biasing element to move the inertial blocking member to the at-rest position According to one feature, the center of gravity of the blocking member is, in the engaged position of the blocking member, approximately aligned with the vector of the acceleration force and the axis of rotation.

According to another feature, the biasing element is a helical torsion spring.

WRITTEN DESCRIPTION

For purposes of this description, "bell crank counterweight" shall mean "a body coupled with a bell crank actuator for imposing a balancing moment thereon, movable in response to an inertial force vector from an at-rest position, in which a door assembly can be opened only by operation of the door handle grip and movement of the bell crank actuator, to a non-restrictive position, wherein movement of the bell crank counterweight and the bell crank actuator in response to the inertial force vector enables the uncontrolled opening of the vehicle door."

"Blocking member retainer" or "retainer" shall mean "an element or a combination of elements associated with an inertial blocking member for extending the activation time during which the inertial blocking member impedes movement of the bell crank actuator beyond the activation time in the absence of the blocking member retainer."

"Door handle grip" shall mean "that component part of the release handle assembly mounted to the exterior of the vehicle door, and grasped and pulled to operate the door latch and open the door."

"Door latch assembly" shall mean "an assembly of component parts comprising part of a vehicle door, for opening and closing the vehicle door, including a release handle assembly, a door latch, and an apparatus, such as a cable or rod, that operably couples the release handle assembly with the door latch."

"Inertial blocking member" or "blocking member" shall mean "a body, movable in response to an inertial force vector from an at-rest position, in which the door assembly can be opened only by operation of the door handle grip and movement of the bell crank actuator, to a blocking position, wherein movement of the bell crank counterweight and the bell crank actuator are prevented, thereby preventing the uncontrolled opening of the vehicle door."

"Release handle assembly" shall mean "an assembly of component parts comprising an escutcheon, a door handle grip, a bell crank assembly comprising a bell crank actuator and a bell crank counterweight, an inertial blocking member assembly comprising a blocking member retainer, and a release handle assembly framework."

The terms "outward", "outwardly", "exteriorly", or "externally" shall mean "in a direction toward the exterior of, or located outside, the motor vehicle." The terms "inward", "inwardly", "interiorly", or "internally" shall mean "in a direction toward the interior of, or located within, the motor vehicle."

Figure 1:
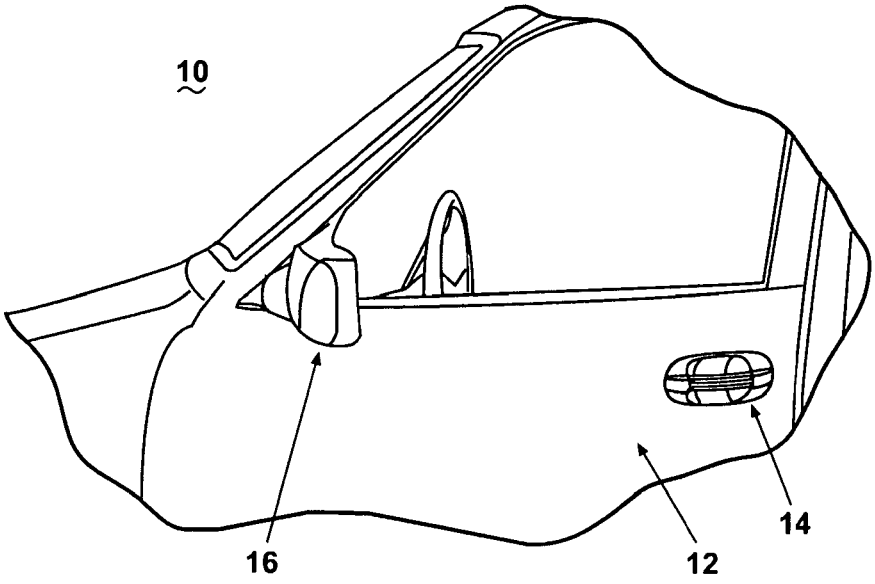
FIG. 1 is a partial side view of a motor vehicle incorporating a vehicle release handle assembly having a retaining element according to an embodiment of the invention.

Referring to the Drawings, and in particular to FIG. 1, a motor vehicle 10 is illustrated in part comprising a door assembly 12. The door assembly 12 has a release handle assembly 14 mounted thereto for facilitating the opening and closing of the door assembly 12. The door assembly 12 is also provided with a mirror assembly 16 for providing an occupant of the vehicle with a rearward view. The mirror assembly 16 is not a part of the invention, and thus will not be described further herein.

Figure 2:
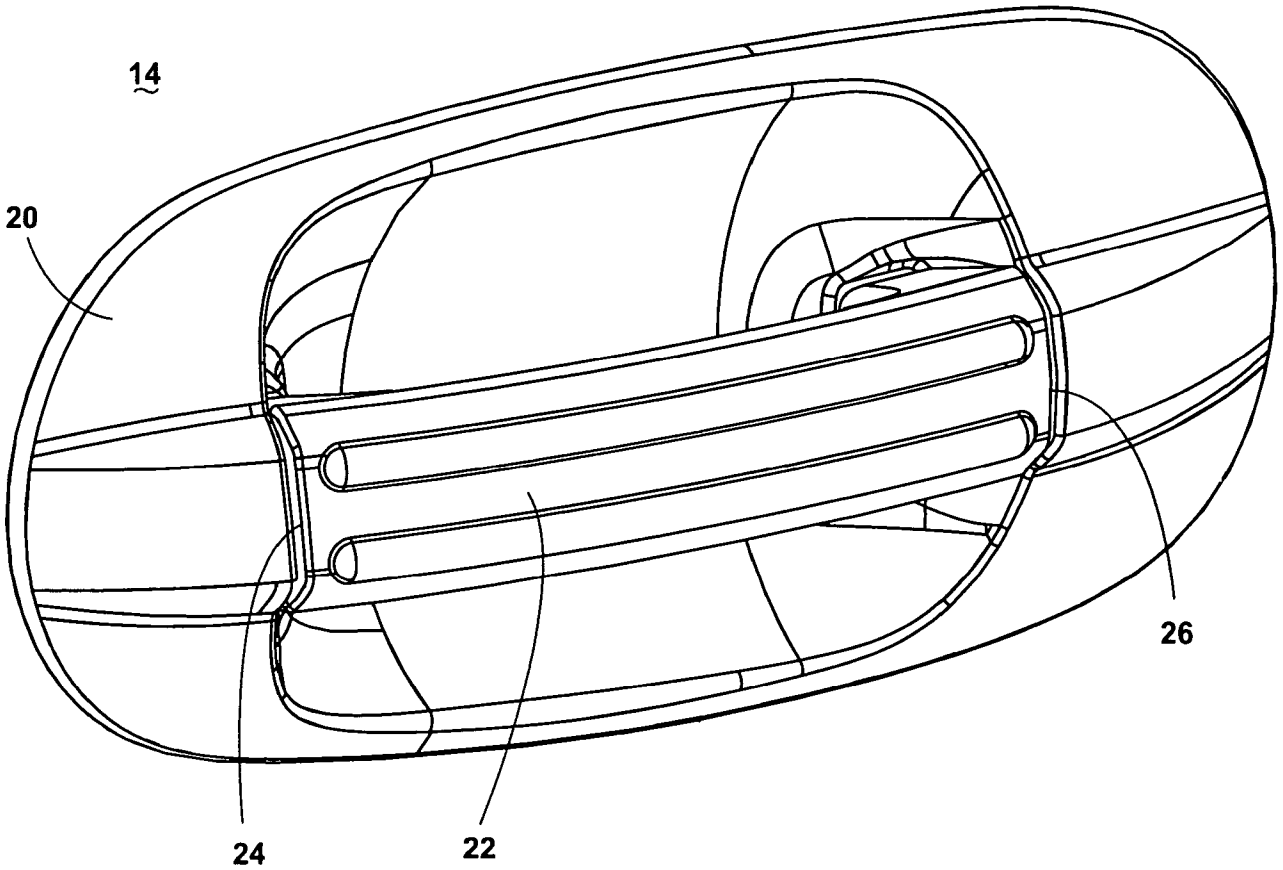
FIG. 2 is an enlarged perspective view of the exterior of the vehicle release handle assembly of FIG. 1.

As illustrated in FIG. 2, the release handle assembly 14 comprises an escutcheon 20 and a door handle grip 22. The illustrated release handle assembly 14 is but one example of a release handle assembly that can incorporate an inertial blocking member subassembly. The release handle assembly 14 can alternatively comprise other release handle assemblies, such as a paddle-type or twist-type handle assembly.

Figure 3:
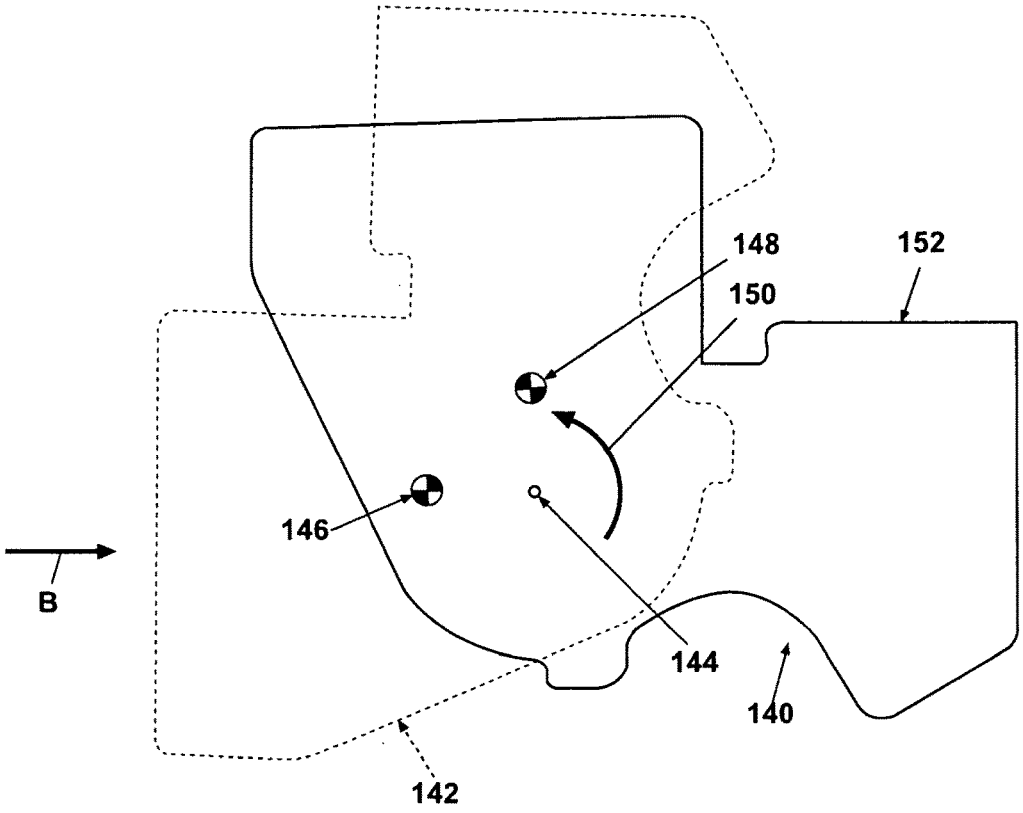
FIG. 3 is a schematic view true to the rotation axis of a rotating inertial blocking member illustrating the concept underlying disclosed embodiments of an inertial blocking member subassembly having a retaining element according to the invention.

Several embodiments of the invention will be described which share a base configuration and operation. This base configuration is illustrated in FIG. 3, which shows conceptually in plan view the operation of an inertial blocking member, also referred to as a hidden CG counterweight, comprising the basis for embodiments of the invention. The inertial blocking member 140 comprises part of an inertial blocking member subassembly (not shown) which is pivotally attached through a pivot connection 144 to a fixed portion of the release handle assembly framework or escutcheon (not shown) for pivotal rotation about a vertical axis. The pivot connection 144 is offset from the center of mass 148 of the inertial blocking member 140.

The inertial blocking member 140 is rotatable about the pivot connection 144 between a first, at-rest position 152, and a second, engagement position 142. Consequently, an acceleration force, comprising part of a larger acceleration/force field acting on the door assembly and represented by the vector "B," can cause an oppositely-directed force to act on the center of mass 148, thereby urging rotation 150 of the inertial blocking member 140, illustrated as counterclockwise, to the engagement position 142. Conversely, an acceleration force acting on the door assembly in a direction opposite the direction of the acceleration force B can urge the rotation of the inertial blocking member 140 in a clockwise direction.

The engagement position 142, with the center of mass 148 rotated to a position 146 in line with the acceleration force vector B and the pivot connection 144, can be referred to as the "hidden center of gravity" or "hidden CG" configuration. In the hidden CG configuration, the inertial blocking member 140 can remain stationary until the acceleration force dissipates sufficiently to enable the inertial blocking member 140 to return to its at-rest position 152. A biasing member, such as a helical spring (not shown), can be incorporated into the inertial blocking member 140 to urge its return to the at-rest position 152. A spring constant for the biasing member can be selected based upon the mass and moment of inertia of the inertial blocking member, design impact event parameters, and the time period during which the hidden CG configuration is to be maintained.

In the at-rest position 152, the inertial blocking member 140 can be isolated from the bell crank, thus enabling the bell crank to fully operate to open the door. The inertial blocking member 140 can be configured to engage and impede the motion of the bell crank or other release handle mechanism when the inertial blocking member 140 is in the hidden CG configuration as the result of an impact event to prevent movement of the release handle mechanism and opening of the door. The inertial blocking member 140 can remain in the hidden CG configuration 142 until it is able to rotate to the at-rest position 152 under the influence of the biasing member. The return of the inertial blocking member 140 to the at-rest position 152 can take place during the later stages of, or after, the deformation phase, when the acceleration force vector "B" is inadequate to resist the return force of the biasing member.

Figure 4:
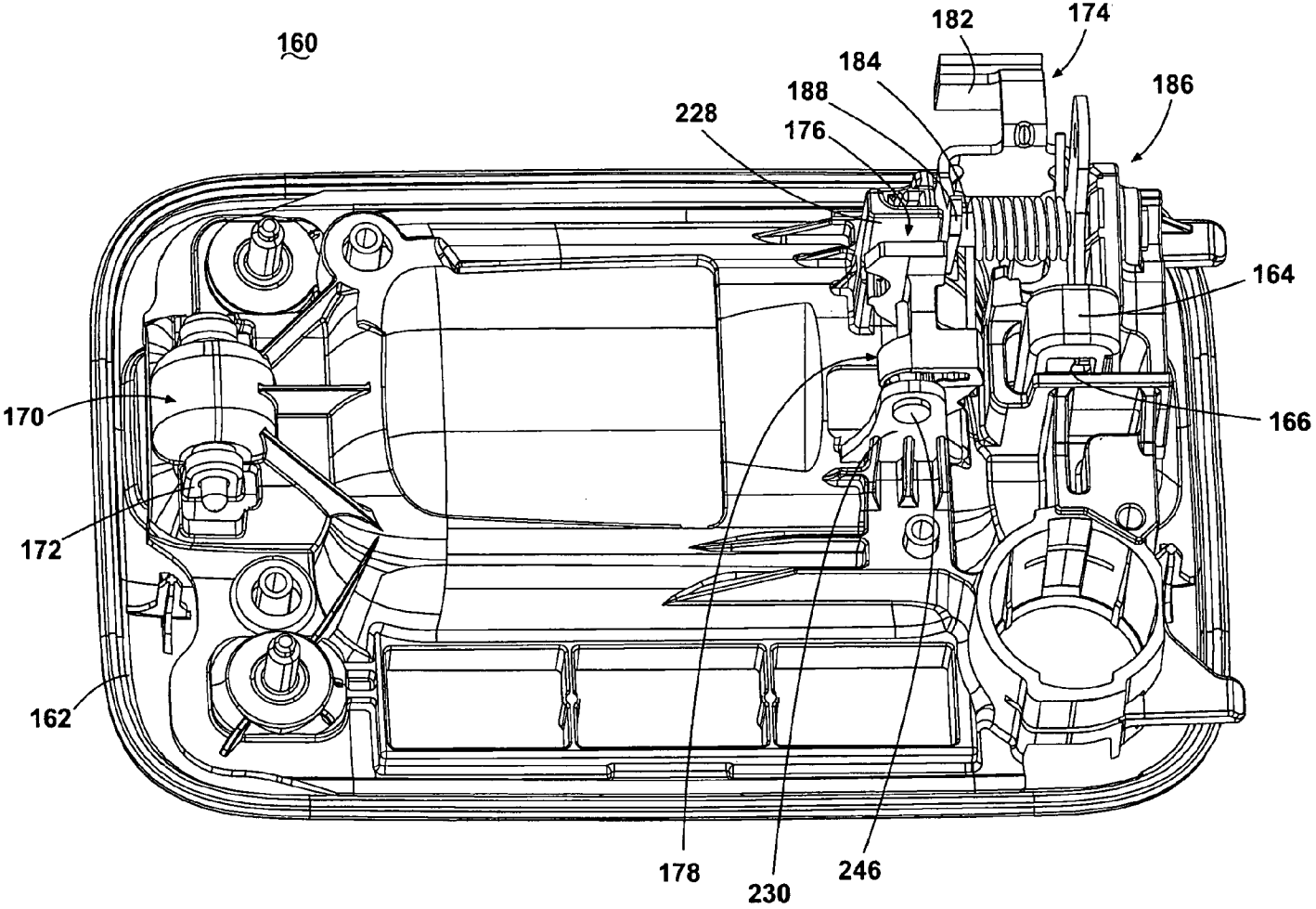
FIG. 4 is an enlarged perspective view of the interior of a vehicle release handle assembly, illustrating a first embodiment of an inertial blocking member subassembly.
Figure 5:
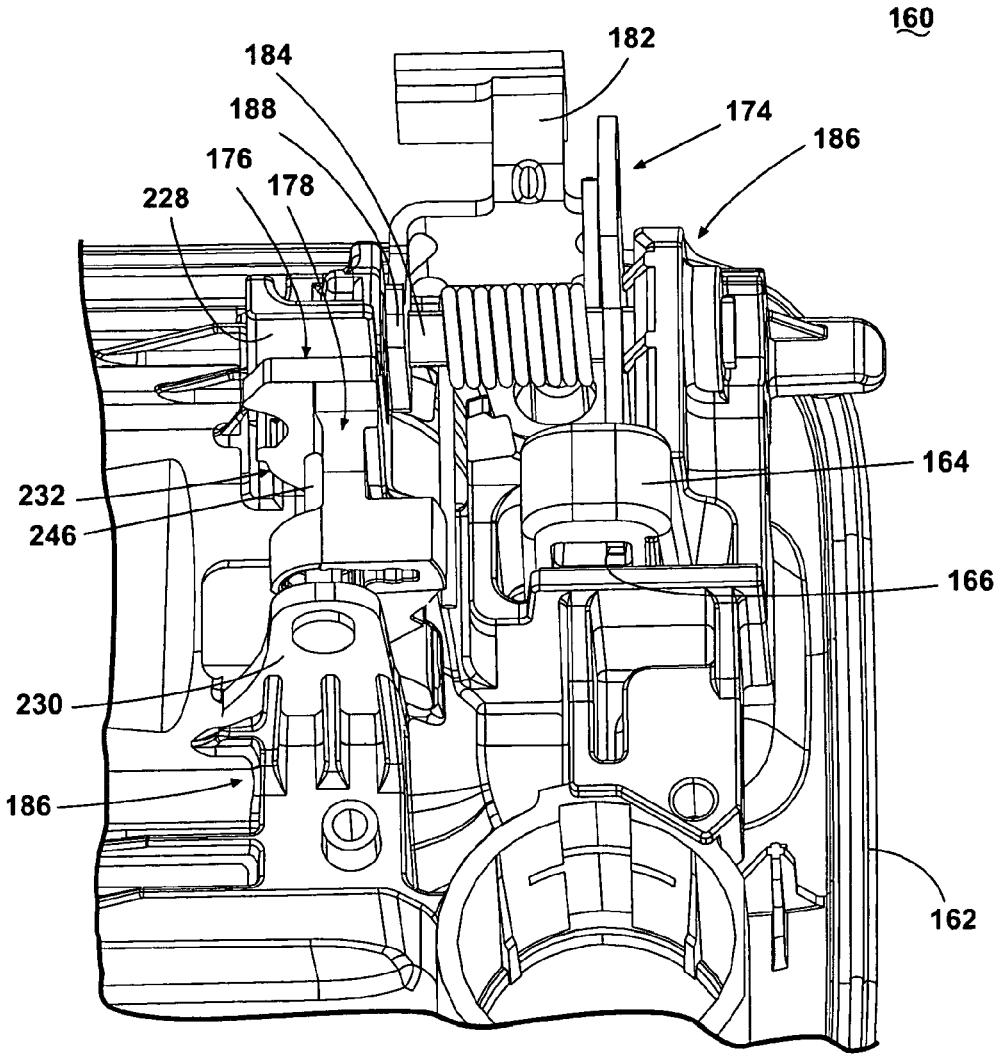
FIG. 5 is a further enlarged perspective view of the interior of the vehicle release handle assembly of FIG. 4, illustrating essential elements of the inertial blocking member subassembly.
Figure 6A:
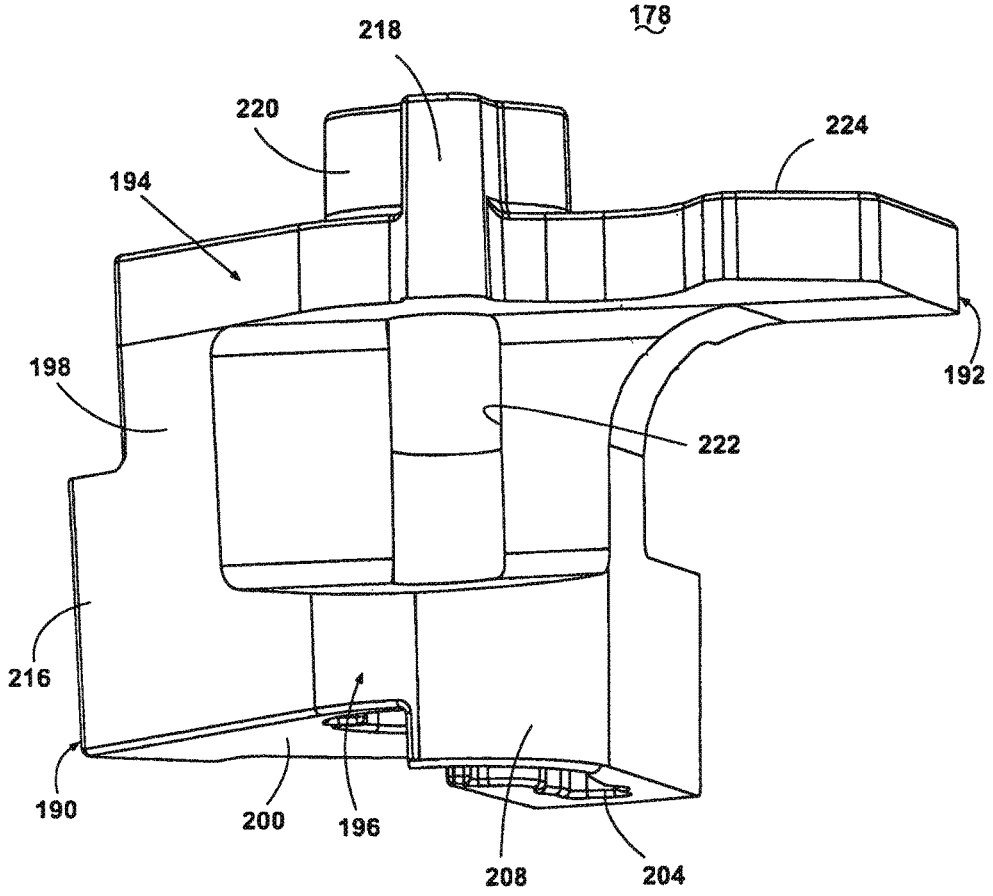
FIGS. 6A-D are alternate enlarged perspective views of an inertial blocking member comprising an essential element of the blocking member subassembly illustrated in FIG. 5.
Figure 6B:
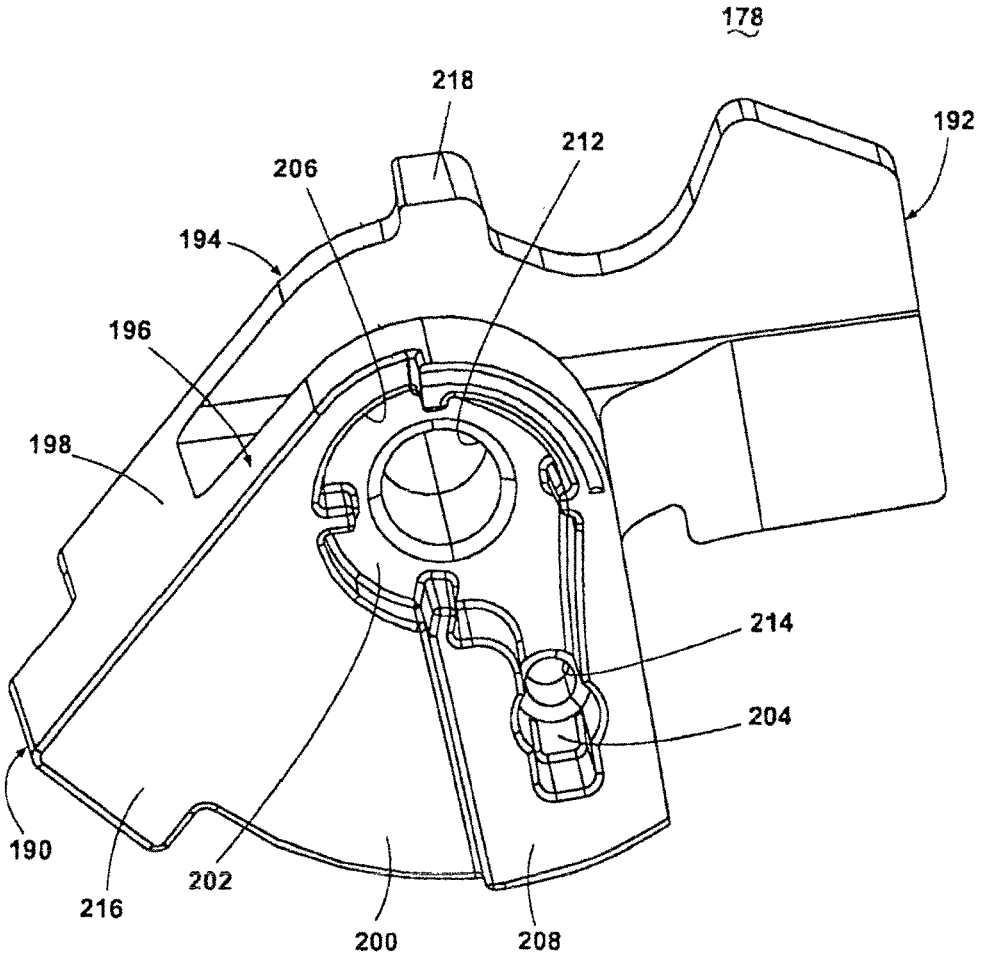
Figure 6C:
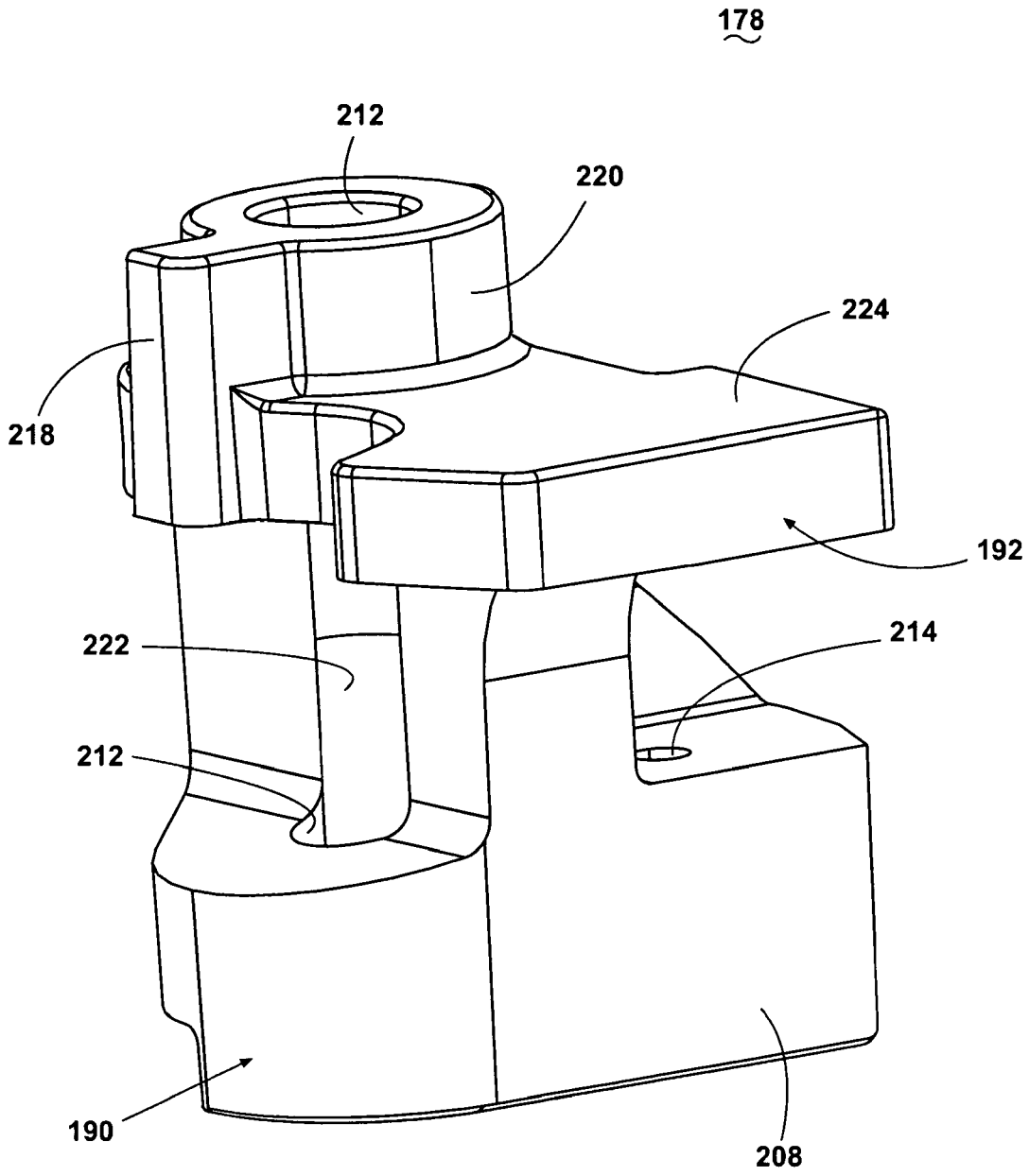
Figure 6D:
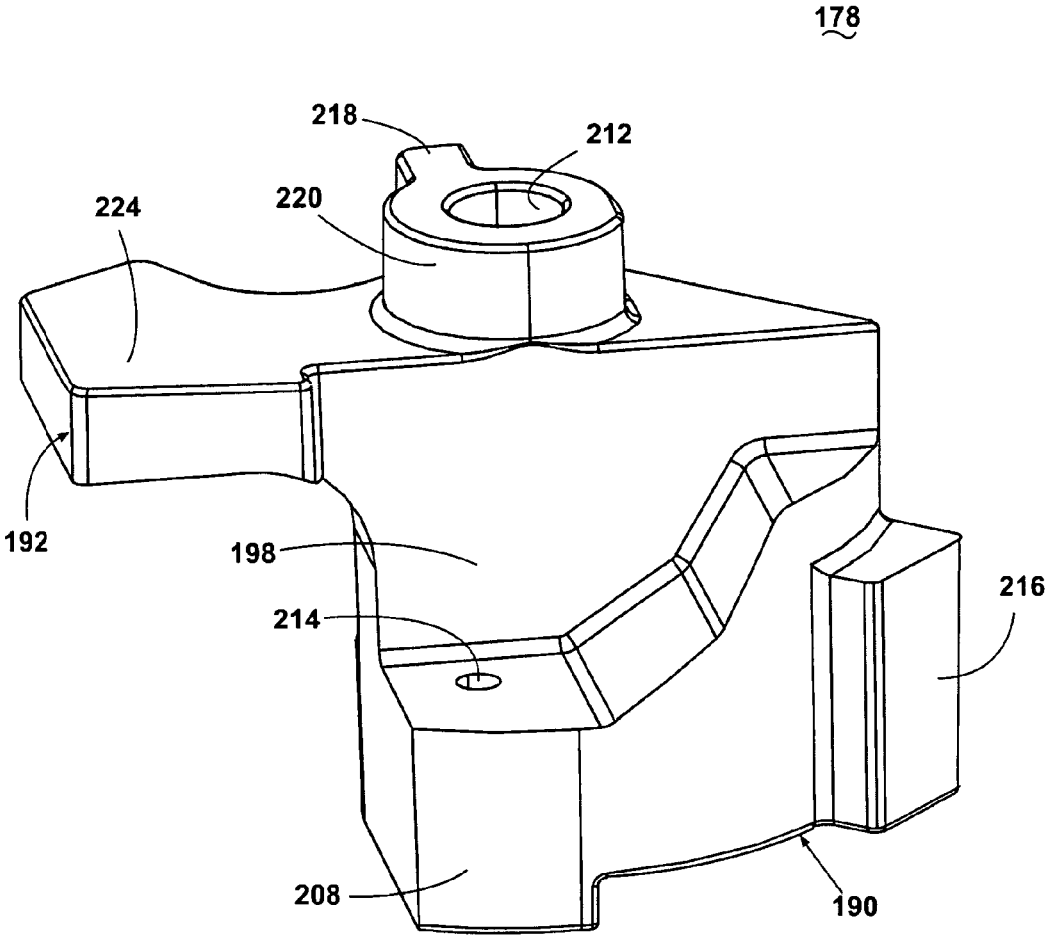

Referring now to FIGS. 4 and 5, a first embodiment of an inertial blocking member subassembly 176, incorporating the hidden CG features described above, is illustrated comprising part of a release handle assembly 160. The release handle assembly 160 comprises an escutcheon 162 and a door handle grip (not shown) for operating a bell crank assembly 174. The door handle grip comprises a latch arm 164 at a first end and a pivot arm (not shown) rotatably received in a pivot arm housing 170 through a pivot pin 172. Pulling on the door handle grip can pivot the door handle grip about the pivot pin 172, moving the latch arm 164 outwardly of the release handle assembly 160. Alternatively, the release handle assembly 160 can be comprised of other handle/latch assemblies, such as a paddle-type or twist-type latch assembly.

The bell crank assembly 174 comprises a bell crank transitioning to a crank finger 166 extending radially away from the support pin 184 at a first, generally following end, which slidably couples with the latch arm 164 (both shown in FIG. 10), so that when the door handle grip 22 is pulled, the crank finger 166 translates outwardly. An interference finger 188 extends radially away from the support pin 184 at a second, generally leading end of the bell crank assembly 174, for purposes that will become evident hereinafter. The bell crank assembly 174 also comprises a bell crank counterweight 182. The bell crank assembly 174 comprises a suitably oriented support pin, such as a horizontally-disposed support pin 184, mounted in a suitable manner to the release handle assembly framework 186 for rotation of the bell crank assembly 174 about the longitudinal axis of the pin 184. Pulling on the door handle grip can move the latch arm 164 and the crank finger 166 outwardly, thereby rotating the bell crank assembly 174 to rotate the interference finger 188 downwardly.

Figure 7:
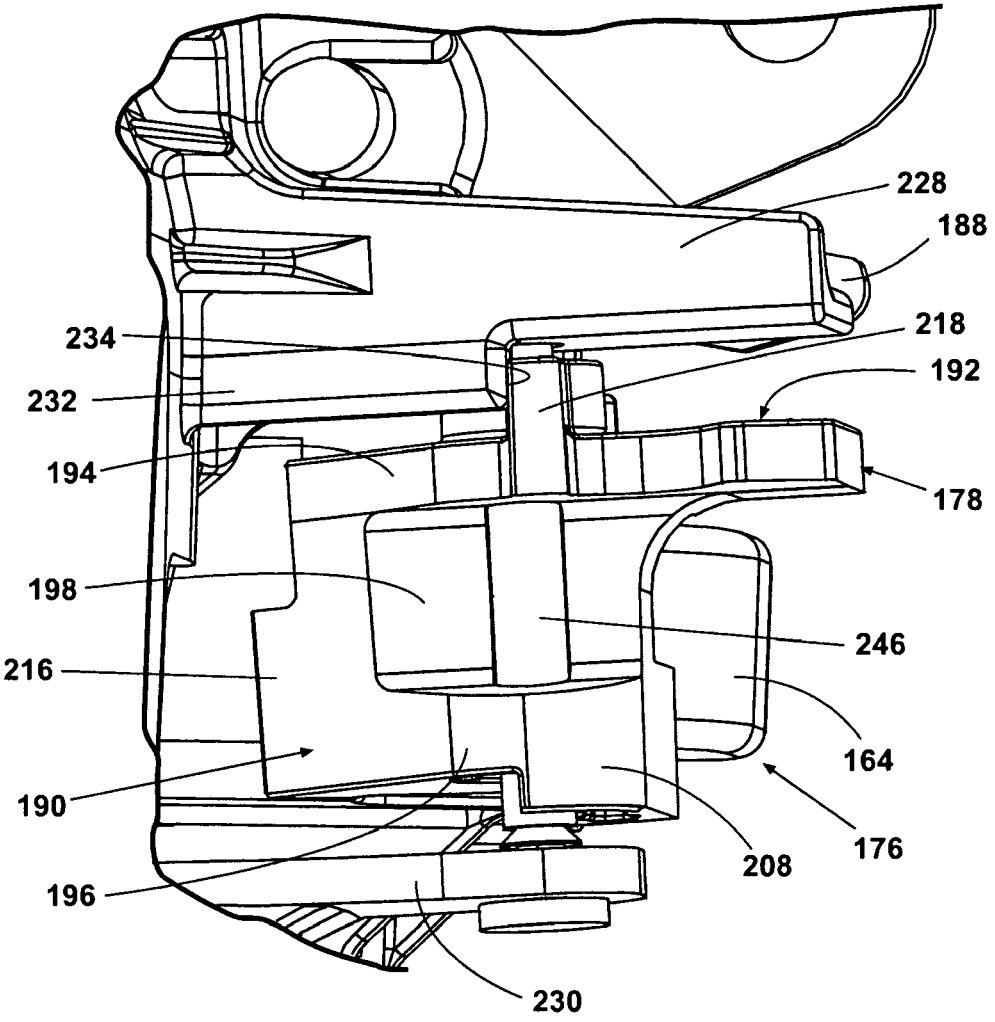
FIG. 7 is an enlarged perspective view of the inertial blocking member subassembly of FIG. 5 in an at-rest configuration.
Figure 8:
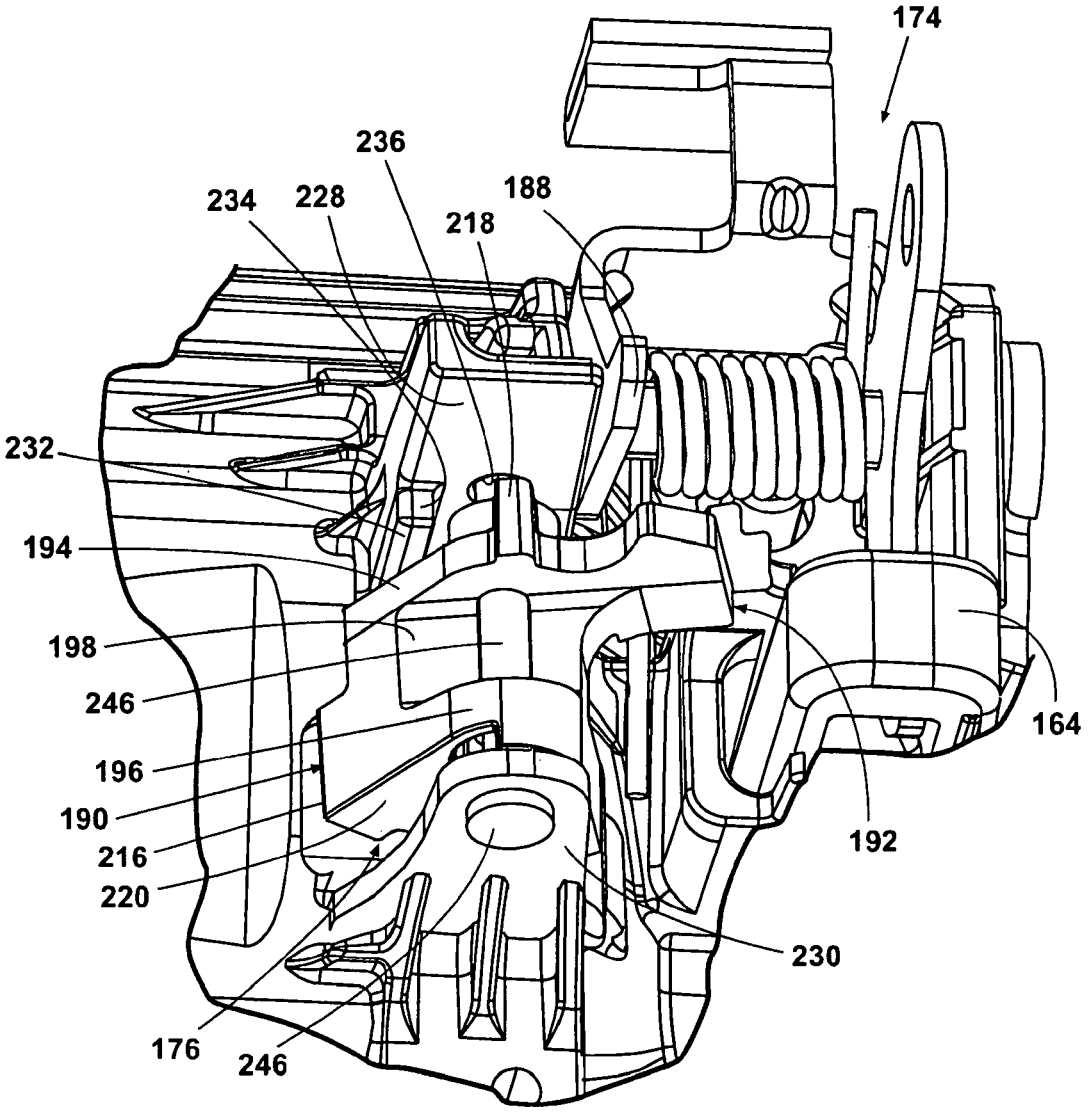
FIG. 8 is a first enlarged perspective view of the inertial blocking member subassembly of FIG. 5 illustrating the inertial blocking member in position to prevent the activation of a bell crank actuator and unintended opening of the door.

Referring specifically to FIG. 5, an inertial blocking member subassembly 176 comprising an inertial blocking member 178 is rotatably mounted through a pin 246 between an upper support feature 228 and a lower support feature 230. As illustrated in FIGS. 5, 7, and 8, the upper support feature 228 comprises a generally rectilinear stop wall 232 depending therefrom and terminating inwardly in a planar stop end 234. The upper support feature 228 also has a pin aperture 236 extending therethrough for receipt of the pin 246.

Referring to FIGS. 6A-D, the inertial blocking member 178 is an irregularly-shaped body comprising a generally sector-shaped hidden CG counterweight portion 190 (FIG.

6B) and an interference portion 192. The counterweight portion 190 comprises a top wall 194. The interference portion 192 comprises a bottom wall 196 spaced from and generally parallel to the top wall 194. A side wall 198 extends generally orthogonally between the top wall 194 and the bottom wall 196.

The top wall 194 comprises a generally planar bottom surface 200 transitioning at the apex of the top wall 194 to a generally circular spring cavity 202 for housing of the biasing member. The spring cavity 202 opens tangentially into a narrow, elongated spring channel 204 having a spring opening 214 extending therefrom. The spring cavity 202 has a concentric pin aperture 212 extending therefrom, and extending through the top wall 194 and the bottom wall 196.

A low wall 206 depends from the bottom surface 200 in an arc partially circumscribing and defining the spring cavity 202. A high wall 208 caps the remaining circumferential portion of the spring cavity 202 and the perimeter of the spring channel 204. The spring cavity 202 and the spring channel 204 receive a helical spring (not shown). The coil of the helical spring is received within the spring cavity 202. One arm of the helical spring extends into the spring channel 204, and terminates orthogonally in a finger that can be inserted into the spring opening 214. The other arm of the helical spring extends along the bottom surface 200.

The bottom wall 196 transitions to a generally rectilinear bottom wall projection 216 extending from the bottom surface 200.

The top wall 194 transitions to the interference portion 192 radially away from the pin aperture 212. The top wall 194 has a planar top surface 224 oriented generally parallel to the bottom surface 200. Extending from the top wall 194 is an annular collar 220 coaxial with the pin aperture 212. A top wall stop boss 218 extends from the top surface 224 along the top wall 196 and the collar 220 to project radially away from the pin aperture 212. The pin aperture 212 intersects the sidewall 198 to define an elongated, rounded channel-like pin groove 222.

FIGS. 5 and 7 illustrate the inertial blocking member subassembly 176 in an at-rest position. In this configuration, the inertial blocking member 178 is urged by the helical spring in a counterclockwise direction, indicated by the vector in FIG. 9, so that the top wall stop boss 218 can contact the stop end 234 (FIG. 8). As shown in FIG. 5, the interference portion 192 can extend generally beneath the upper support feature 228. The center of mass of the inertial blocking member 178 can be offset from the axis of rotation, i.e. the pin 246, with the inertial blocking member 178 in the at-rest position. Pulling on the door handle grip 22 can rotate the bell crank assembly 174 and the interference finger 188 without interference from the interference portion 192 when the inertial blocking member assembly is in an at-rest configuration.

Figure 9:
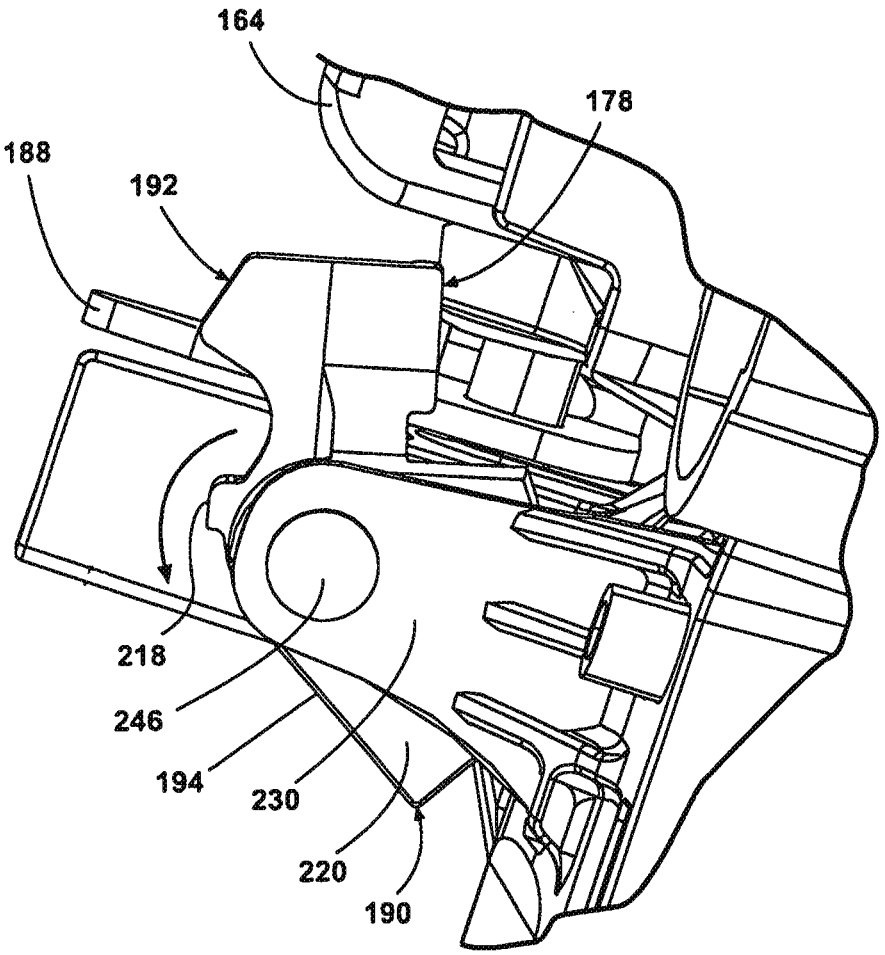
FIG. 9 is a second enlarged perspective view of the inertial blocking member subassembly of FIG. 5 illustrating the inertial blocking member in position to prevent the activation of the bell crank actuator and unintended opening of the door.
Figure 10:
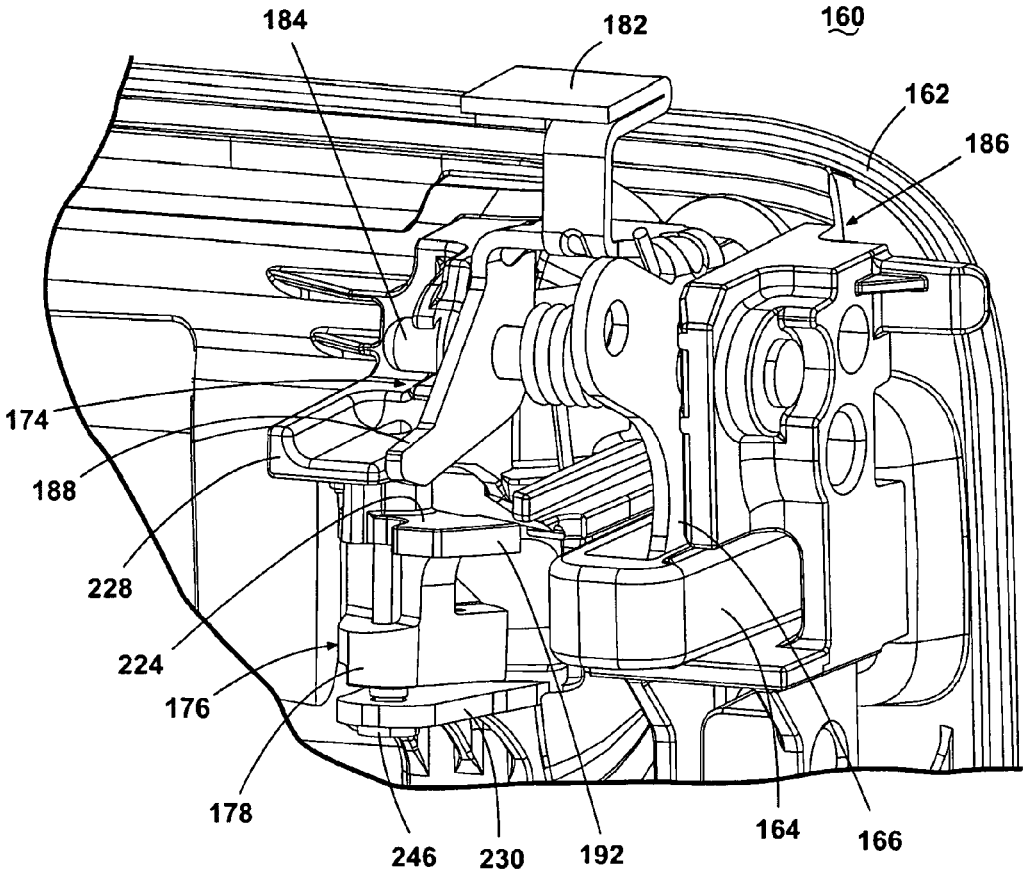
FIG. 10 is a third enlarged perspective view of the inertial blocking member subassembly of FIG. 5 illustrating the inertial blocking member in position to prevent the activation of the bell crank actuator and unintended opening of the door.
Figure 11:
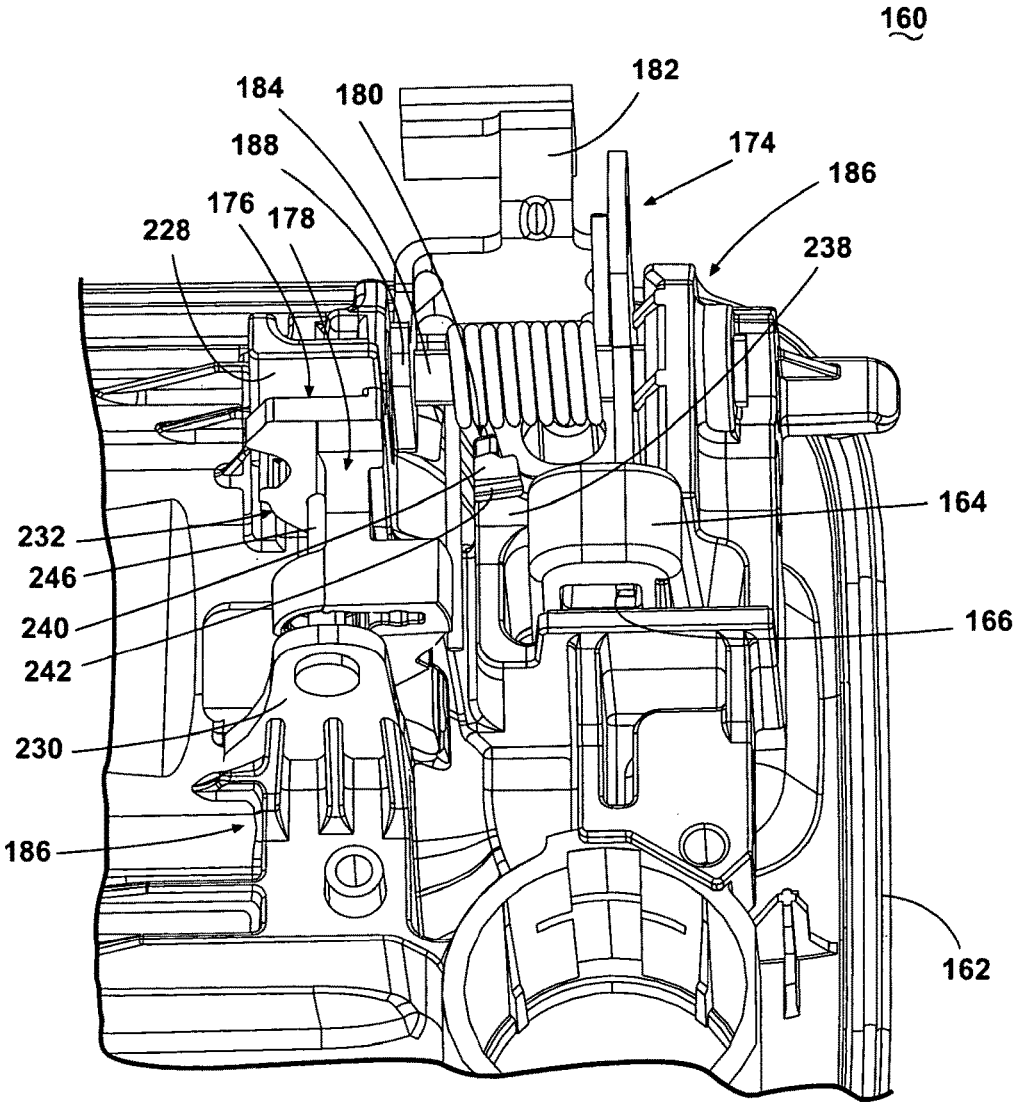
FIG. 11 is an enlarged perspective view of a portion of a vehicle release handle assembly illustrating a second embodiment of an inertial blocking member subassembly having a retaining element.

FIGS. 8, 9, and 10 illustrate the relative positions of the inertial blocking member 178 and the interference finger 188 of the bell crank assembly 174 during the acceleration phase. During the acceleration phase, the bell crank counterweight 182 can assert an inertial force outwardly, tending to rotate the bell crank assembly 174 and urge the crank finger 166 inwardly against the end of the latch arm 164. At the same time, the door handle grip 22 can also assert an inertial force outwardly. Due to the higher weight of the door handle grip 22 relative to the bell crank counterweight 182, the door handle grip 22 can move outwardly, tending to move the latch arm 164 outwardly and thereby urging rotation of the bell crank assembly 174 in opposition to the inertial force acting on the bell crank counterweight 182.

Meanwhile, the inertial blocking member 178 can rotate against the bias of the helical spring. The interference portion 192 can concurrently rotate toward the bell crank assembly 174 and latch arm 164, and the top wall stop boss 218 can move away from the stop end 234. During the acceleration phase, the rotation of the interference portion 192 can bring the inertial blocking member 178 into the hidden CG configuration, which can extend into the deformation phase. Consequently, the inertial blocking member 178 can be prevented from returning to an at-rest position, and the interference finger 188 can contact the interference portion 192, preventing rotation of the interference finger 188 downwardly and outwardly, thereby preventing rotation of the bell crank assembly 174 and movement of the door handle grip 22 during the deformation phase.

At the end of the deformation phase, the force exerted by the helical spring can return the inertial blocking member 178 to the at-rest configuration so that the release handle assembly 14 can be operated.

FIGS. 11-16B illustrate a second embodiment of the invention, which is similar to the first embodiment except for the incorporation of a blocking member retainer that extends the duration of the hidden CG configuration and the inertial blocking member engagement. Elements of the second embodiment common to the first embodiment are identified with like reference characters and will not be described except as necessary to a complete understanding of the invention.

Figure 12:
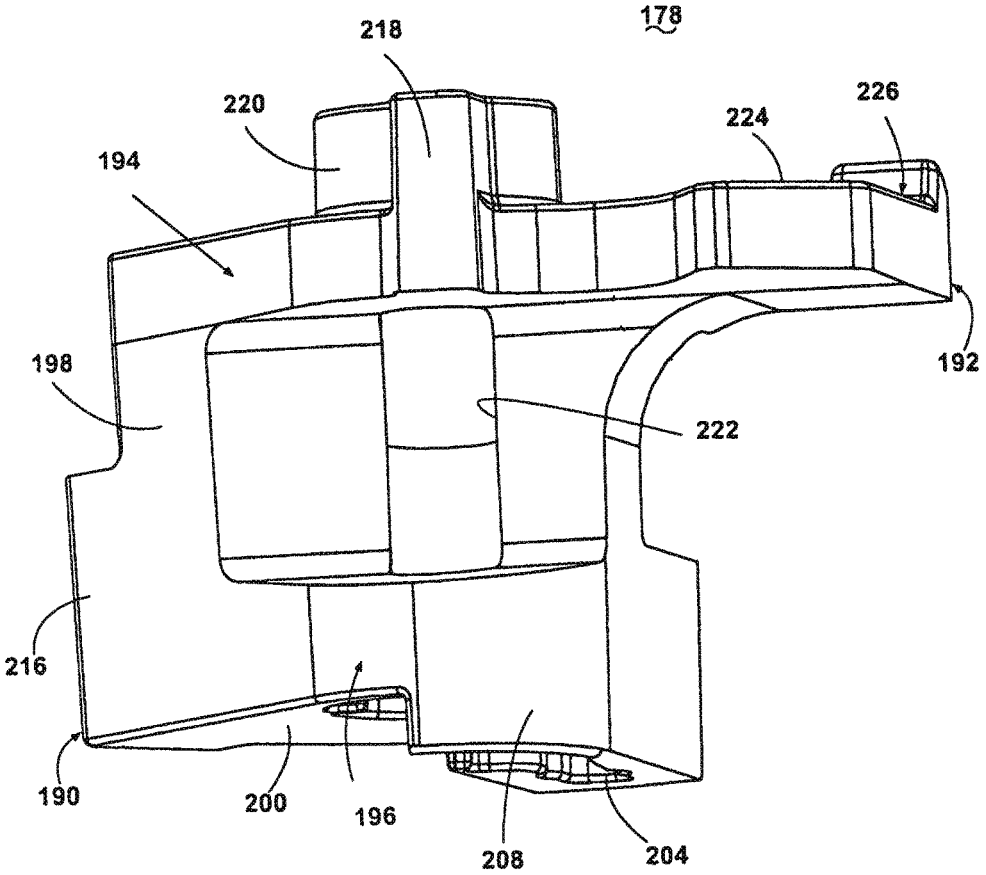
FIG. 12 is an enlarged perspective view of an inertial blocking member comprising an essential element of the inertial blocking member subassembly illustrated in FIG. 11.

FIG. 12 illustrates an inertial blocking member 178 having a blocking member retainer element comprising a generally rectilinear, somewhat brick-like blocking member stop 226 extending upwardly from the top surface of the interference portion 192 along an outer edge thereof. Not shown is a biasing member, such as a spring, which can be housed in the spring cavity 202 and, in addition to rotating the inertial blocking member 178 to an at-rest position, can urge the inertial blocking member 178 upwardly towards the upper support feature 228.

Figure 13A:
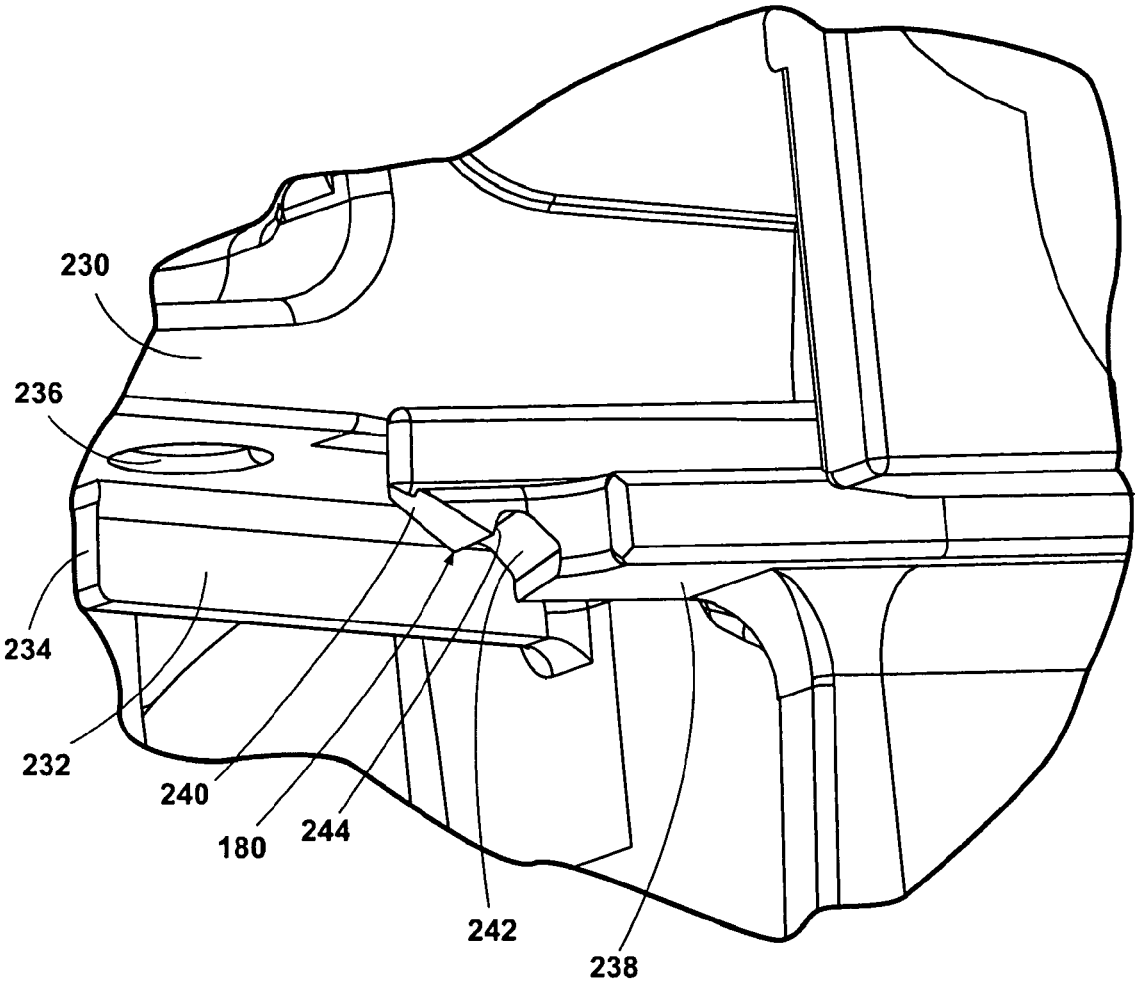
FIGS. 13A-B are alternate enlarged perspective views of a blocking member stop comprising a portion of the inertial blocking member subassembly illustrated in FIG. 11.
Figure 13B:
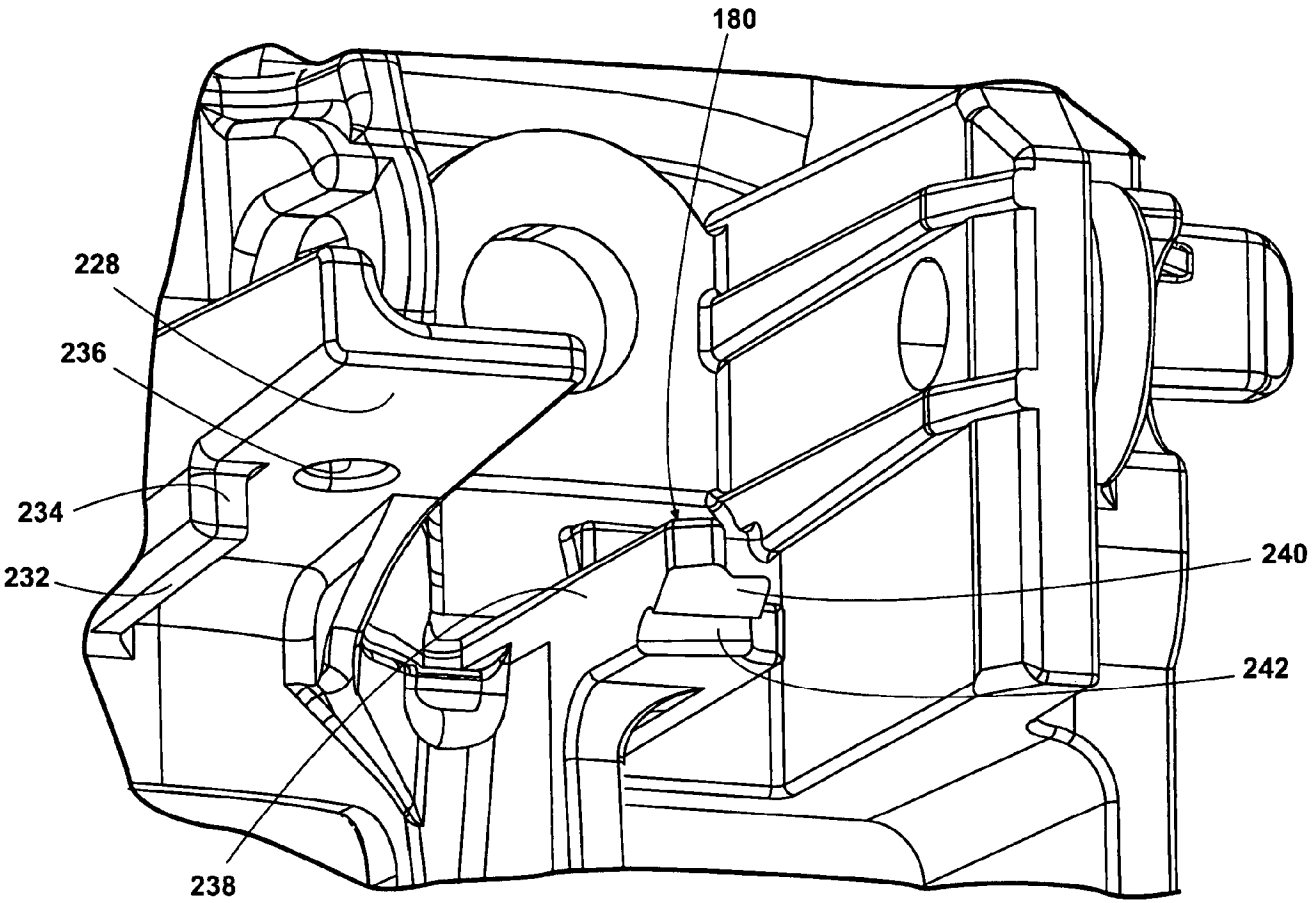

Referring to FIGS. 13 and 14, a frame projection 238 is an elongated, cantilevered beam-like structure extending inwardly from the release handle assembly framework 186. The frame projection 238 terminates in the blocking member retainer element comprising a blocking member catch 180. The blocking member catch 180 comprises an inclined face 240 transitioning outwardly to a concave surface 242 extending laterally across the frame projection 238, and defining a recess 248. The concave surface 242 transitions inwardly to an inclined face 244 intersecting the inclined face 240. The blocking member catch 180 and blocking member stop 226 are configured for cooperative interconnection as hereinafter described.

Figure 14A:
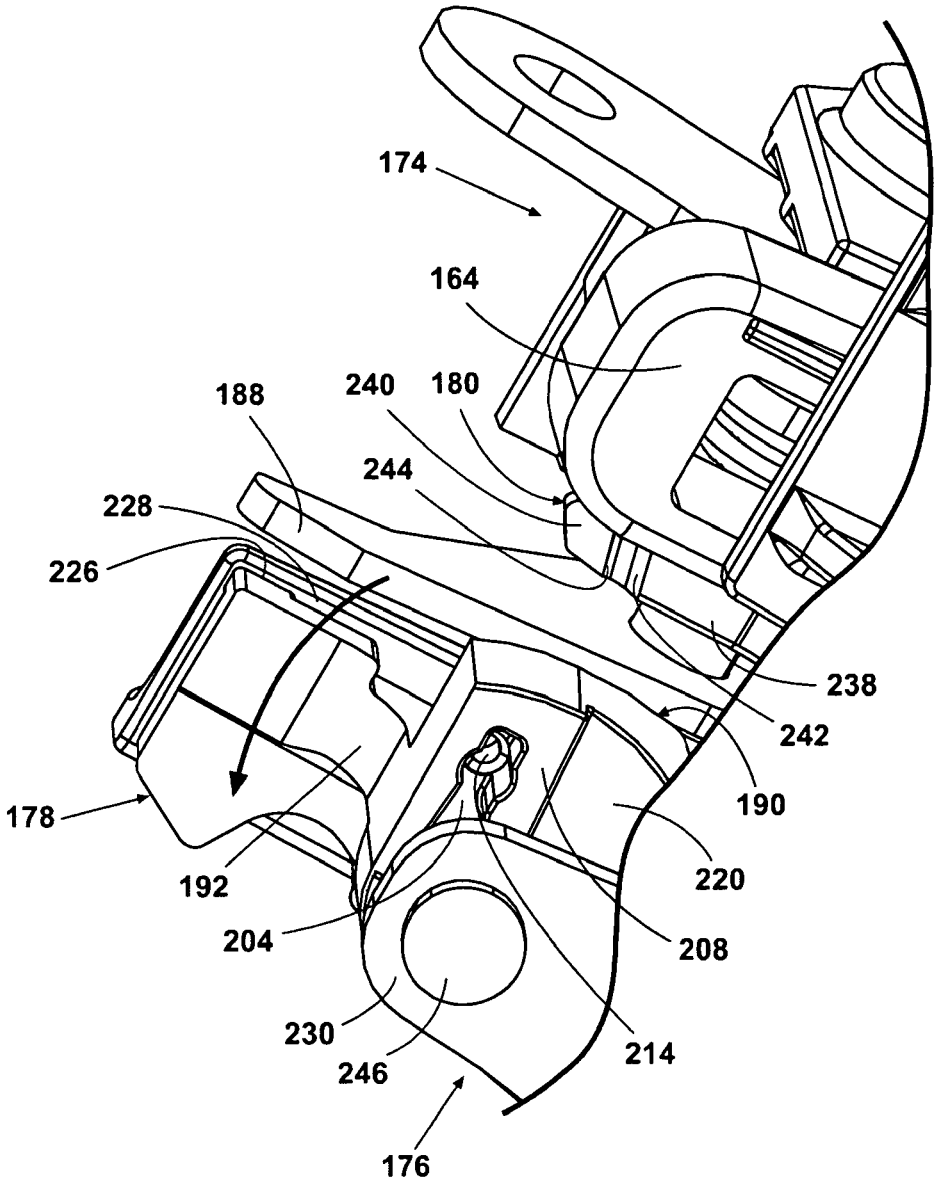
FIGS. 14A-B are alternate enlarged perspective views of the inertial blocking member and blocking member stop of FIG. 11 in an at-rest configuration.
Figure 14B:
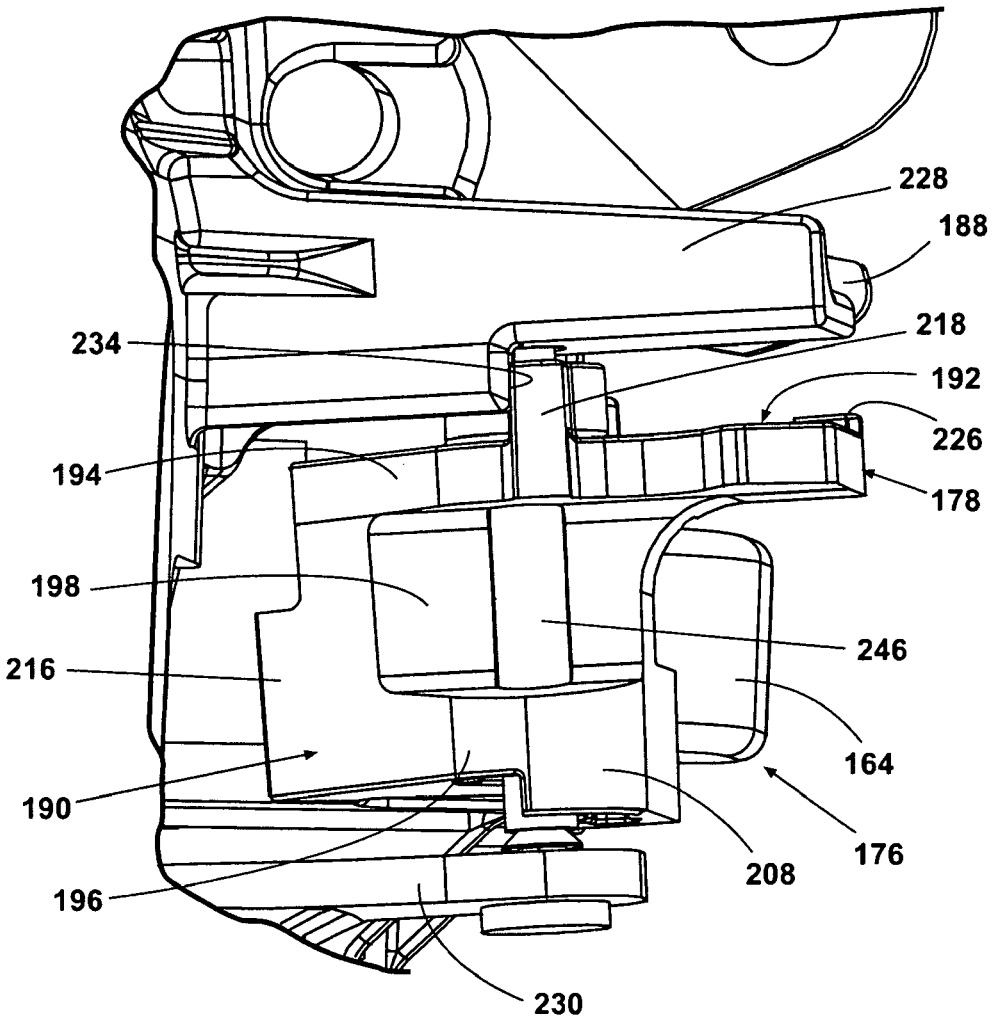

FIGS. 14A-B illustrate the inertial blocking member subassembly 176 in an at-rest position. In this configuration, pulling on the door handle grip 22 can rotate the bell crank assembly 174 and the interference finger 188 without interference from the inertial blocking member 178.

Figure 15A:
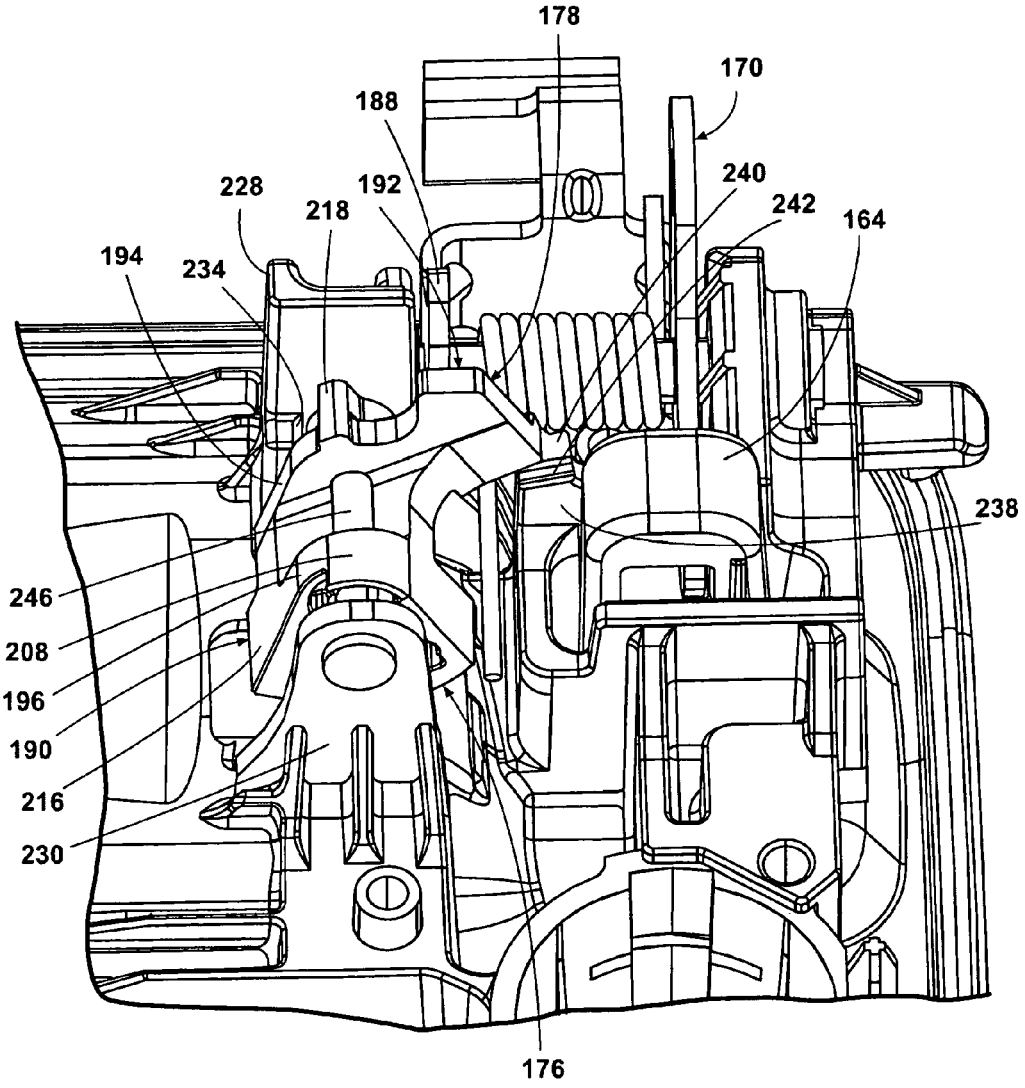
FIGS. 15A-C are alternate enlarged perspective views of the inertial blocking member and blocking member stop of FIG. 11 during an impact tending to influence the activation of the vehicle release handle assembly.
Figure 15B:
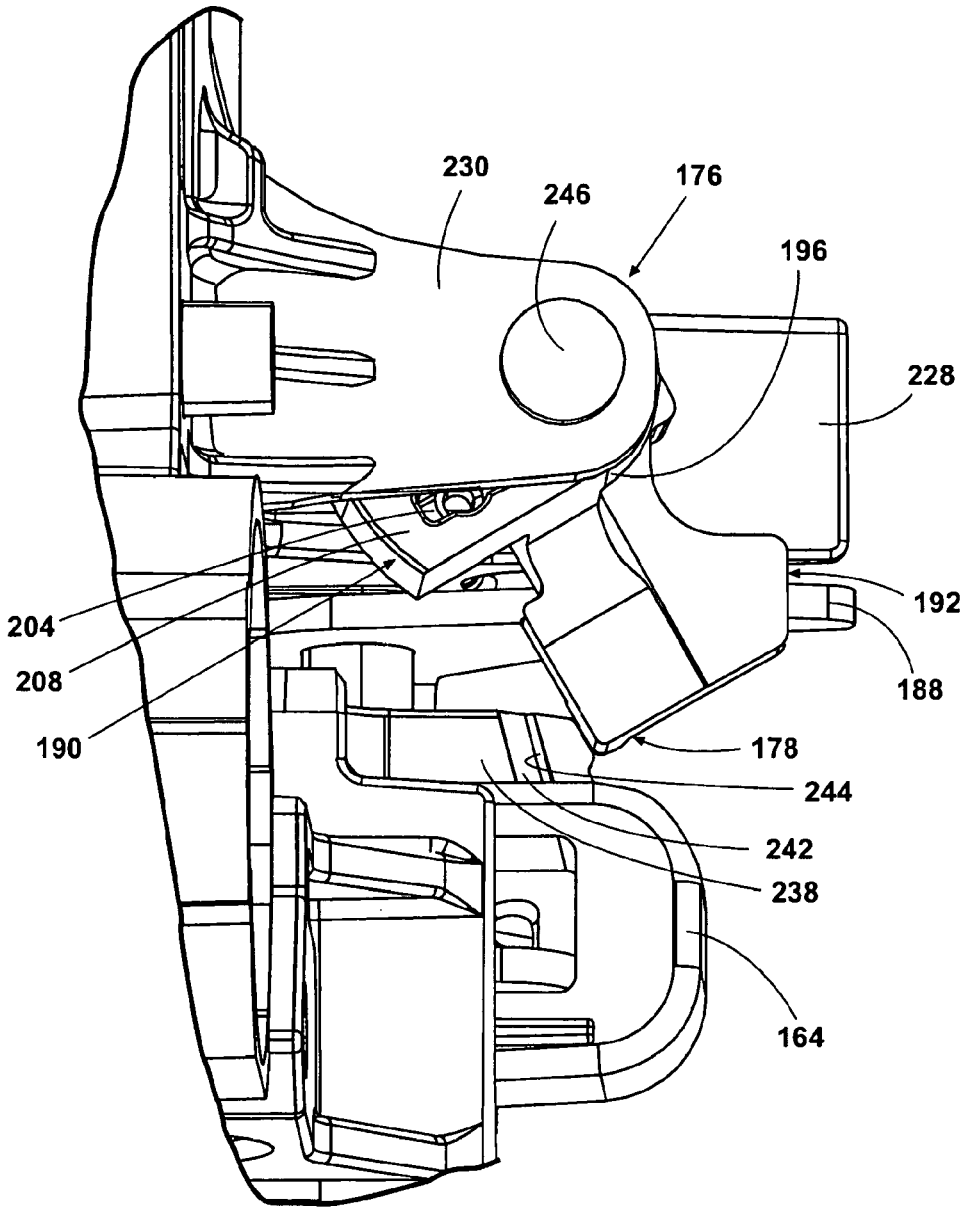
Figure 15C:
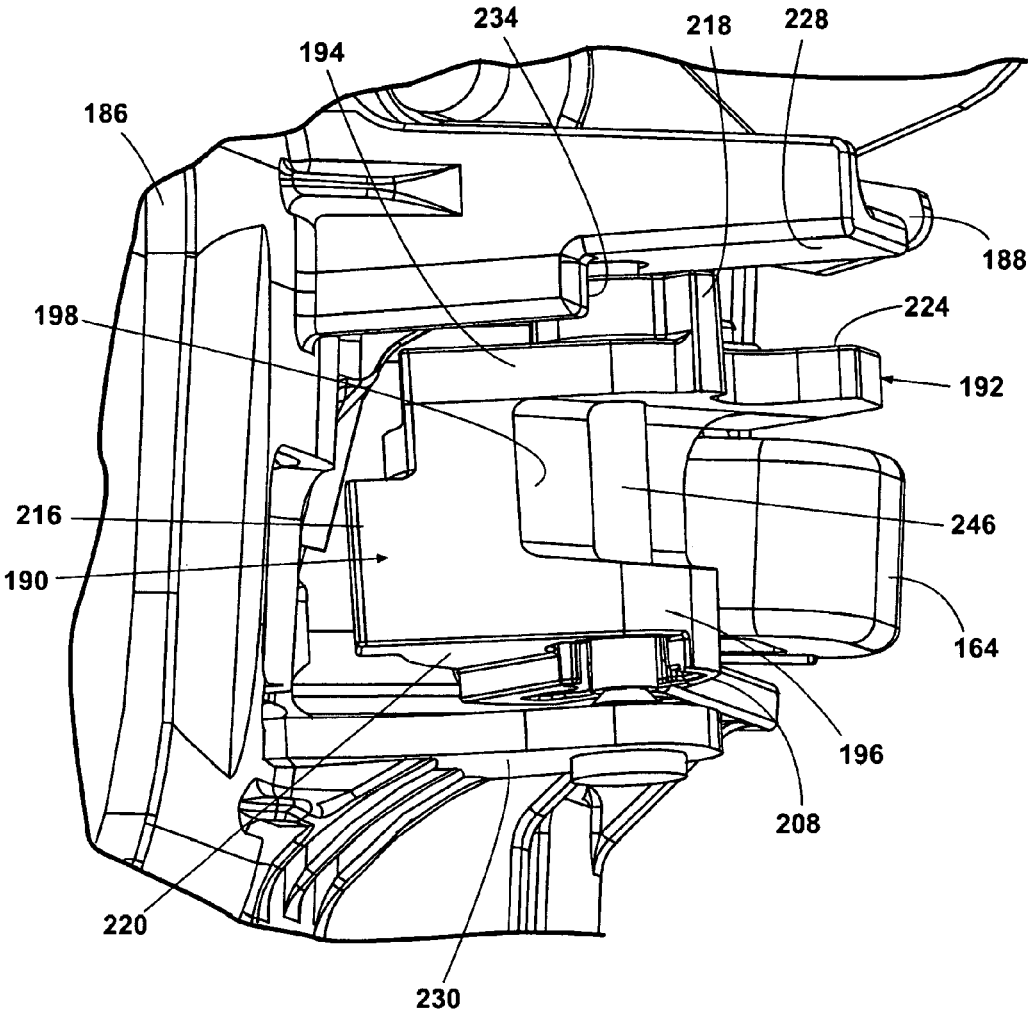

FIGS. 15A-C illustrate the relative positions of the inertial blocking member 178 and the interference finger 188 of the bell crank assembly 174 during the acceleration phase. Activation of the inertial blocking member subassembly 176 during the acceleration phase progresses generally as described above with respect to the first embodiment. The hidden CG counterweight portion 190 can urge the inertial blocking member 178 to rotate into the hidden CG configuration.

Figure 16A:
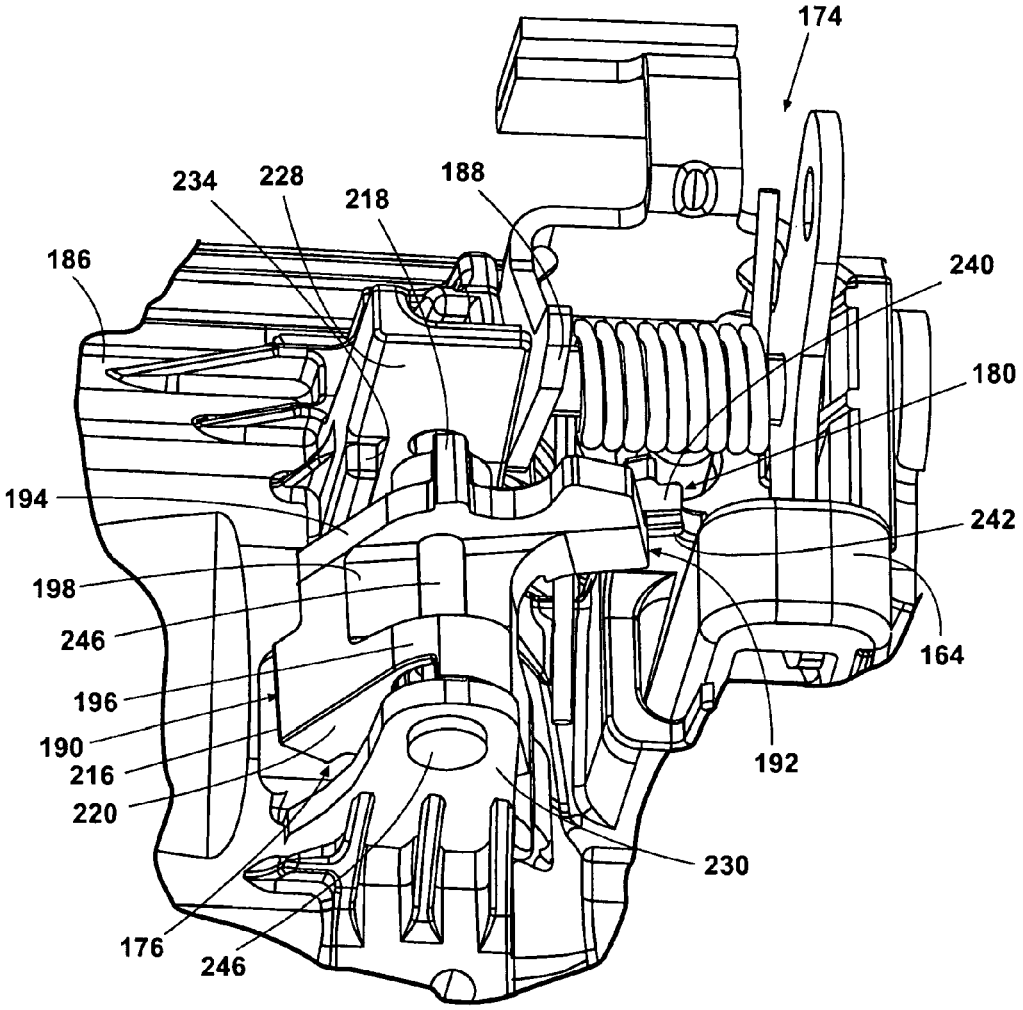
FIGS. 16A-B are alternate enlarged perspective views of the inertial blocking member subassembly of FIG. 11 illustrating the inertial blocking member in position relative to the blocking member stop to prevent the return of the inertial blocking member to the at-rest configuration.
Figure 16B:
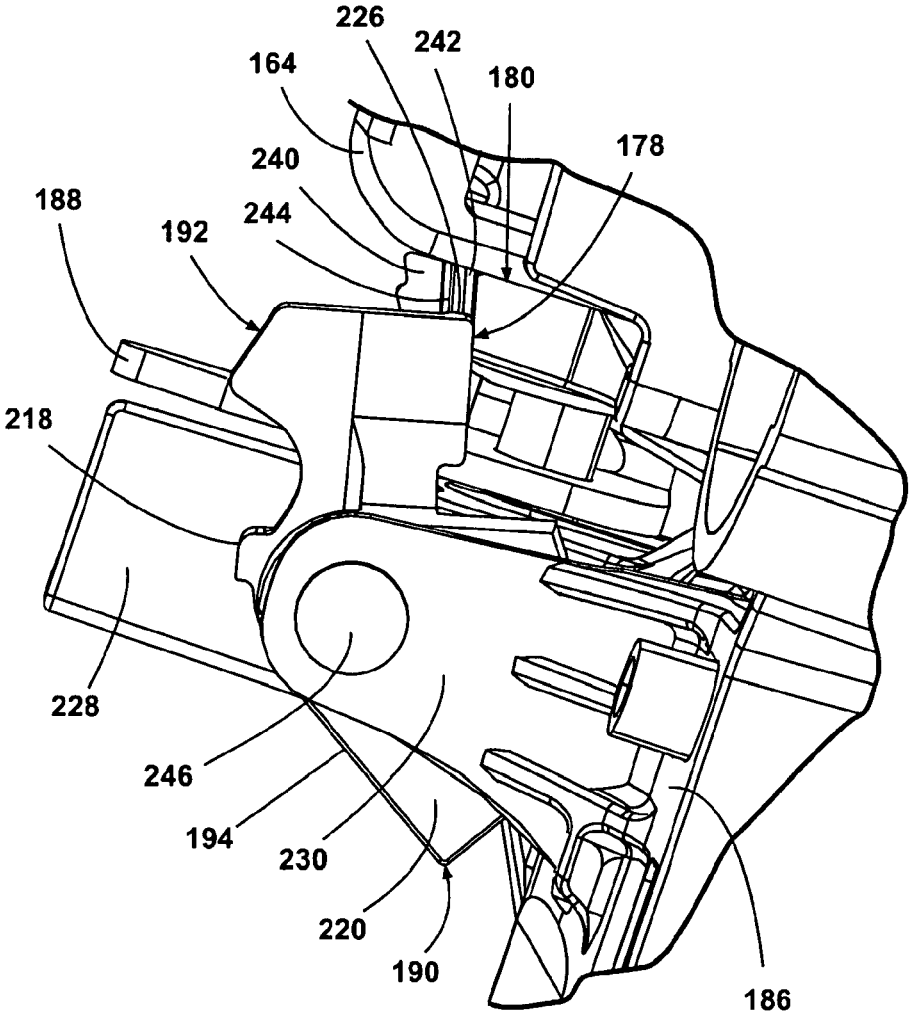

At a later time period, which can be during the end of the acceleration phase, or during the deformation phase, the inertial blocking member 178 can rotate sufficiently into the hidden CG configuration with the interference portion 192 aligned with the frame projection 238 so that the inertial blocking member stop 226 can travel along the inclined face 240 and into the recess 248. As illustrated in FIGS. 16A-B, this can urge the inertial blocking member 178 downward toward the lower support feature 230, against the upwardly-directed force of the biasing member, thereby coupling the stop 226 and catch 180. The upwardly-directed force of the biasing member can retain the inertial blocking member stop 226 in the recess 248, and the inertial blocking member 178 in a blocking configuration beyond the end of the impact event.

At the end of the impact event, pulling on the door handle grip 22 can rotate the interference finger 188 downwardly against the interference portion 192, moving the inertial blocking member 178 away from the frame projection 238 to separate the inertial blocking member stop 226 from the recess 248, thereby enabling the biasing member to return the inertial blocking member 178 to the at-rest configuration.

FIGS. 17A-22 illustrate a third embodiment of an inertial blocking member subassembly which is similar to the first and second embodiments except for the incorporation of an alternate blocking member retainer to increase the duration of the hidden CG configuration and extend the blocking of the release handle assembly. Elements of the third embodiment common to the first and second embodiments are identified with like reference characters and will not be described except as necessary to a complete understanding of the invention.

Figure 17A:
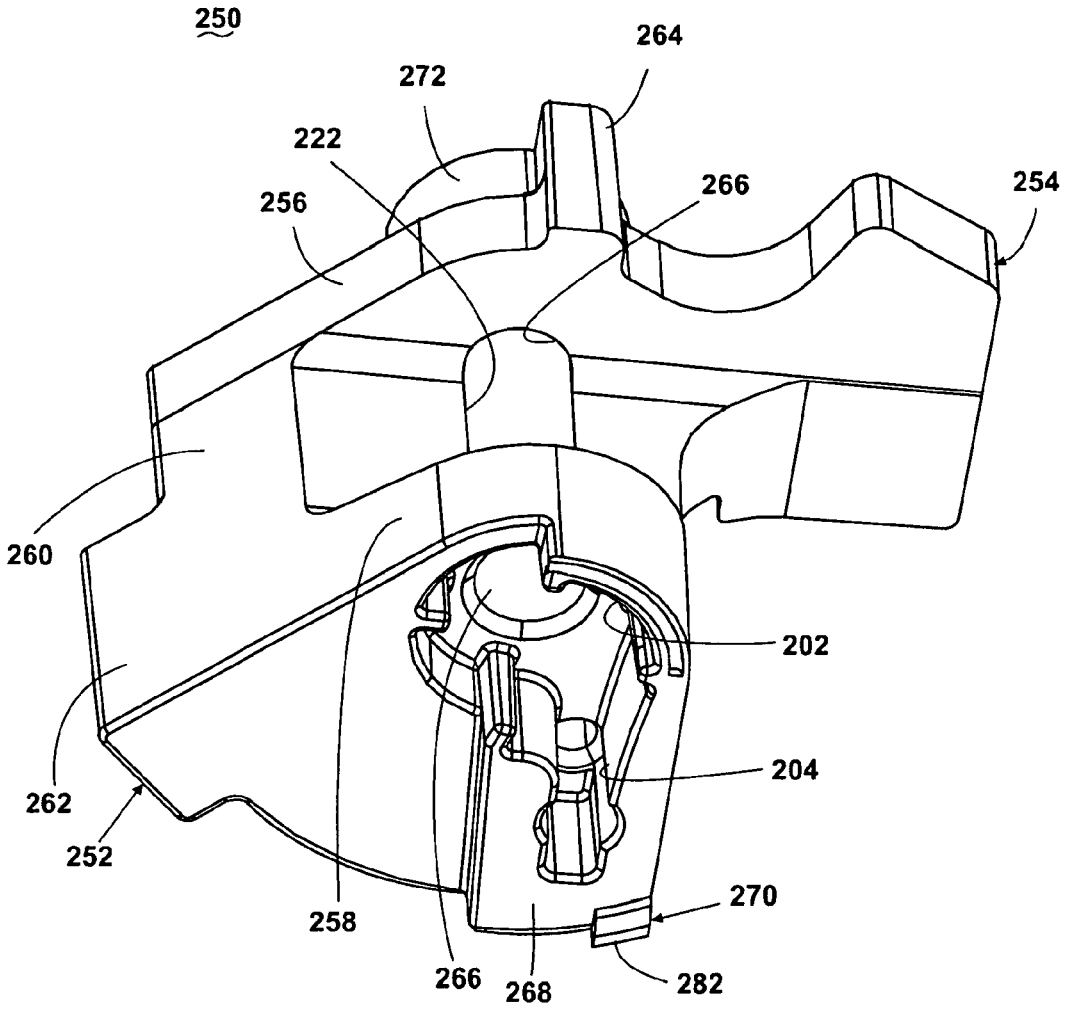
FIGS. 17A-C are alternate enlarged perspective views of an inertial blocking member comprising a third embodiment of an inertial blocking member subassembly having a retaining element.
Figure 17B:
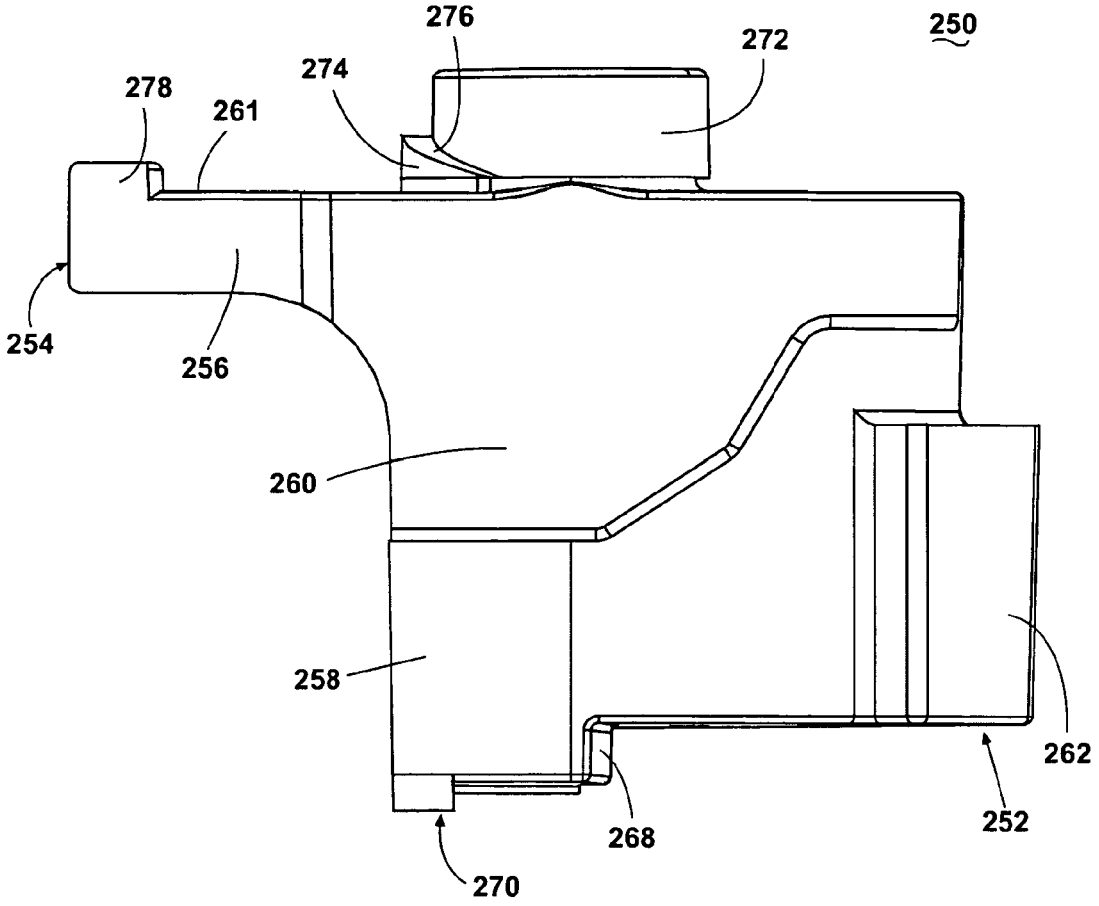
Figure 17C:
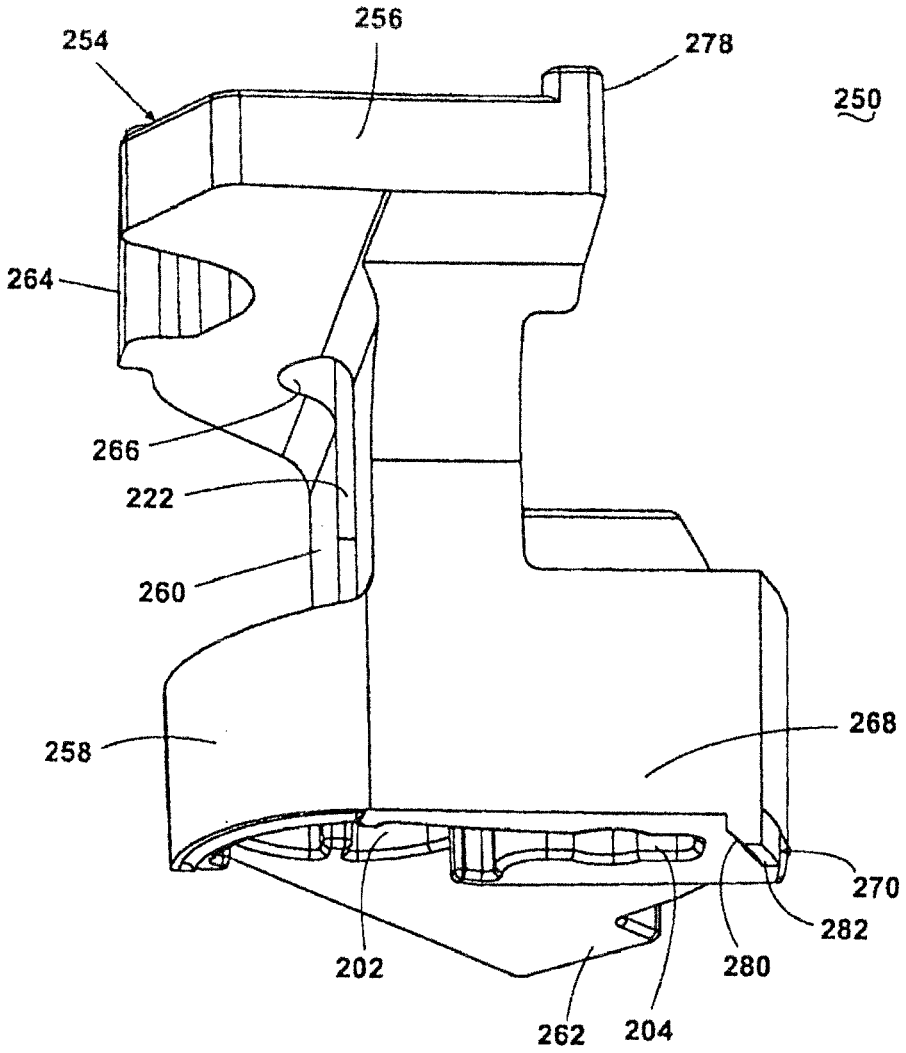
Figure 18A:
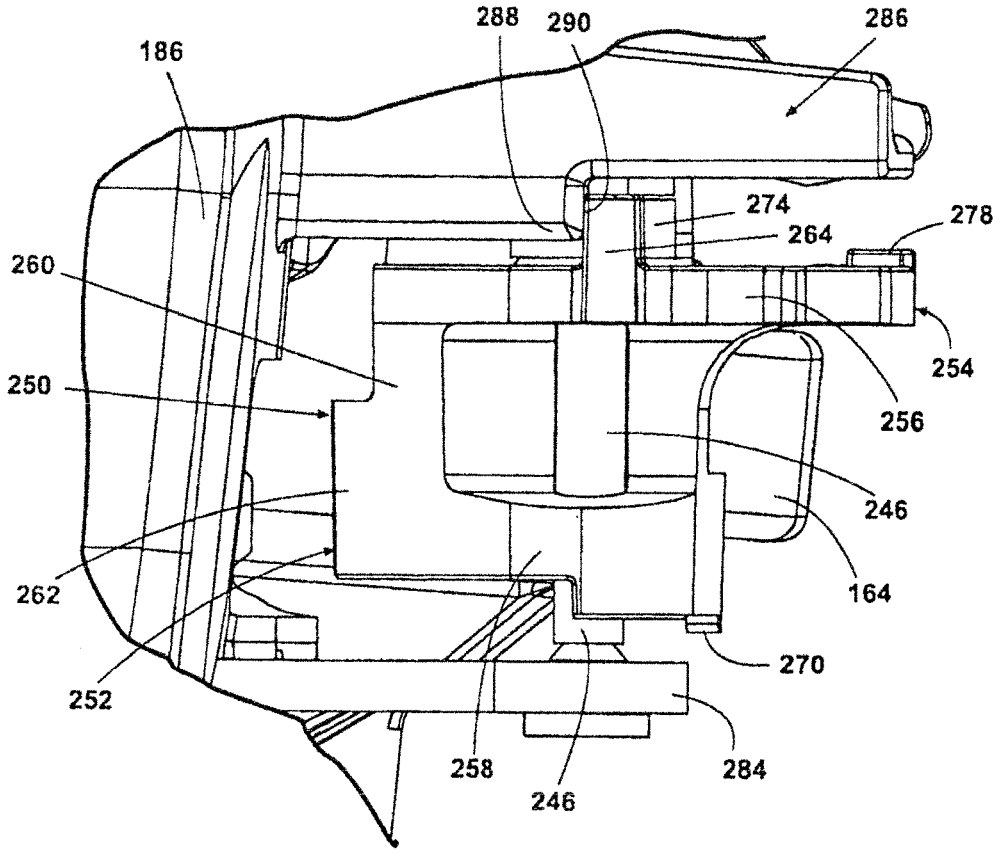
FIGS. 18A-B are alternate enlarged perspective views of the inertial blocking member of FIGS. 17A-C in an at-rest configuration, and an arcuate wedge wall comprising a portion of the inertial blocking member subassembly.

The third embodiment comprises an inertial blocking member 250, illustrated in FIGS. 17A-C, which is rotatably mounted between a lower support feature 284 and an upper support feature 286 by the pin 246 (FIG. 18A). The inertial blocking member 250 is urged toward the at-rest position and upwardly toward the upper support feature 286 by a suitable biasing member, such as a helical spring (not shown), which can be disposed concentrically with the pin 246. Extending inwardly from the release handle assembly framework 186 is an elongated, somewhat cantilevered frame projection 308 terminating in an orthogonally-disposed planar stop surface 310.

Referring to FIGS. 17A-C, the inertial blocking member 250 comprises a hidden CG counterweight portion 252 and an interference portion 254. The hidden CG counterweight portion 252 comprises a bottom wall 258. The interference portion 254 comprises a top wall 256. The top wall 256 is joined with the bottom wall 258 by a side wall 260.

The bottom wall 258 transitions to a radially-disposed bottom wall projection 262, and the top wall 256 transitions to a radially-disposed top wall stop boss 264. A pin aperture 266 extends coaxially through the top wall 256 and the bottom wall 258. A high wall 268 depends perimetrically around an elongated spring channel 204 and part of a circular spring cavity 202. A first blocking member retainer element comprises a high wall boss 270 projecting downwardly from an outer corner edge of the high wall 268, and having a radially inwardly-directed inclined face 280 transitioning radially-outwardly to a parallel face 282.

The upper surface of the interference portion 254 has a generally rectilinear inertial blocking member stop 278 extending upwardly therefrom for engagement with the stop surface 310 to limit rotation of the inertial blocking member 250 away from the at-rest position. A second blocking member retainer element comprises an annular collar 272 projecting orthogonally from the upper surface of the inertial blocking member 250 concentric with the pin aperture 266. Spaced radially away from the collar 272 is a third blocking member retainer element comprising a semi-annular arcuate wedge 274 having an upwardly-directed inclined face 276.

Figure 21:
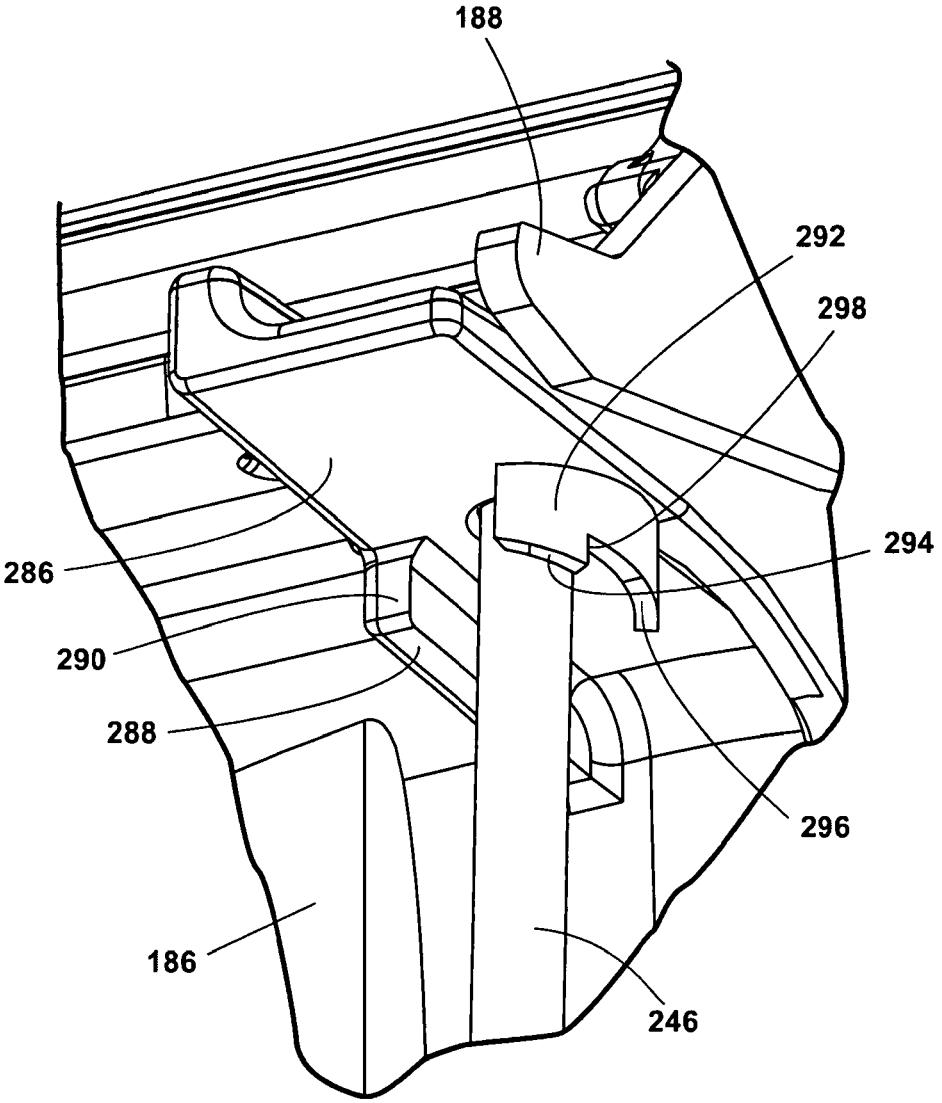
FIG. 21 is an enlarged perspective view of the arcuate wedge wall and an upper support feature of FIGS. 17A-C.

As illustrated in FIG. 21, the upper support feature 286 has a fourth blocking member retainer element comprising a downwardly-projecting semi-annular arcuate wedge wall 292 configured for registry with the arcuate wedge 274 when the inertial blocking member 250 is mounted between the lower support feature 284 and the upper sport feature 286. The arcuate wedge wall 292 comprises a first inclined face 294 transitioning to a second inclined face 296 through a vertical face 298. The inclined faces 292, 296 are oriented for slidable registry with the inclined face 276 of the arcuate wedge 274. The upper support feature 286 also comprises a stop wall 288 terminating in a stop end 290.

Figure 18B:
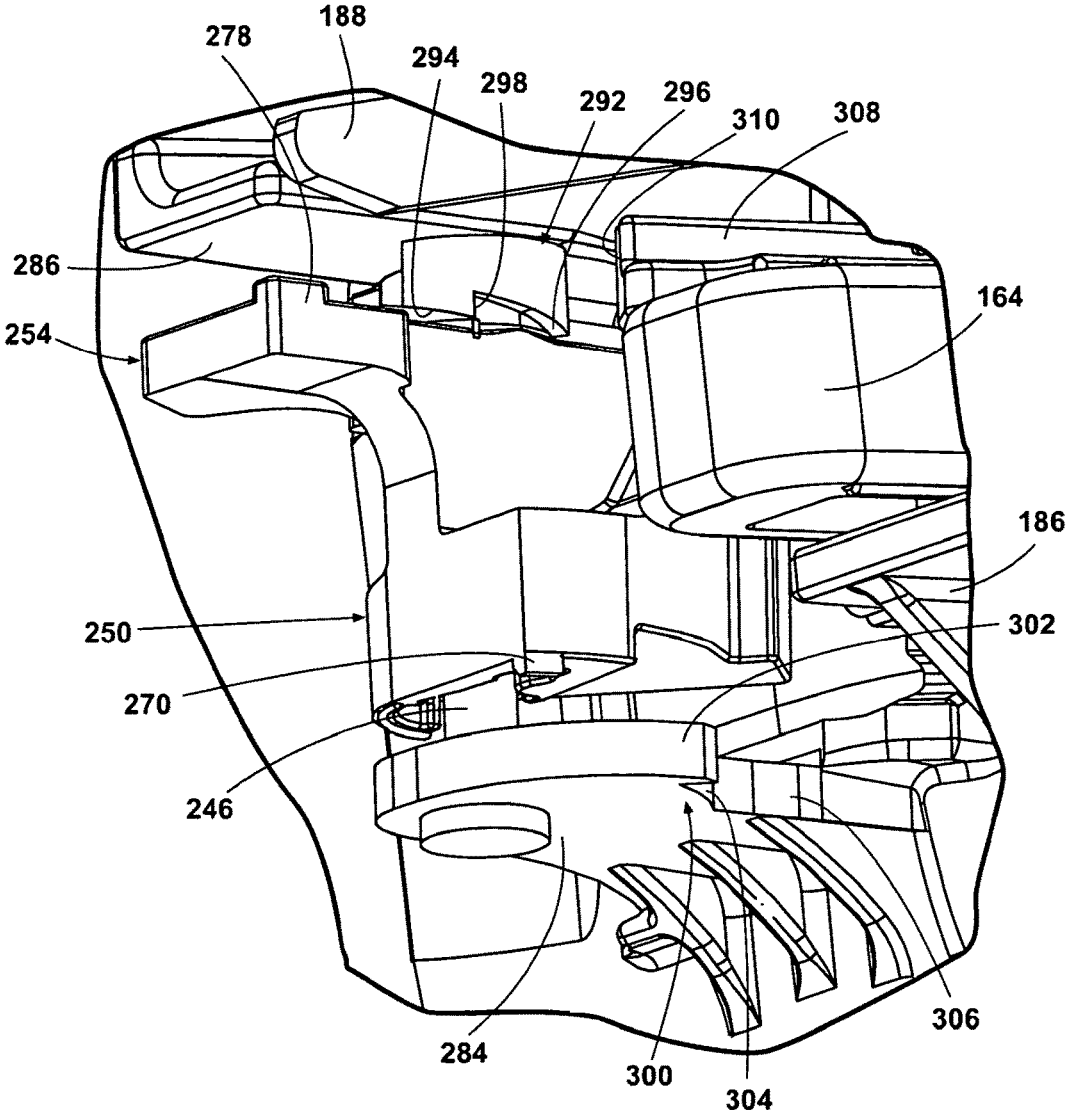
Figure 22:
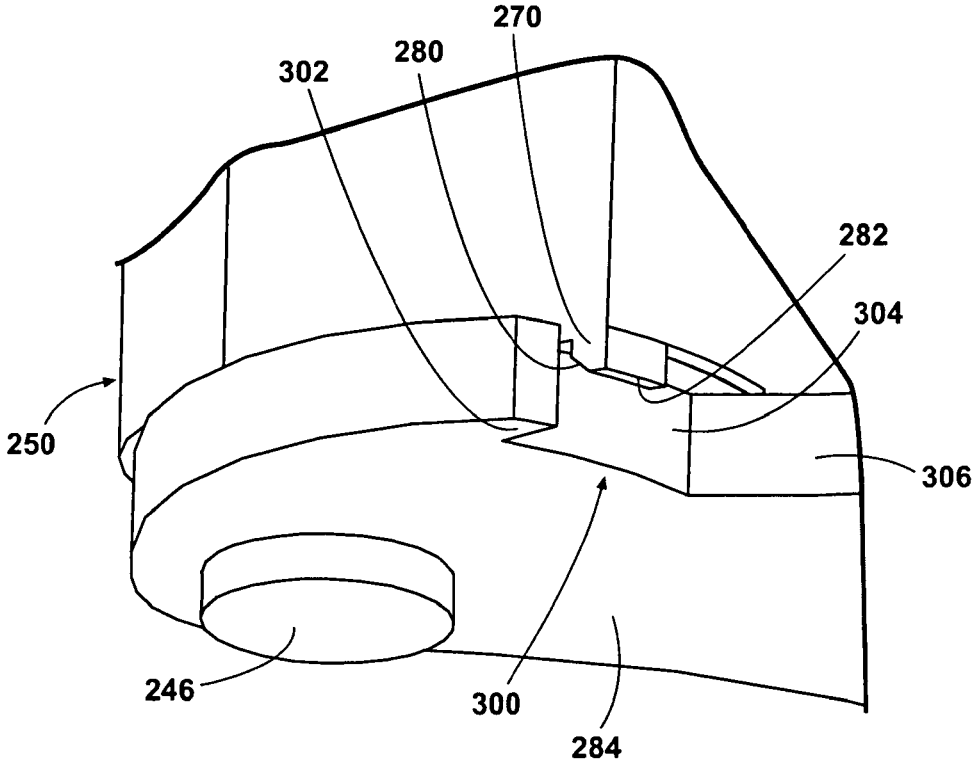
FIG. 22 is an enlarged perspective partial view of the lower support feature and inertial blocking member of FIGS. 17A-C.

As illustrated in FIGS. 18B and 22, the lower support feature 284 has a cutout 300 extending into the lower support feature 284 and defined by a cantilever wall 302 transitioning through a curved face 304 to a planar return face 306. The cutout 300 is adapted for interfering registry with the high wall boss 270.

FIGS. 18A-B illustrate the relative positions of the inertial blocking member 250, the lower support feature 284, and the upper support feature 286 in an at-rest position. In this configuration, the inertial blocking member 250 can be urged by the helical spring in a clockwise direction so that the top wall stop boss 264 contacts the stop end 290, thereby preventing further rotation of the inertial blocking member 250 and orienting the center of gravity of the inertial blocking member 250 in an optimal position relative to the axis of rotation, i.e. the pin 246, for satisfactory operation in the event of an impact. Additionally, the inertial blocking member 250 can be biased upwardly toward the upper support feature 286 as previously described.

In the at-rest configuration, the arcuate wedge 274 can be spaced circumferentially away from the arcuate wedge wall 292. The interference portion 254 can extend generally below the upper support feature 286 laterally of the bell crank assembly 174. The center of mass of the inertial blocking member 250 can be offset from the axis of rotation toward the latch arm 164. Pulling on the door handle grip 22 can operate the bell crank assembly 174 without interference from the inertial blocking member 250; the interference finger 188 can rotate downwardly without contacting the interference portion 254.

Figure 19A:
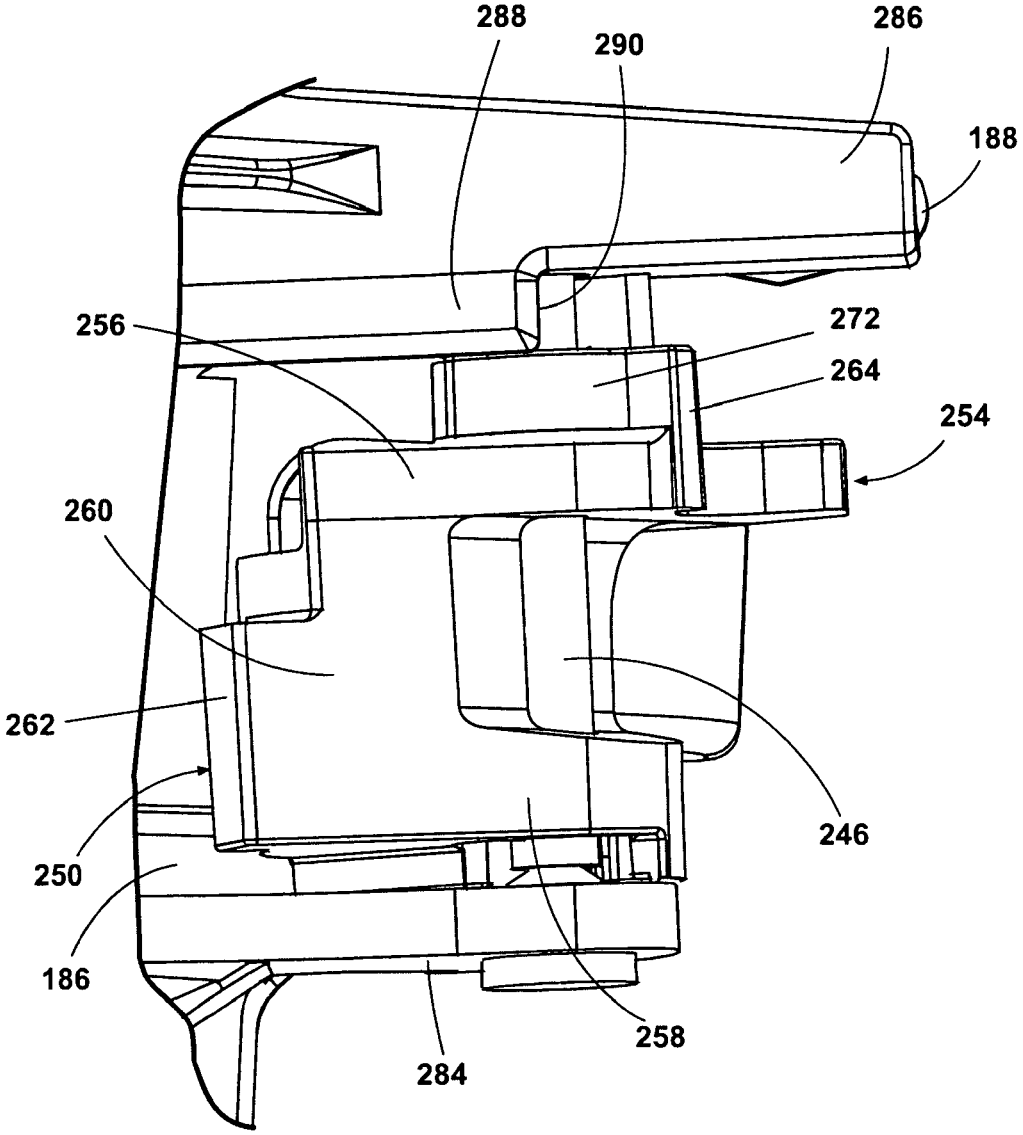
FIGS. 19A-B are alternate enlarged perspective views of the inertial blocking member and arcuate wedge wall of FIGS. 17A-C during an impact tending to influence the activation of the vehicle release handle assembly.
Figure 19B:
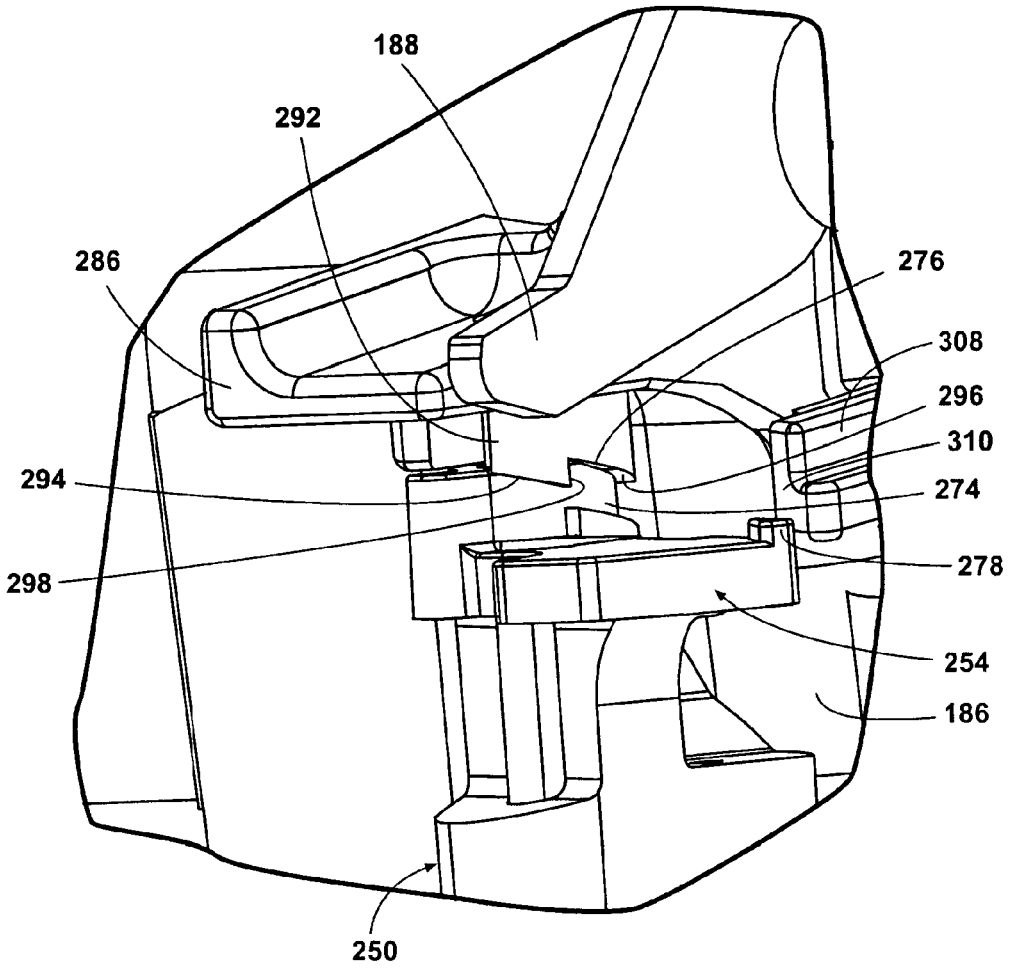

FIGS. 19A-B illustrate the relative positions of the inertial blocking member 250, the lower support feature 284, and the upper support feature 286 during the acceleration phase. During the acceleration phase, the inertial blocking member 250 can rotate against the bias of the helical spring so that the interference portion 254 rotates toward the bell crank assembly 174 and the latch arm 164. The inclined face 276 of the arcuate wedge 274 can contact and move along the first inclined face 294 of the arcuate wedge wall 292, urging the inertial blocking member 250 downward toward the lower support feature 284 against the force of the biasing member. The high wall boss 270 can also be urged toward the upper surface of the lower support feature 284. The interference finger 188 can concurrently rotate downward to contact the inertial blocking member 250. However, the inertial blocking member 250 can be prevented from downward movement, and the interference finger 188 from rotating downward, by contact of the high wall boss 270 with the upper surface of the lower support feature 284.

Figure 20A:
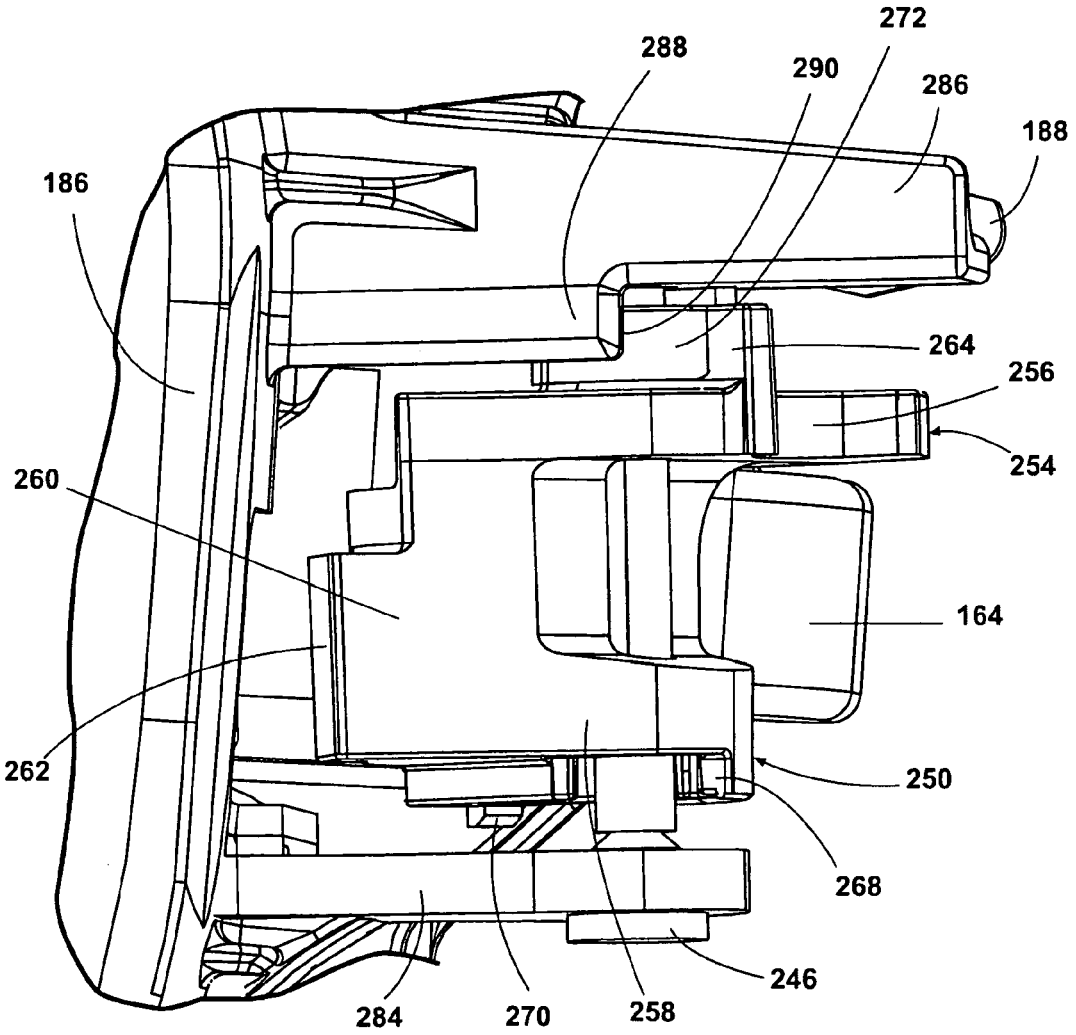
FIGS. 20A-B are alternate enlarged perspective views of the inertial blocking member and arcuate wedge wall of FIGS. 17A-C illustrating the inertial blocking member subassembly in position to prevent the return of the bell crank actuator to the at-rest configuration.
Figure 20B:
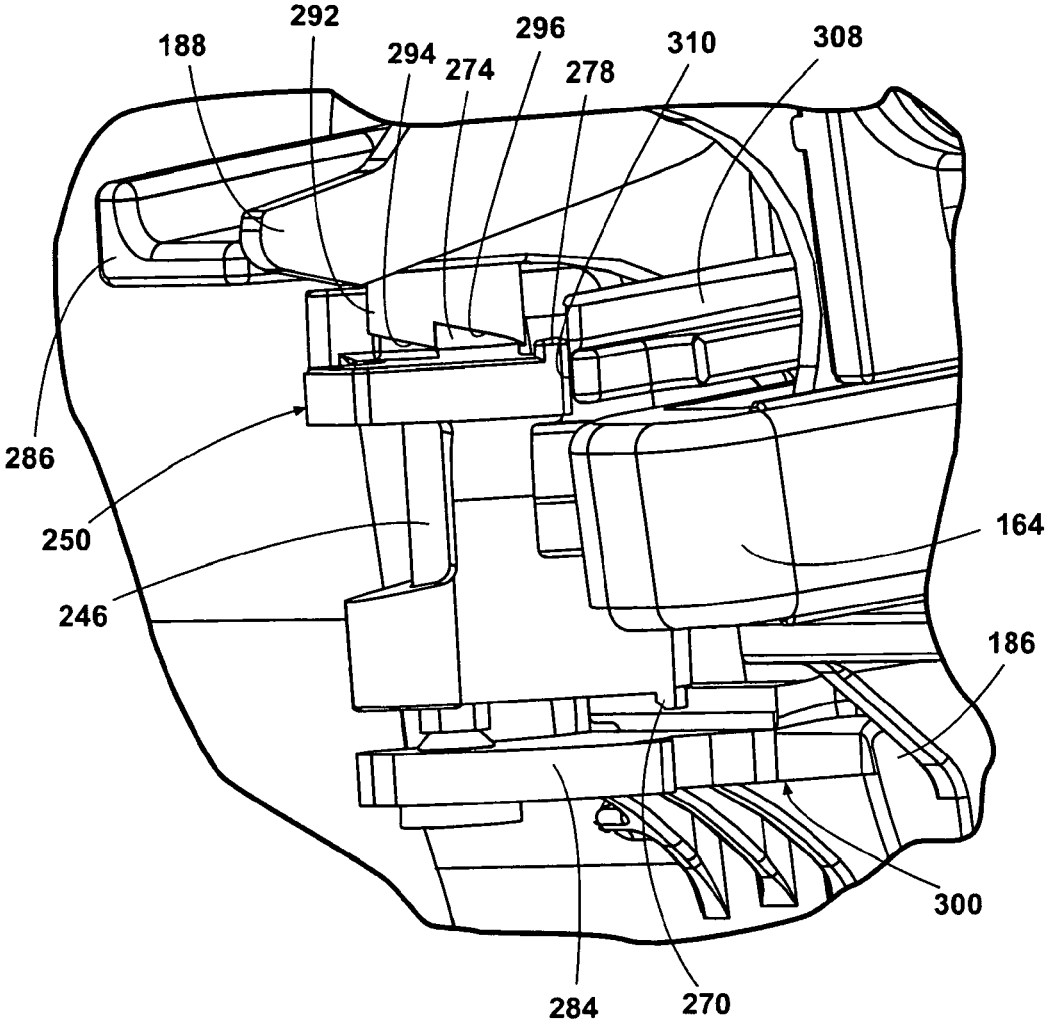

Referring now to FIGS. 20A-B, as the inertial blocking member 250 continues to rotate, the inertial blocking member 250 can continue to move downward as the arcuate wedge 274 traverses the inclined face 294. At the same time, the high wall boss 270 can "drop" into the cutout 300 (FIG. 22) by the action of the interference finger 188 and/or the travel of the arcuate wedge 274 along the inclined face 294, thus preventing rotation of the blocking member 250 back toward the at-rest position. When the wedge 274 clears the vertical face 298 of the arcuate wedge wall 292, the inertial blocking member 250 can be urged upward, bringing the arcuate wedge 274 into contact with the second inclined face 296. Rotation of the inertial blocking member 250 back toward the at-rest position can be prevented by the engagement of the arcuate wedge 274 with the vertical face 298, continuing the blocking of the interference finger 188 and preventing the unintended operation of the release handle assembly 14 and opening of the door assembly 12 during and after the deformation phase.

At the end of the impact event, pulling on the door handle grip 22 can rotate the interference finger 188 downwardly against the interference portion 254, urging the inertial blocking member 250 downward and separating the arcuate wedge 274 from the arcuate wedge wall 292 so that the inertial blocking member 250 can return to the at-rest position under the influence of the biasing member. As the arcuate wedge 274 traverses the arcuate wedge wall 292, the high wall boss 270 remains in the cutout 300 until the wedge 274 clears the wedge wall 292, at which time the upward movement of the blocking member 250 can enable the high wall boss 270 to clear the cutout 300. It may be necessary to release and pull the door handle grip 22 a second time, after the inertial blocking member 250 has returned to the at-rest configuration to enable unimpeded operation of the bell crank assembly 174.

Figure 23:
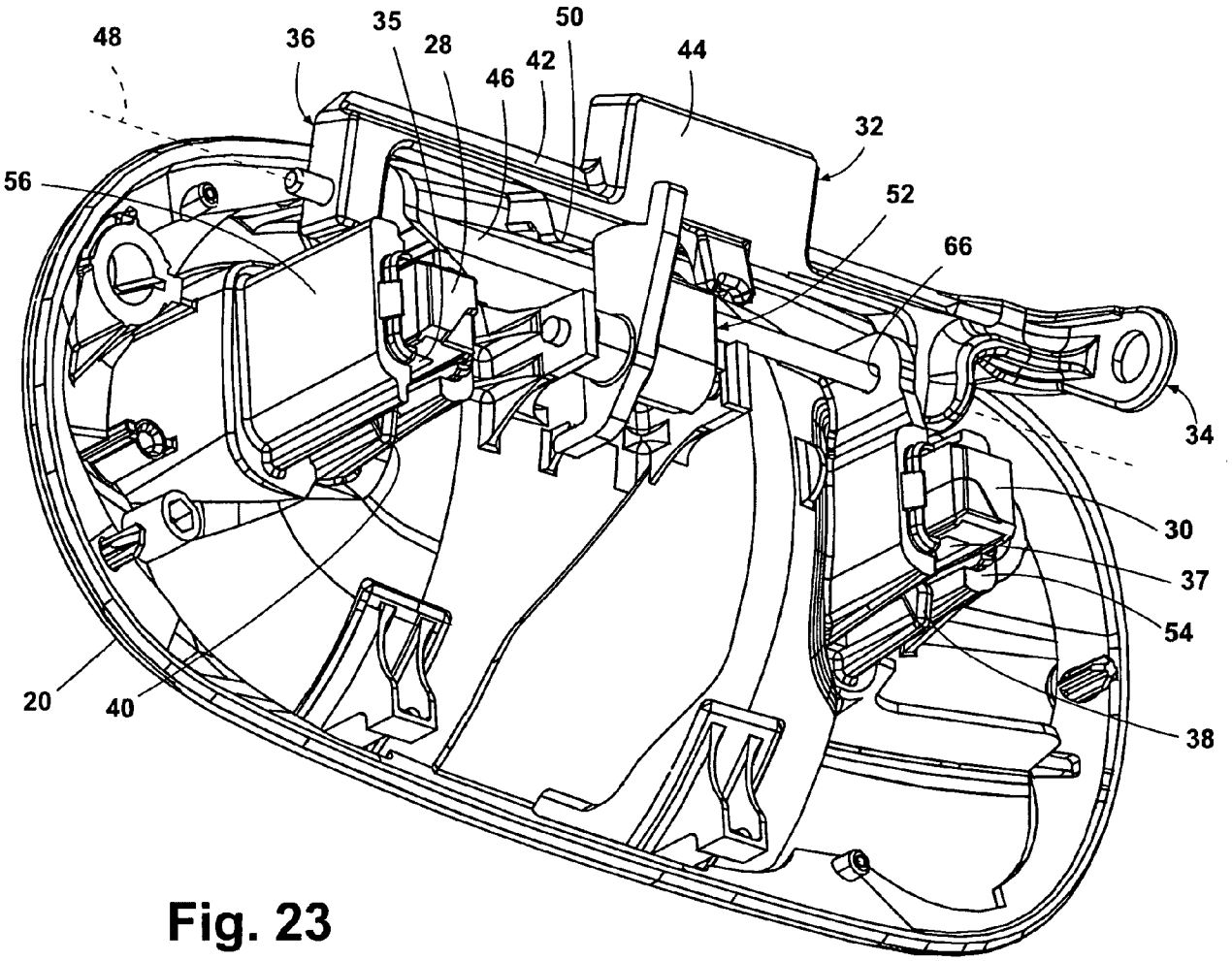
FIG. 23 is a perspective view of a vehicle release handle assembly illustrating a fourth embodiment of an inertial blocking member subassembly having a retaining element.
Figure 24:
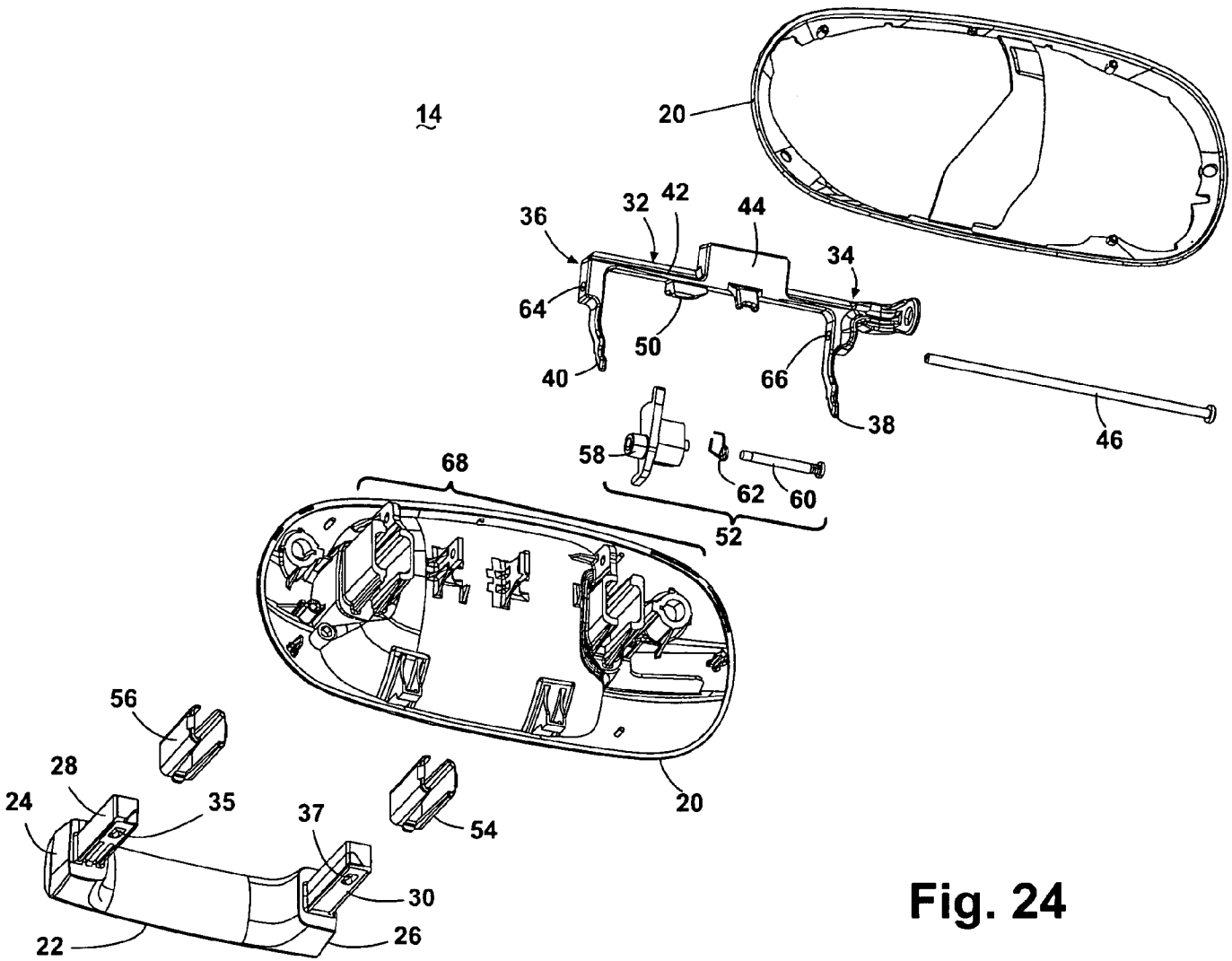
FIG. 24 is an exploded view of the vehicle release handle assembly of FIG. 23.

FIGS. 23-28 illustrate a fourth embodiment of the invention. The door handle grip 22 comprises a support end 24 and an opposed latch end 26. Extending somewhat orthogonally away from the door handle grip 22 at the support end 24, as illustrated in FIGS. 23 and 24, is an elongated support arm 28 having a generally constant cross-section, illustrated herein as generally rectilinear. Similarly, extending orthogonally away from the door handle grip 22 at the latch end 26 is a latch arm 30 having a generally rectilinear cross-section.

Each arm 28, 30 terminates proximate its inward end in a vertically disposed rectilinear slot 35, 37, respectively. The support arm 28 and the latch arm 30 are slidably received within complementary tube-like handle sleeves 56, 54, respectively, rigidly coupled with the escutcheon 20. Pulling on the door handle grip 22 from the exterior side of the vehicle 10 can slidably translate the arms 28, 30 toward the exterior of the door assembly 12.

A bell crank actuator 32 is an elongated body having a crank end 34 and an opposed support end 36, joined by an elongated connecting beam 42. The crank end 34 comprises a bell crank for operable coupling with the vehicle door latch (not shown), and angular movement about an axis of rotation 48.

Extending generally orthogonally downwardly away from the connecting beam 42 at the crank end 34 is an elongated crank finger 38. Extending generally orthogonally downwardly away from the connecting beam 42 at the support end 36 is an elongated support finger 40. The fingers 38, 40 are adapted for slidable coupling with the slots 37, 35, so that pulling of the door handle grip 22 and translation of the arms 28, 30 outwardly of the door assembly 12 can pull the fingers 38, 40 outwardly.

The fingers 38, 40 are somewhat angular so as to facilitate this movement. However, the fingers 38, 40 can be any configuration suitable for the purposes described herein. The fingers 38, 40 are adapted with apertures 66, 64, respectively, for receipt of a pivot pin 46 therethrough, enabling the bell crank actuator 32 to rotate about the axis of rotation 48 which is spaced from and generally orthogonal to the fingers 38, 40.

The pin 46 is a slender, cylindrical, rod-like member that can be rotatably supported in a suitable manner, such as by a rigid frame or escutcheon subassembly 68, to which various elements of the release handle assembly 14 can also be coupled.

Extending away from the connecting beam 42 at approximately the mid-point thereof, and opposite the fingers 38, 40, is a block-like bell crank counterweight 44 projecting generally upwardly. Projecting generally downwardly away from the connecting beam 42, somewhat offset from the mid-point of the connecting beam 42 and the bell crank counterweight 44, is a blocking member retainer element comprising a translation boss 50 having a downwardly disposed inclined face. Adjacent the translation boss 50 and generally downwardly therefrom is an inertial blocking member subassembly 52 comprising an inertial blocking member 58 suspended by a mounting pin 60 (FIG. 24). The mounting pin 60 is supported by a pair of pillow blocks 122, 124 fixedly attached to a suitable portion of the release handle assembly 14, such as a rigid frame, subassembly, or the escutcheon 20, and associated with a biasing member or return spring 62. The pillow block 124 is provided at an innermost end with a blocking member retainer element comprising a laterally projecting stop block 126.

Figure 25A:
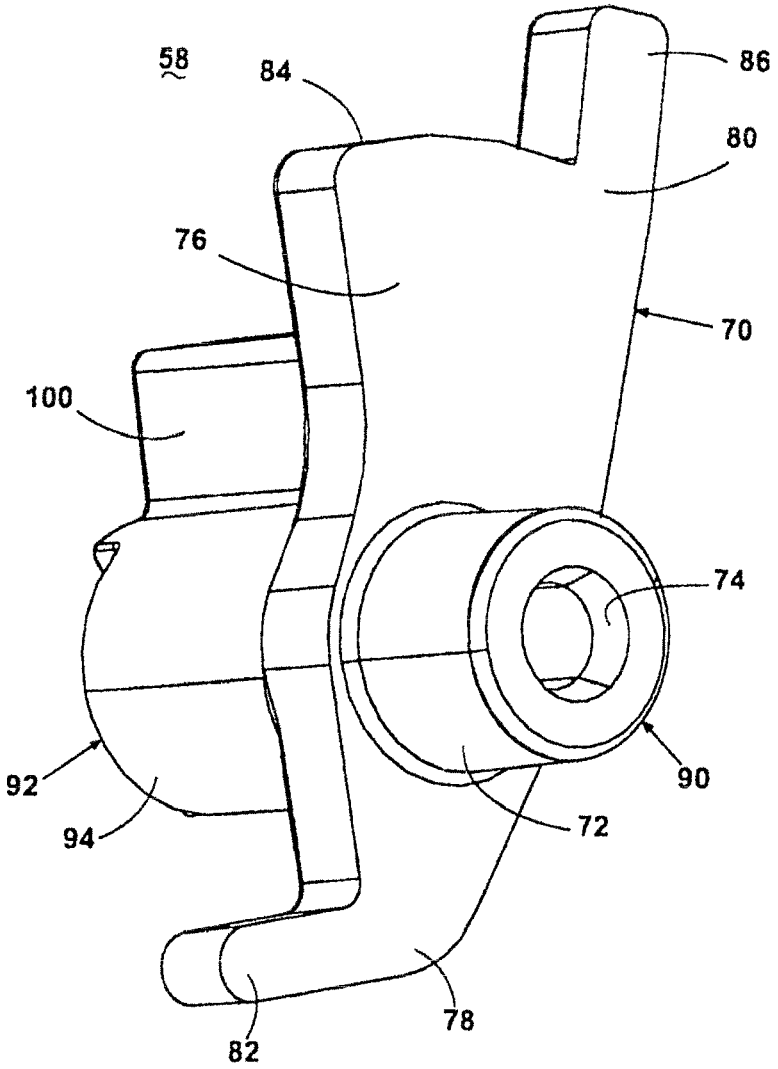
FIGS. 25A-B are alternate enlarged perspective views of an inertial blocking member illustrated in FIG. 24.
Figure 25B:
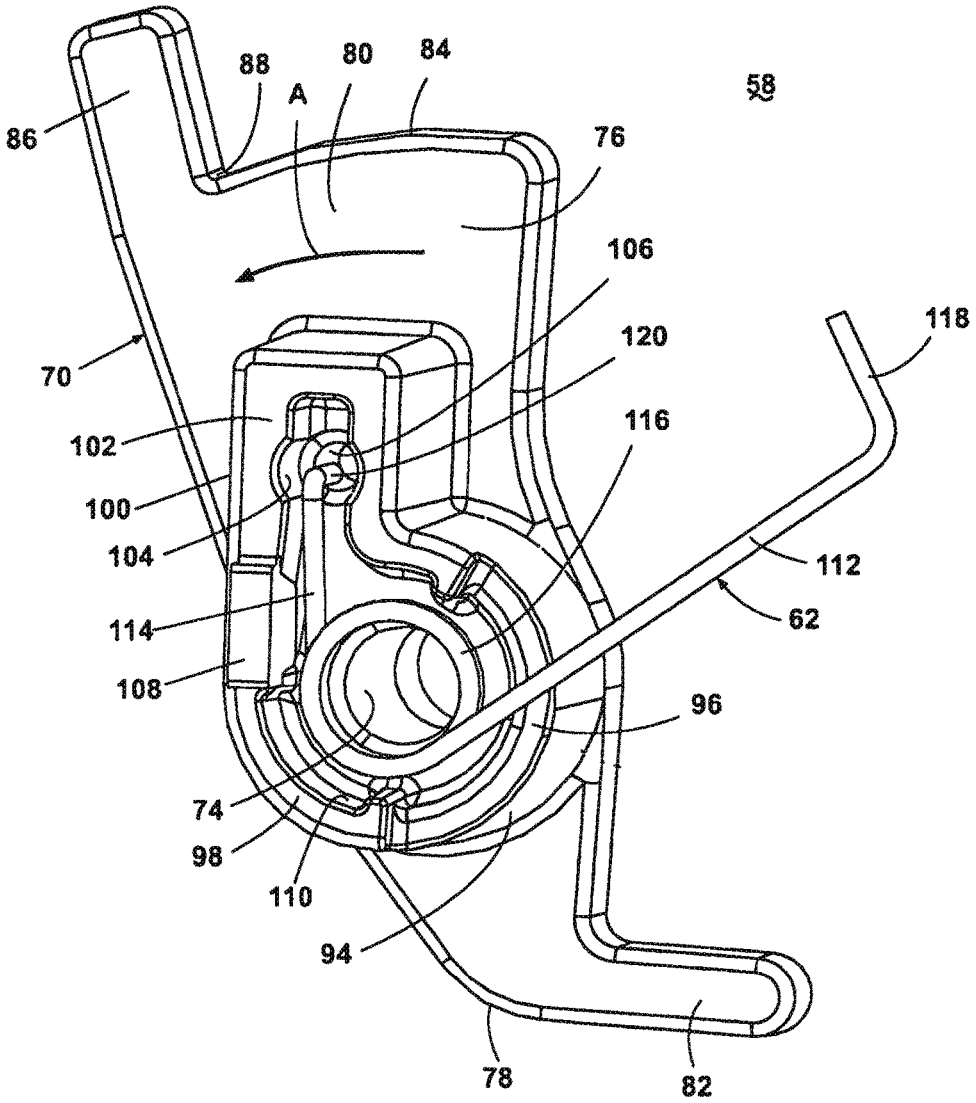

Referring now to FIGS. 25A-B, the inertial blocking member 58 is an irregularly shaped body comprising a relatively thin, planar inertial blocking member plate 70 having a generally annular through collar 72 extending orthogonally therethrough and defining a coaxial mounting pin aperture 74. The inertial blocking member plate 70 comprises a sector portion 76 having an apex end 78 and an opposed curved end 80. Extending laterally from the apex end 78 and coplanar with the sector portion 76 is a stop finger 82. The curved end 80 defines an arcuate wall 84 transitioning to a generally upwardly extending stop boss 86. The mounting pin aperture 74 can receive an elongated, generally cylindrical mounting pin 60, which can be supported in a suitable manner as hereinafter described, for rotation of the inertial blocking member 58 about an axis of rotation coextensive with the longitudinal axis of the pin 60.

The through collar 72 comprises an annular free portion 90 extending generally orthogonally from a first side of the inertial blocking member plate 70, and a blocking member retainer element comprising an engagement portion 92 extending generally orthogonally from a second, opposite side of the inertial blocking member plate 70 and coaxial with the free portion 90. The center of gravity of the inertial blocking member 58 is located within the inertial blocking member plate 70, offset laterally away from the axis of rotation associated with the mounting pin 60.

The engagement portion 92 comprises a generally cylindrical turret 94 transitioning generally tangentially to a somewhat rectangular turret projection 100. An arcuate low wall 96 caps the turret 94 along an arc disposed toward the stop finger 82. A first high wall 98 caps the remainder of the turret 94, and transitions to a second high wall 102 capping the turret projection 100. The low and high walls 96, 98 capping the turret 94 define a spring cavity 110 coaxial with the mounting pin aperture 74. The second high wall 102 capping the turret projection 100 defines a spring channel 104. A spring opening 106 extends from the floor of the spring channel 104 into the turret projection 100. Capping the high walls 98, 102 at the transition thereof is a rectilinear blocking member boss 108.

The spring cavity 110 and spring channel 104 are configured for receipt of a biasing member or helical spring 62, having a coil 116 adapted to encircle the mounting pin 60. Extending tangentially away from a first end of the coil 116 is a contact arm 112 terminating orthogonally in a contact finger 118. Extending tangentially away from a second end of the coil 116 and angularly offset from the contact arm 112 is a blocking member arm 114 terminating orthogonally in a blocking member finger 120. The blocking member finger 120 is adapted for insertion into the spring opening 106 when the spring 62 is positioned in the spring cavity 110 and around the mounting pin 60. In this configuration, the contact arm 112 can extend across the low wall 96.

Figure 26A:
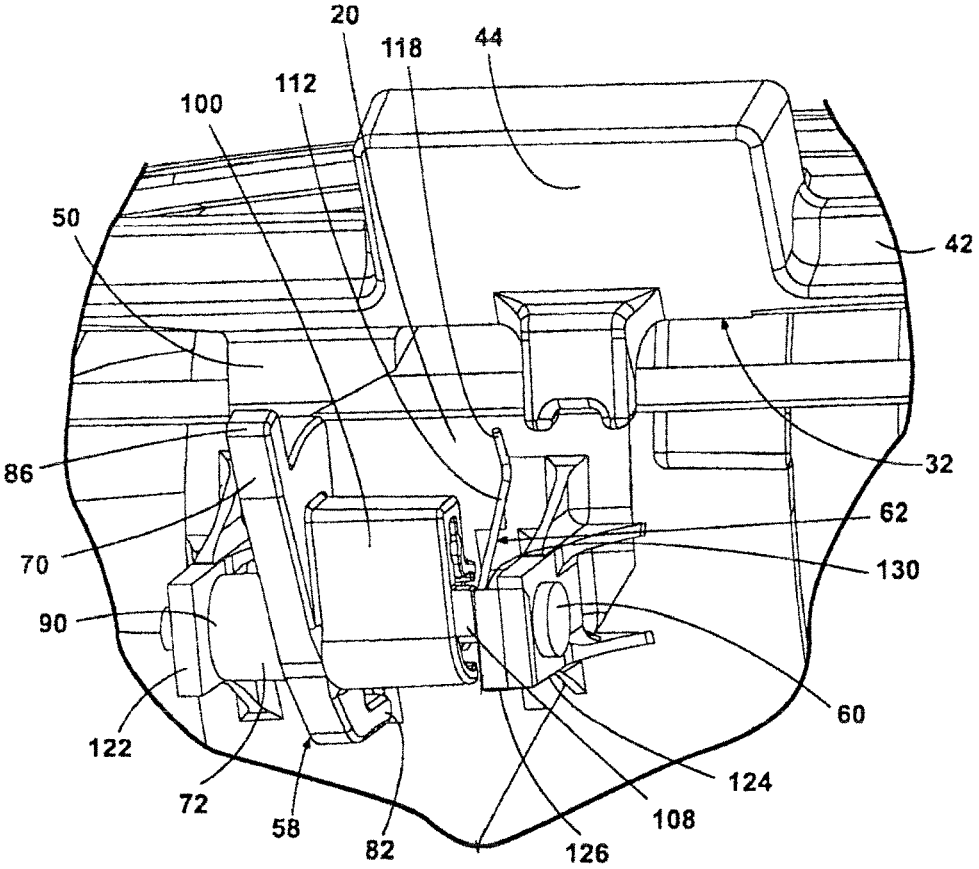
FIGS. 26A-B are alternate enlarged perspective views of a bell crank actuator illustrated in FIG. 24, and the inertial blocking member, in an at-rest configuration.

Referring to FIG. 26A, the bend between the contact arm 112 and the contact finger 118 can bear against the escutcheon 20 so that the inertial blocking member 58 can be urged in a clockwise rotation, as represented by the curved vector "A" in FIG. 25B.

Figure 26B:
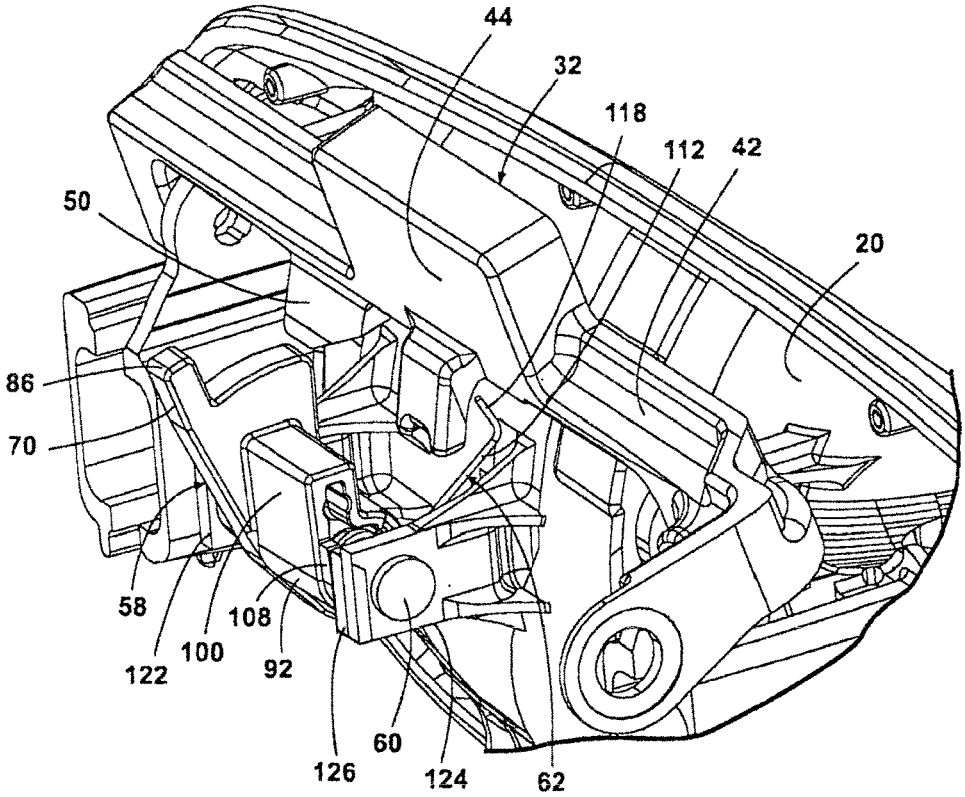

FIGS. 26A-B illustrate the relative positions of the inertial blocking member 58 and bell crank actuator 32 in an at-rest configuration. The mounting pin 60 supported by the pillow blocks 122, 124 rotatably suspends the inertial blocking member 58. The return spring 62 can tend to urge the inertial blocking member 58 to rotate so that the stop finger 82 contacts the escutcheon 20, thereby stabilizing the inertial blocking member 58 in place, and spacing the stop boss 86 away from the translation boss 50. In this configuration, pulling on the door handle grip 22 to open the door assembly 12 can cause the bell crank actuator 32 to rotate about the pin axis 48, activating the bell crank, and also rotating the translation boss 50 forwardly away from the inertial blocking member 58. The inertial blocking member 58 thus cannot move.

Figure 27A:
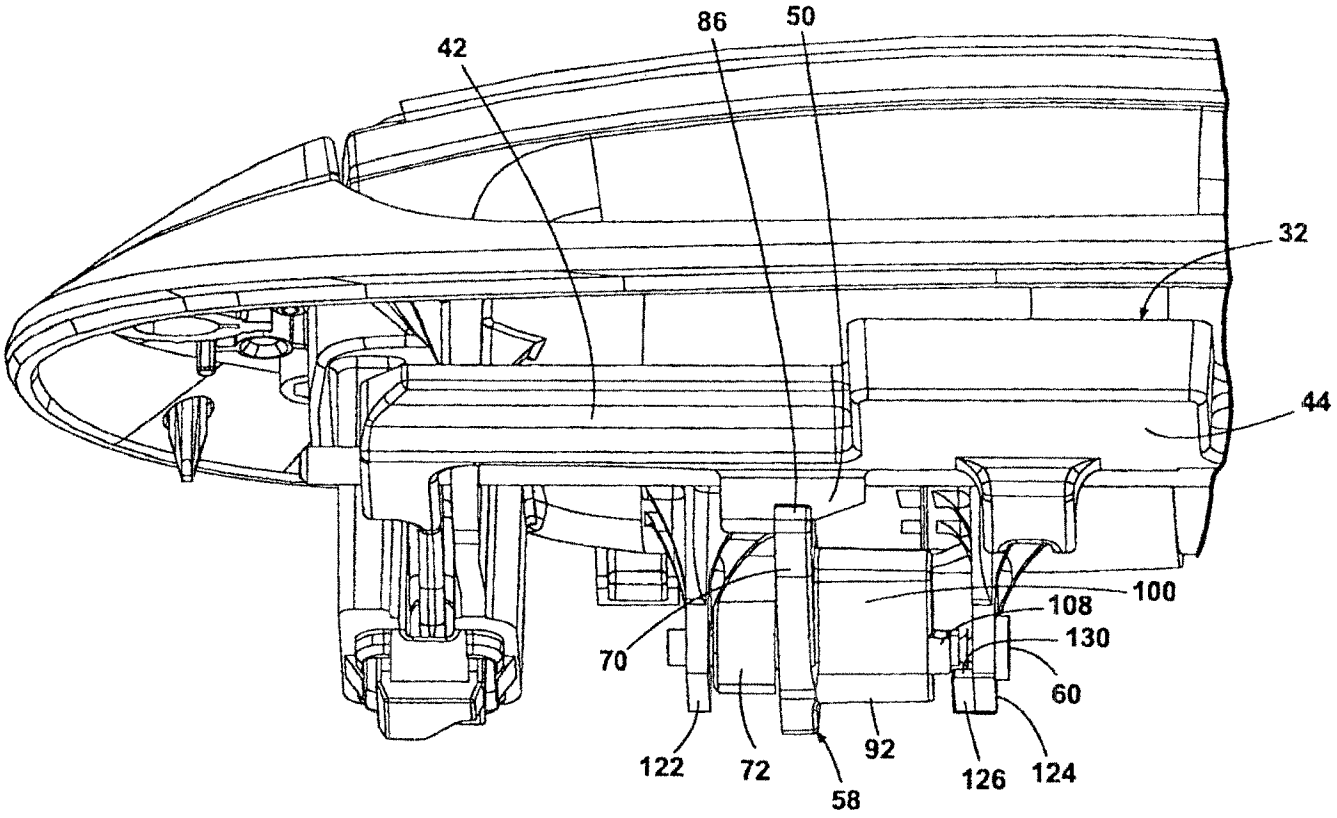
FIGS. 27A-B are alternate enlarged perspective views of the bell crank actuator and inertial blocking member illustrated in FIGS. 26A-B during an impact tending to influence the activation of the vehicle release handle assembly.
Figure 27B:
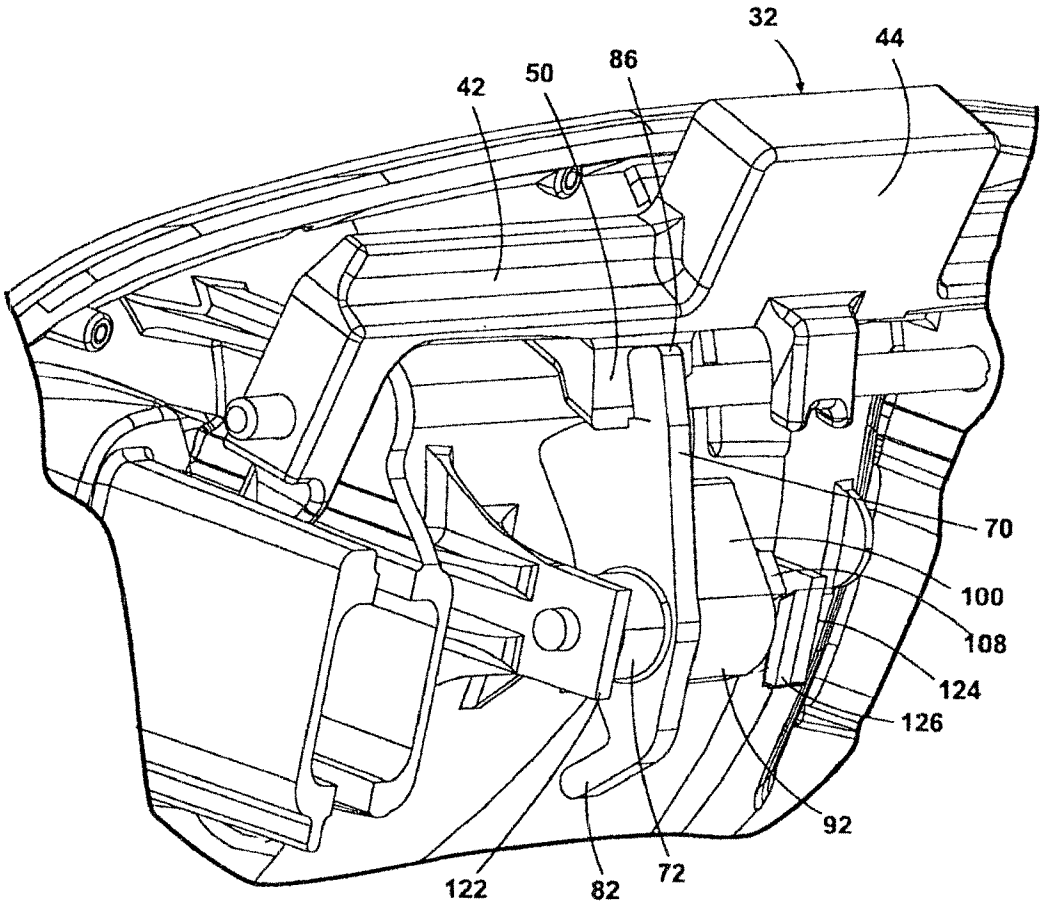

FIGS. 27A-B illustrate the relative positions of the inertial blocking member 58 and the bell crank actuator 32 during the acceleration phase of an impact event. During this phase, the bell crank counterweight 44 and the translation boss 50 can move outwardly toward the escutcheon 20 so that the bell crank actuator 32 rotates about the pin axis 48, and the fingers 38, 40 are urged inwardly, holding the door handle grip 22 in the door closed position. Concurrently, the inertial blocking member 58 can rotate so that the stop finger 82 moves inwardly away from the escutcheon 20 and the stop boss 86 moves outwardly. The blocking member boss 108 can translate upwardly along the stop block 126 of the pillow block 124, eventually clearing the stop block 126, as illustrated in FIG. 27A.

Figure 28A:
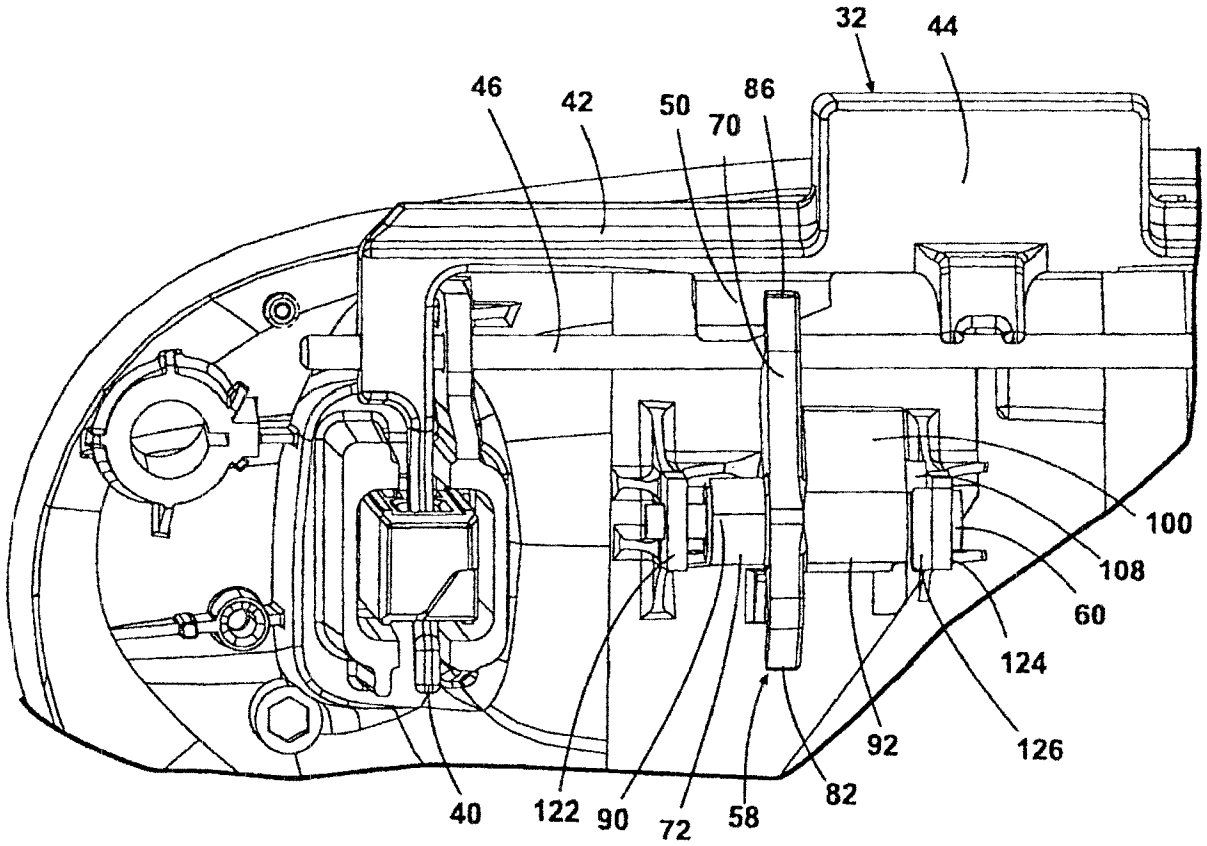
FIGS. 28A-B are alternate enlarged perspective views of the bell crank actuator and inertial blocking member illustrated in FIGS. 26A-B illustrating the inertial blocking member subassembly in position to prevent the return of the bell crank actuator to the at-rest configuration.
Figure 28B:
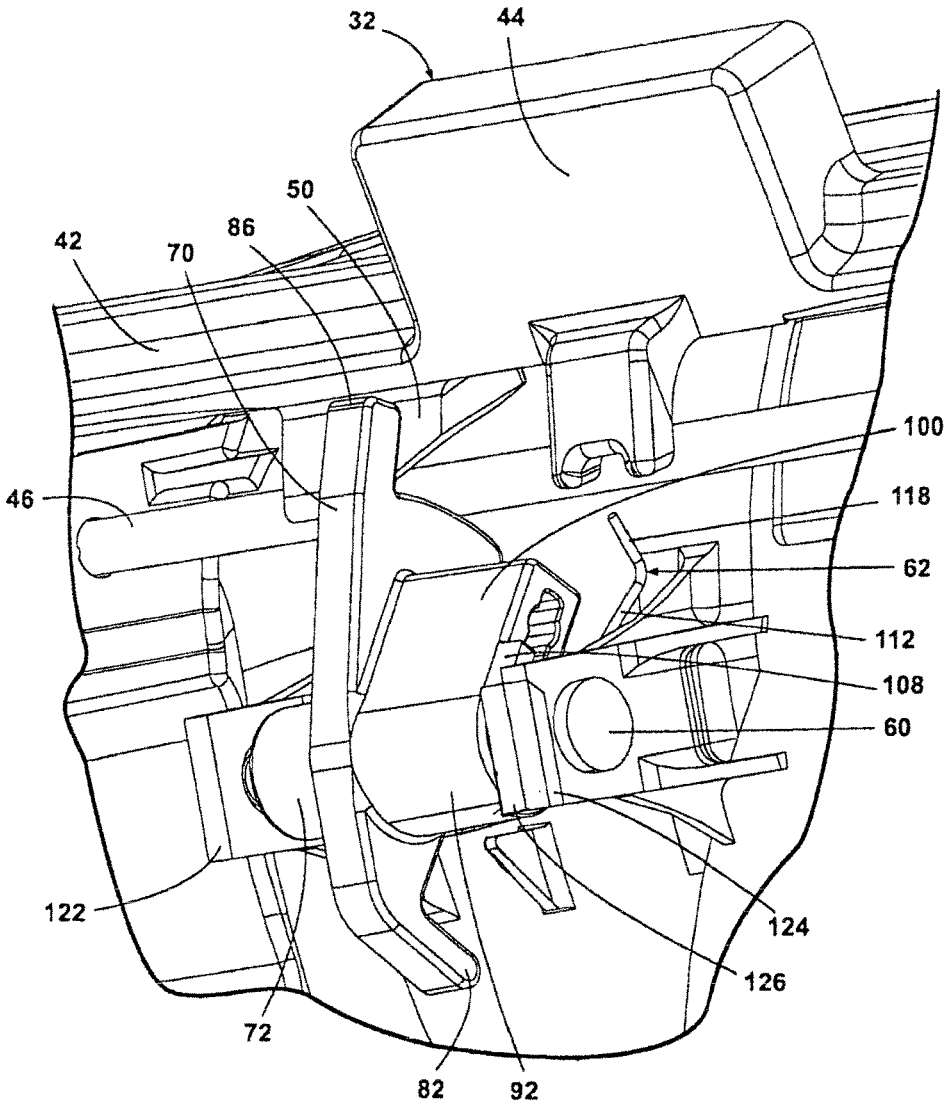

Referring now to FIGS. 28A-B, if during the deformation phase acceleration forces cause the bell crank counterweight 44 and the translation boss 50 to move inwardly away from the escutcheon 20, the inclined surface of the translation boss 50, which is also moving inwardly, can be brought into contact with the arcuate wall 84, thereby urging the bell crank actuator 32 back towards its at-rest position. Continued movement of the translation boss 50 can urge the arcuate wall 84 to slide along the inclined surface of the translation boss 50 and the inertial blocking member 58 to slide along the mounting pin 60 toward the pillow block 124. The blocking member boss 108, having cleared the stop block 126, can translate toward the pillow block 124 along the stop block 126 until the blocking member boss 108 contacts the blocking member surface 130. In this configuration, the inertial blocking member 58 and the bell crank actuator 32 cannot rotate back to their at-rest positions due to the engagement of the stop boss 86 with the translation boss 50.

With the inertial blocking member 58 and the bell crank actuator 32 prevented from rotating back to their at-rest positions, the door handle grip 22 can be prevented from moving and enabling the opening of the door assembly 12. When acceleration forces have dissipated, the return spring 62 can urge the inertial blocking member 58 toward its at-rest position with the stop finger 82 in contact with the escutcheon 20 and the stop boss 86 away from the translation boss 50. The force exerted by the return spring 62 tending to rotate the inertial blocking member 58 can urge the arcuate wall 84 to travel up the inclined surface of the translation boss 50 until the blocking member boss 108 clears the blocking member surface 130 and can slide along the stop block 126. The door assembly 12 can remain closed during the acceleration caused by the impact, but can be opened when the acceleration has dissipated, after the termination of the impact event.

Turning next to FIGS. 29A through 29E, there is shown another alternative embodiment of an inertial blocking member subassembly for a vehicle-door release handle mechanism. Except as particularized below, the handle assembly, including the inertial blocking member subassembly, is generally as described above in respect of the other embodiments of the present invention.

In the following, and remaining, embodiments of the present invention as shown in FIGS. 29A through 31D, it is to be understood that the reference numerals used in these drawings relate only to these embodiments and, as such, have no relation to the reference numerals used in any of the other drawings. It will also be understood that the terms "up," "upper," "lower" and "down" are, unless otherwise expressly stated, used in relation to the frame of reference defined by the drawings, and do not necessarily refer to true vertical relationships with the horizon. Rather, those skilled in the art will understand that the orientation of the invention according to the embodiments disclosed herein may be varied to accommodate different door handle designs, subject only to the overall requirement that the blocking member move rotationally and translationally in the manner described hereafter in connection with the several embodiments of the present invention in order to interfere, as required, with the operation of a vehicle's door handle assembly.

Figure 29A:
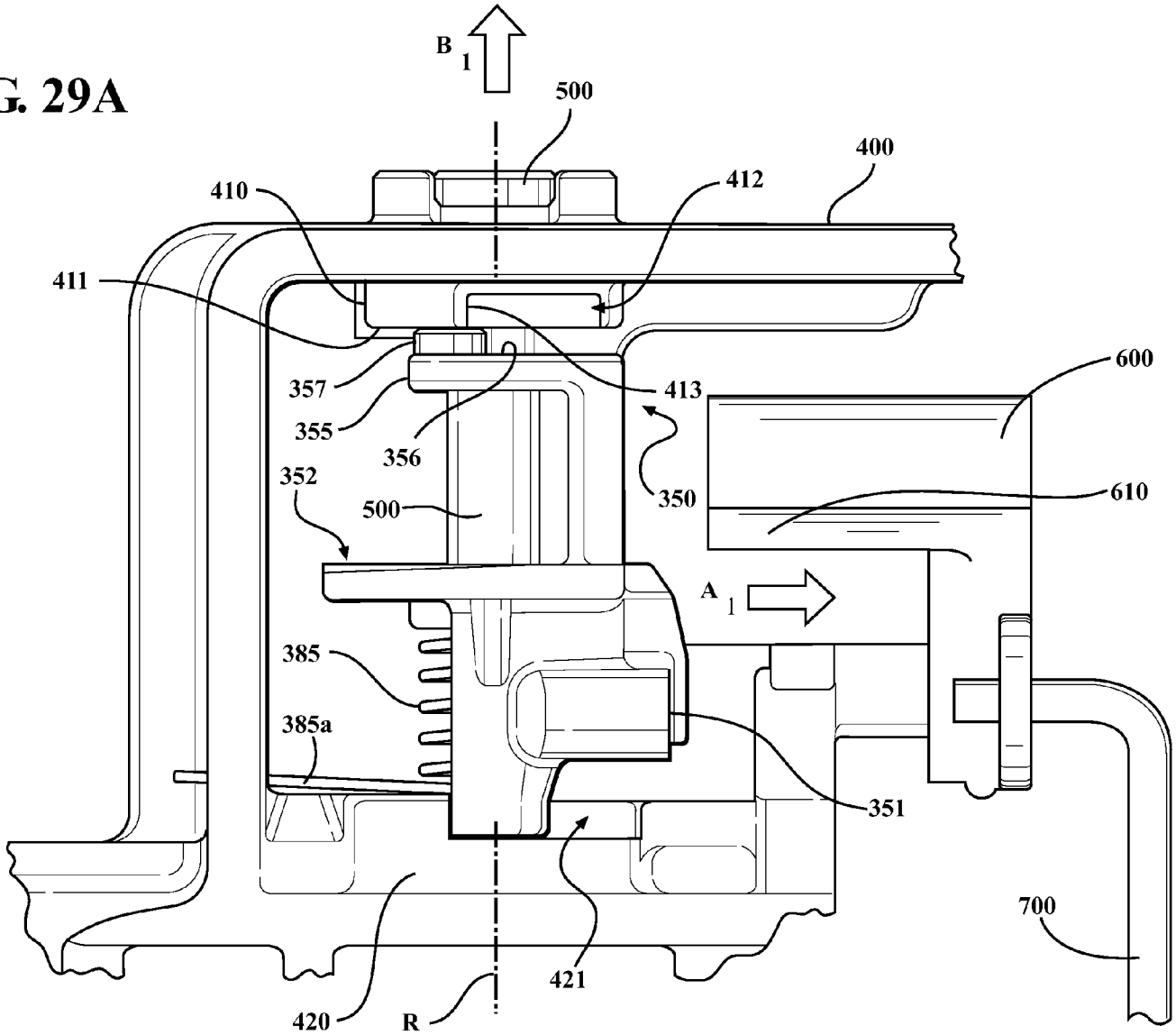
FIGS. 29A-B are views of an alternate embodiment of an inertial blocking member subassembly shown in at-rest and engaged positions of the blocking member.

According to the embodiment of FIGS. 29A through 29E, the inertial blocking member subassembly comprises an inertial blocking member 350 associated with the release handle assembly framework 400, the blocking member 350 having a center of gravity which is offset from an axis of rotation (shown by the dashed line R in FIGS. 29A and B). As described hereafter, blocking member 350 is movable in rotational (shown by the arrows $A_1$ and $A_2$ in FIGS. 29A and B) and translational (shown by the arrows $B_1$ and $B_2$ in FIGS. 29A and B) directions between an at-rest position (shown in FIGS. 29A and D), in which the blocking member 350 does not prevent actuation of the release handle (not shown) to effect operation of the door latch, and an engaged position (shown in FIGS. 29B and E), in which the blocking member prevents 350 actuation of the door latch.

Still more particularly, the blocking member 350 includes an interference portion 352 which, as with the above-described embodiments of the invention, contacts an interference portion 610 of the bell crank 600 of a bell crank assembly in the engaged position of the blocking member 350 to thereby prevent rotation of the bell crank assembly and movement of the door handle grip (and, thereby, to prevent unlatching of the vehicle door which, per convention, is effected via a latch rod 700 linking the bell crank 600 to the door latch (not shown)).

Figure 29B:
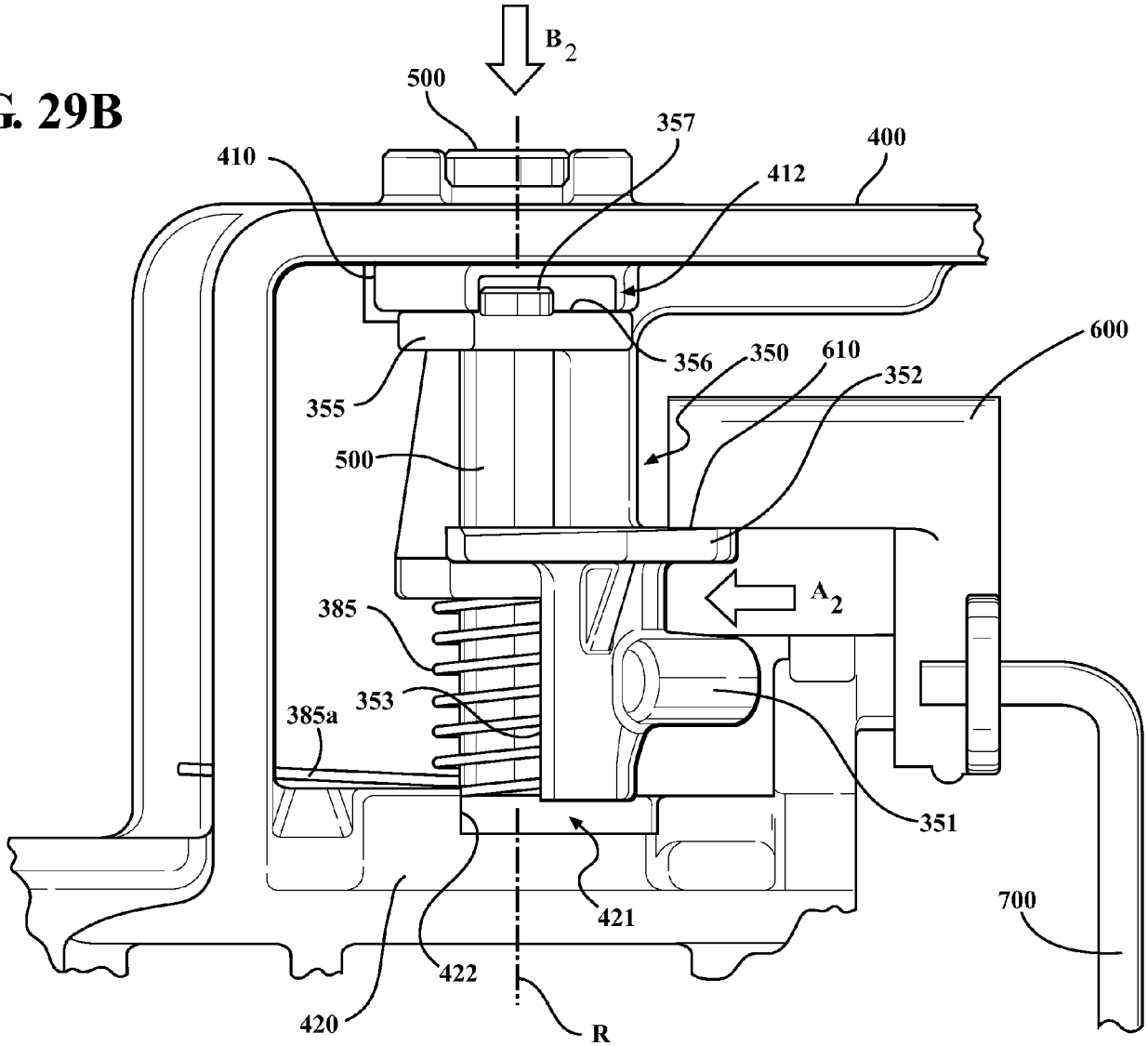
Figure 29C:
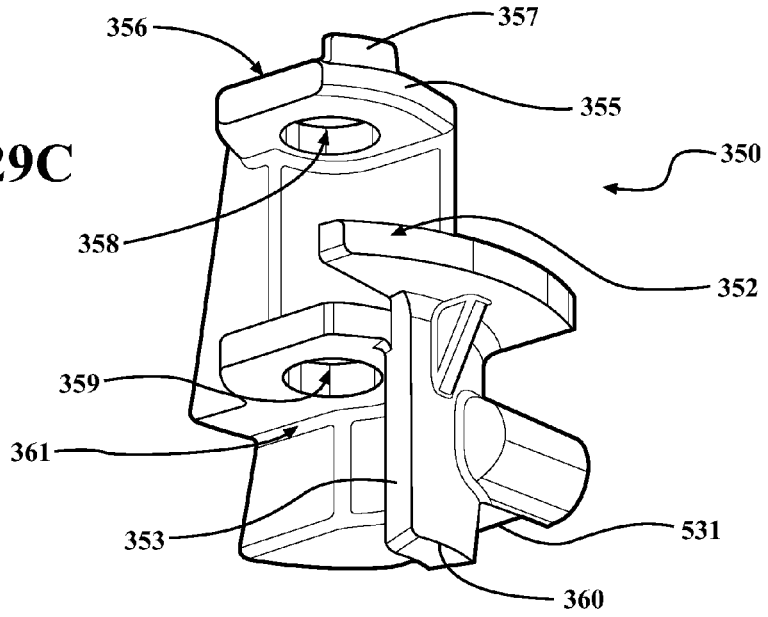
FIG. 29C is a perspective view of the blocking member of FIGS. 29A and 29B.

As best shown in FIGS. 29A through C, the blocking member 350 may be seen to comprise an irregularly-shaped body movably mounted on the door handle framework 400 between upper 410 and lower 420 support features. Blocking member 350 is movably mounted on a pin or axle 500 secured to the framework 400 and extending between the upper 410 and lower 420 support features. Pin 500 may, by way of example, take a form comparable with that of the previously-described embodiments, and is received through axially aligned openings 357, 358 defined in the blocking member 350 body. It will be appreciated that the pin 500 defines the axis of rotation R for the blocking member 350.

As with other embodiments disclosed herein, blocking member 350 comprises a counterweight portion 351 defining the offset center of gravity of the blocking member which effect movement thereof in response to an acceleration force, such as occasioned by a collision. According to the illustrated embodiment, counterweight portion 351 may be seen to take the form of an irregularly-shaped mass extending radially away from the axis of rotation R of the blocking member. The counterweight portion 351 may or may not be characterized by the hidden CG feature described herein in relation to other embodiments of the present invention. To the extent that the hidden CG feature is employed, it will be appreciated from the description of the foregoing embodiments that, in the engaged position of the blocking member 350, the center of gravity of the blocking member is approximately aligned with the vector of the acceleration force and the axis of rotation R of the blocking member 350. Per convention, as those skilled in the art will appreciate, the counterweight portion 351 is disposed and configured so as to define a center of gravity that will effect rotational movement of the blocking member 350 in response to an acceleration force, such as occasioned by a collision.

The interference portion 352 of the blocking portion 350 is configured to extend into the path of travel of the bell crank 600 or other moveable component of the release handle assembly when the blocking member 350 is in the engaged position thereof (FIG. 29B). Conversely, the blocking member 250 permits activation of the release handle assembly (and, according to the illustrated embodiment ore particularly, the bell crank 600) when the blocking member 350 is in the at-rest position (FIG. 29A).

A blocking member retainer is provided on at least one of the release handle assembly framework 400 and the blocking member 350. In the illustrated embodiment, the blocking member retainer comprises each of a projection provided on one of the release handle framework 400 or the blocking member 350, and a recess provided on the other of the release handle framework 400 or the blocking member 350, the projection being at least partially received in the recess in the engaged position of the blocking member 350. More particularly according to the illustrated embodiment of FIGS. 29A through 29E, the blocking member 350 includes, at an upper end thereof, a shelf or shoulder portion 355 extending radially away from the rotational axis R. Pin-receiving opening 358 is defined through the shelf portion 355, as shown best in FIG. 29C. Shelf or shoulder portion 355 defines a generally planar upper surface 356 disposed in opposition to a generally planar lower surface 411 of the upper support feature 410. Extending from upper surface 356 toward the opposing upper support feature 410 there is provided on the blocking member 350 an engagement feature 357. Engagement feature 357 is dimensioned to be received in cut-out or recess 412 defined in the lower surface 411 of upper support feature 410, as described further below. As shown, cut-out or recess 412 is defined in the upper support feature 410 at a position spaced from the position of the engagement feature 357 in the at-rest position of the blocking member 350. More particularly, the cut-out or recess 412 is positioned along the rotational path of the blocking member 350 so that, as described below, engagement feature 357 is received in recess 412 only in the engaged position of the blocking member 350.

Figure 29D:
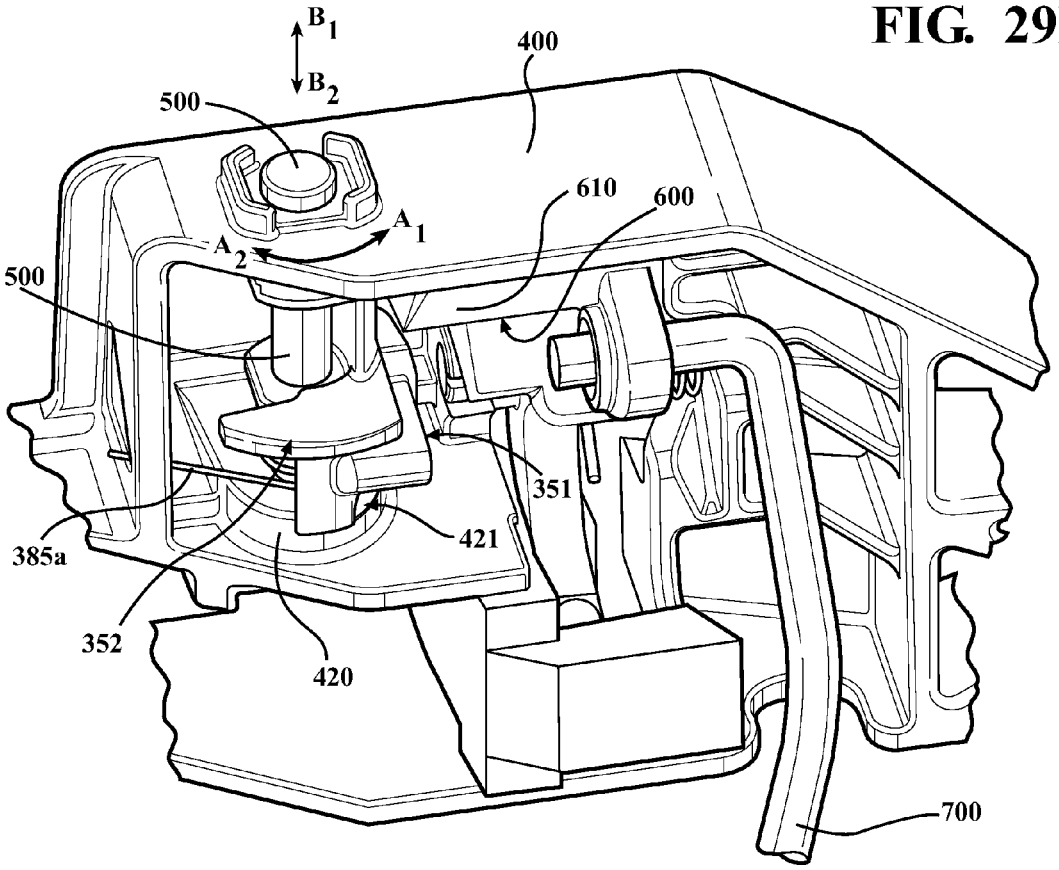
FIGS. 29D-E are perspective views of the blocking member subassembly of FIGS. 29A-29C, shown in at-rest and engaged positions of the blocking member.
Figure 29E:
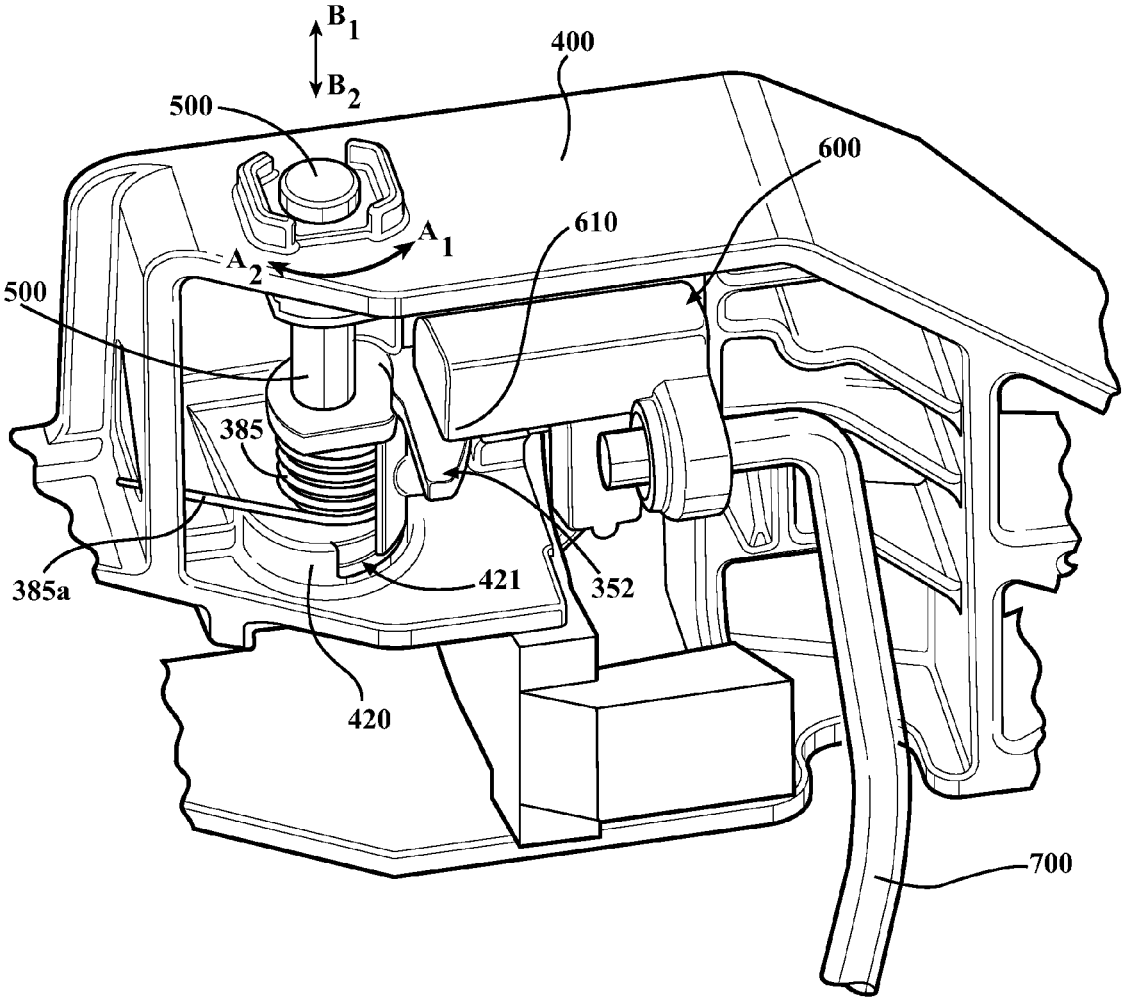

Lower support feature 420 includes an arcuate cut-out portion or recess 421 in which a lower portion 360 of the blocking member is received in the at-rest position thereof (shown in FIGS. 29A and 29D). Recess 421 is partially defined by a sidewall 422 which confronts and abuts an opposing contact surface 353 of the blocking member 350 in the at-rest position, thereby preventing counter-rotation (i.e., in the direction of arrow $A_2$) of the blocking member 350 from the at-rest position.

Between the lower surface of the interference portion 352 and the lower support feature 420, the blocking member 350 defines a cavity or cut-out 361 for disposition of a biasing element or member 385. Captured between and connected at its opposite ends to each of the blocking member 350 and (via the projecting leg 385*a*) the framework 400, and further receiving the pin or axle 500 therethrough the biasing element 385 biases the blocking member 350 into the engaged position thereof in the manner hereafter described. In the illustrated embodiment, the biasing element 385 comprises a helical torsion spring, although it is contemplated that other biasing elements, including other types of springs, may be substituted. According to the illustrated embodiment, the helical torsion spring is under longitudinal (i.e., in the direction of the axis of rotation R) compression in the at-rest position (FIGS. 29A and D) of the blocking member 350, and so will be understood to bias movement of the blocking member 350 upwardly (in the direction of arrow $B_1$) into the engaged position. When the blocking member 350 is in the engaged position, on the other hand, the rotational movement of the blocking member 350 from the at-rest to the engaged positions unwinds the helical torsion spring to the point where it is biased in the direction of rotation of arrow $A_2$ and, therefore, tends to urge the blocking member 350 back toward the at-rest position. Accordingly, it will be understood that, in the at-rest position of the blocking member 350, the torsion spring 385 of the illustrated embodiment is not torsionally loaded (otherwise, it will be appreciated, the blocking member 350 would, per the illustrated embodiment, be freely urged into the engaged position).

As a result of the acceleration force acting on the blocking member center of gravity, the blocking member 350 is both rotationally (in the direction of the arrow $A_1$) and translationally (in the direction of the arrow $B_1$) moved from the at-rest position (FIGS. 29A and D) to the engaged position (FIGS. 29B and E). More specifically, the acceleration force causes rotational movement of the blocking member 350 in the direction of the arrow $A_1$. As blocking member 350 rotates, engagement feature 357 is rotationally moved from its at-rest position of contact with the lower surface 411 of the upper support feature 410 and toward the cut-out 412. As engagement feature 357 clears the lower surface 411 of support feature 410, biasing element 385 urges blocking member 350 translationally, in the direction of arrow $B_1$, toward the upper support feature 410, thereby bringing engagement feature 357 fully into recess 412. In this position, as best shown in FIGS. 29B and E, the interference portion 352 is disposed in the path of travel of the bell crank 600 (which, in normal operation, moves downwardly from the position shown in FIGS. 29A through E to a point beyond the location of interference portion 352 in the engaged position) and, more particularly, confronts and opposes interference portion 610 to prevent normal downward movement of the bell crank 600.

By reason of the blocking member retainer (e.g., the cooperating engagement feature 357 and cut-out 412 of the illustrated embodiment), the blocking member 350 is retained in the engaged position until disengagement of the blocking member retainer from the at least one of the release handle assembly framework 400 and the blocking member 350. More particularly, it can be seen that the engagement feature 357 is maintained within the recess 412 both by reason of the biasing element 385, which urges the blocking member into the engaged position in the translational direction of arrow $B_1$, and by reason of the confrontational engagement of the engagement feature 357 with the end-wall 413 of recess 412, which prevents rotational movement of the blocking member in the direction of arrow $A_2$ (i.e., back to the at-rest position).

Disengagement of the blocking member retainer from the at least one of the release handle assembly framework and the blocking member may be effected by operating the release handle assembly. More particularly, and in a manner similar to that described above in respect of other embodiments of the present invention, pulling on the door handle grip (not shown) with sufficient force rotates the bell-crank assembly downwardly, bringing the interference portion 610 of bell crank 600 against the interference portion 352 of the blocking member 350, thereby moving the blocking member 350 downwardly in the direction of arrow $B_2$. This motion will bring the engagement feature 357 out of recess 412. Once the engagement feature 357 has cleared the cut-out or recess 412, and in particular the end wall 413, the torsional bias in helical torsion spring 385 will tend to urge the blocking member 350 rotationally in the direction of arrow $A_2$ and, thus, back into the at-rest position. Concurrently, continued downward movement of the bell crank 600 will, through contact between the interference portions 352 and 610, move the blocking member downwardly in the direction of arrow $B_2$ to compress the helical torsion spring 385 until, when the blocking member is fully rotated back into the at-rest position, further engagement between the interference portion 610 and interference portion 352 is prevented as the interference portion 352 is moved rotationally out of the path of the interference finger. Thus, it will be understood that, through the combined action of actuation of the door handle grip and the bias of the helical torsion spring, the blocking member engagement feature 357 is disengaged from the recess 412 and, concurrently, the blocking member 350 is returned to the at-rest position.

It is contemplated, and should be readily understood from the foregoing, that engagement between the blocking member 350 and the upper support feature 410 may be accomplished by other engagement feature configurations, including, for example, rearrangement of the various elements described above.

Figure 30A:
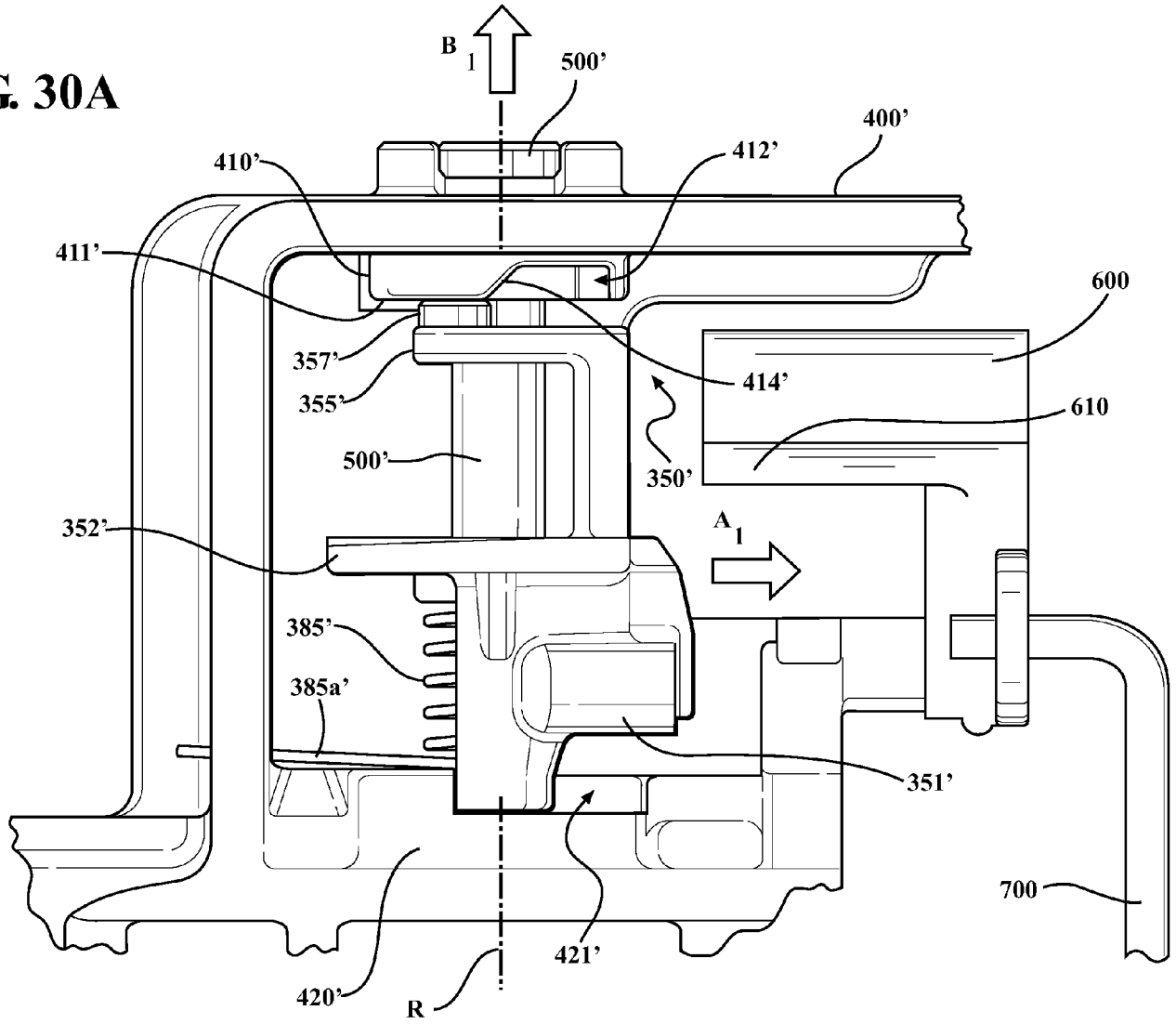
FIGS. 30A-B are views of a further alternate embodiment of an inertial blocking member subassembly shown in at-rest and engaged positions of the blocking member.
Figure 30B:
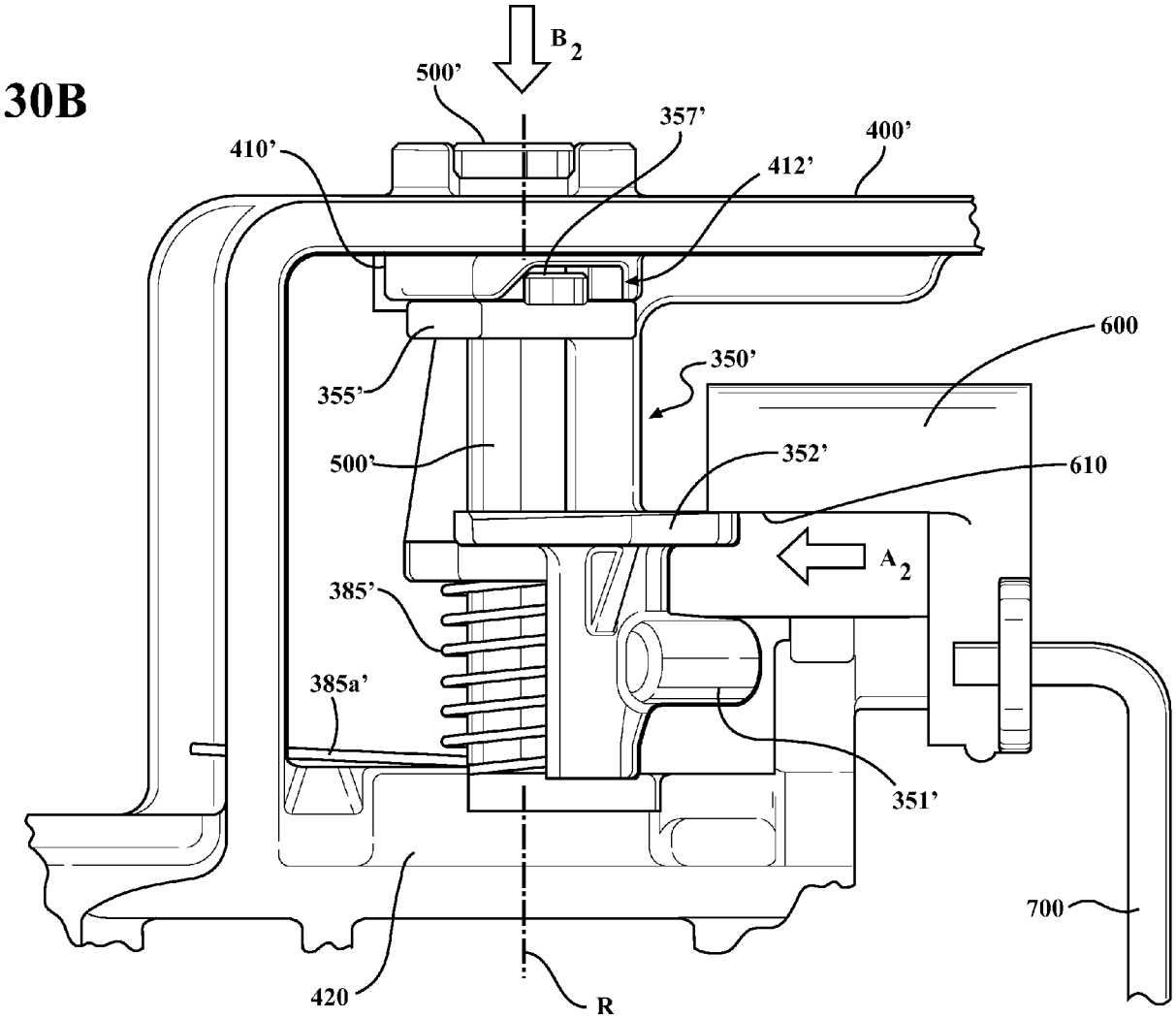

Turning next to FIGS. 30A and B, there is shown another alternative embodiment which in all material respects is like the embodiment of FIGS. 29A through 29E except as otherwise noted. More particularly, the embodiment of FIGS. 30A and B is characterized by the provision of a ramped portion 414' disposed on the recess 412' of upper support feature 410' so as to provide a resistance surface for the projection 357' as the blocking member 350' moves into and out of the engaged position (FIG. 30B). More particularly, ramped portion 414' defines a transitional surface between the lower surface 411' of support feature 410' and the recess 412'.

According to this embodiment, the orientation of the resistance surface 414' is such that, unlike the end-wall 413 described above in the embodiment of FIGS. 29A through E, the resistance surface 414' does not completely stop rotational movement of the blocking member 350' in the direction of arrow $A_2$ when the engagement feature 357' is in the recess 412'. Rather, the angled surface 414' is oriented only to resist, and therefor slow, rotational movement of the blocking member 350' back to the at-rest position (FIG. 30A) thereof. As will be understood from this specification, the particular slope, length and/or surface contour of the resistance surface 414' will, in consideration of the biasing force of the helical torsion spring 385' or other biasing element, be such as to impede return of the blocking member 350' to the at-rest position until such time as it is no longer necessary for the blocking member to be in the engaged position thereof; e.g., until the deformation phase of the impact event or collision has reached a point where accidental actuation of the door handle assembly is no longer possible. By the foregoing, therefore, the embodiment of FIGS. 30A and 30B may be understood permit, through the action of the helical torsion spring 385' or other biasing member, the automatic return of blocking member 350' to the at-rest position after the impact event.

FIGS. 31A through D depict still another alternate embodiment of an inertial blocking member subassembly comprising a blocking member 350" associated with the release handle assembly framework 400". The blocking member 350" is in all material respects like the embodiment of FIGS. 29A-29E except as otherwise noted.

Blocking member 350" is movably mounted on a pin or axle 500" secured to the framework 400" and extending between the upper 410" and lower 420" support features. Pin 500" may, by way of example, take a form comparable with that of the previously-described embodiments, and is received through axially aligned openings 357", 358" defined in the blocking member 350" body. It will be appreciated that the pin 500" defines the axis of rotation R for the blocking member 350".

The blocking member 350" may be seen to lack the engagement feature 357, 357' of the embodiments of FIGS. 29A through 30B, while the upper support feature 410" will be seen to lack the recess or cut-out 412, 412' of these embodiments. These upper surface of the blocking member and opposing lower surface of the upper support feature are, rather, generally planar surfaces.

Instead of the engagement feature of the previous embodiments, the blocking member 350" of the embodiment of FIGS. 31A through D defines a longitudinal contact surface 353" proximate the lower support feature 420". Correspondingly, the lower support feature includes a stepped cut-out comprising a first recess 421" extending to a first depth from the upper surface 422" of the lower support feature 420". The first depth of the first recess is defined by the position of the step 423", which step includes an upper surface 424" and a sidewall 425" transitioning to a second recess 426" extending to a second depth from the upper surface 424". The junction between the upper surface 424" and sidewall 425" of the step 423" defines a transitional edge between the first 421" and second 426" recesses. Further, the cut-out defines a sidewall 427" between the upper surface 422" and the upper surface 424", as shown best in FIG. 31B.

Figure 31A:
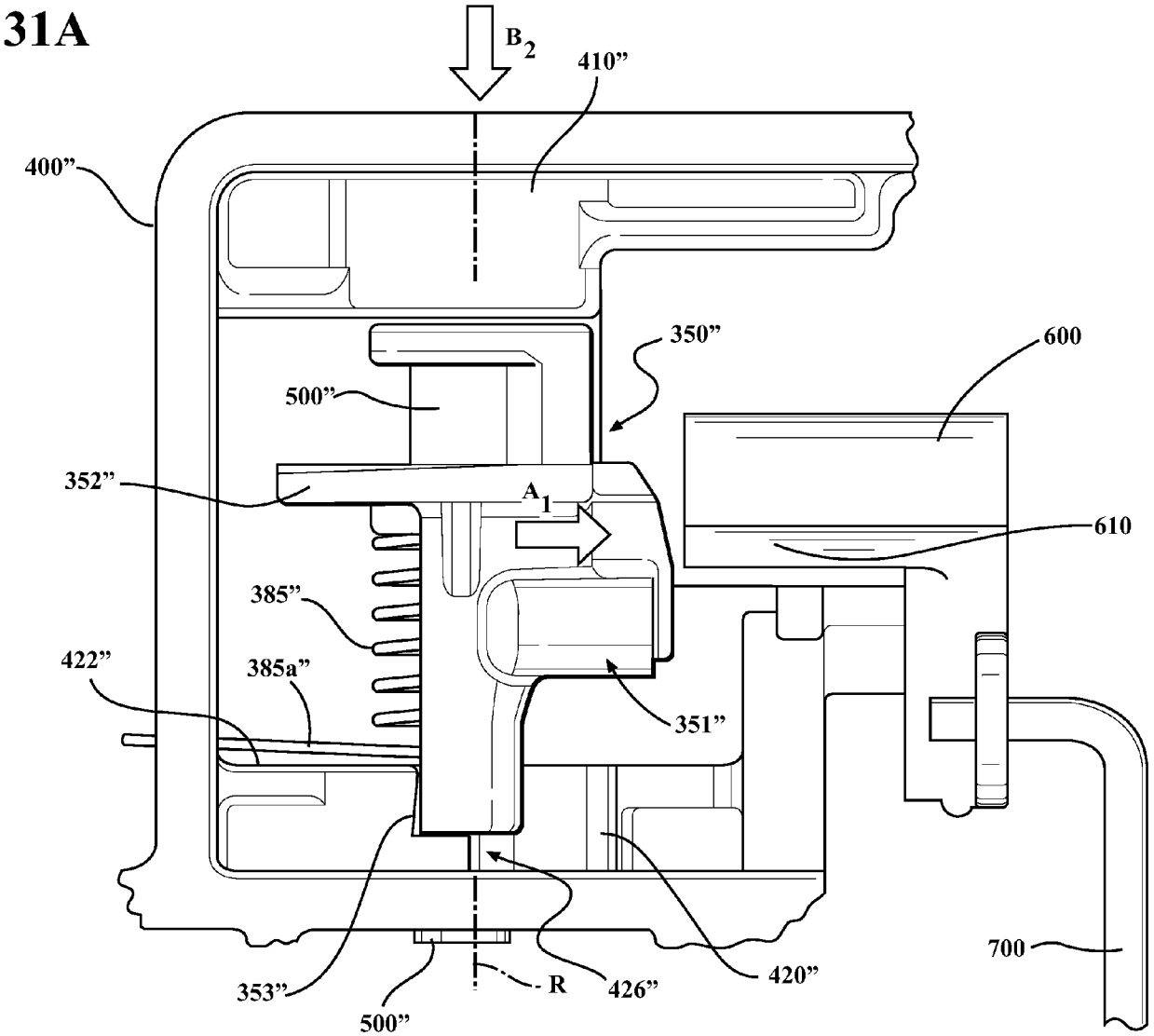
FIGS. 31A-B are views of still another alternate embodiment of an inertial blocking member subassembly shown in at-rest and engaged positions of the blocking member.
Figure 31B:
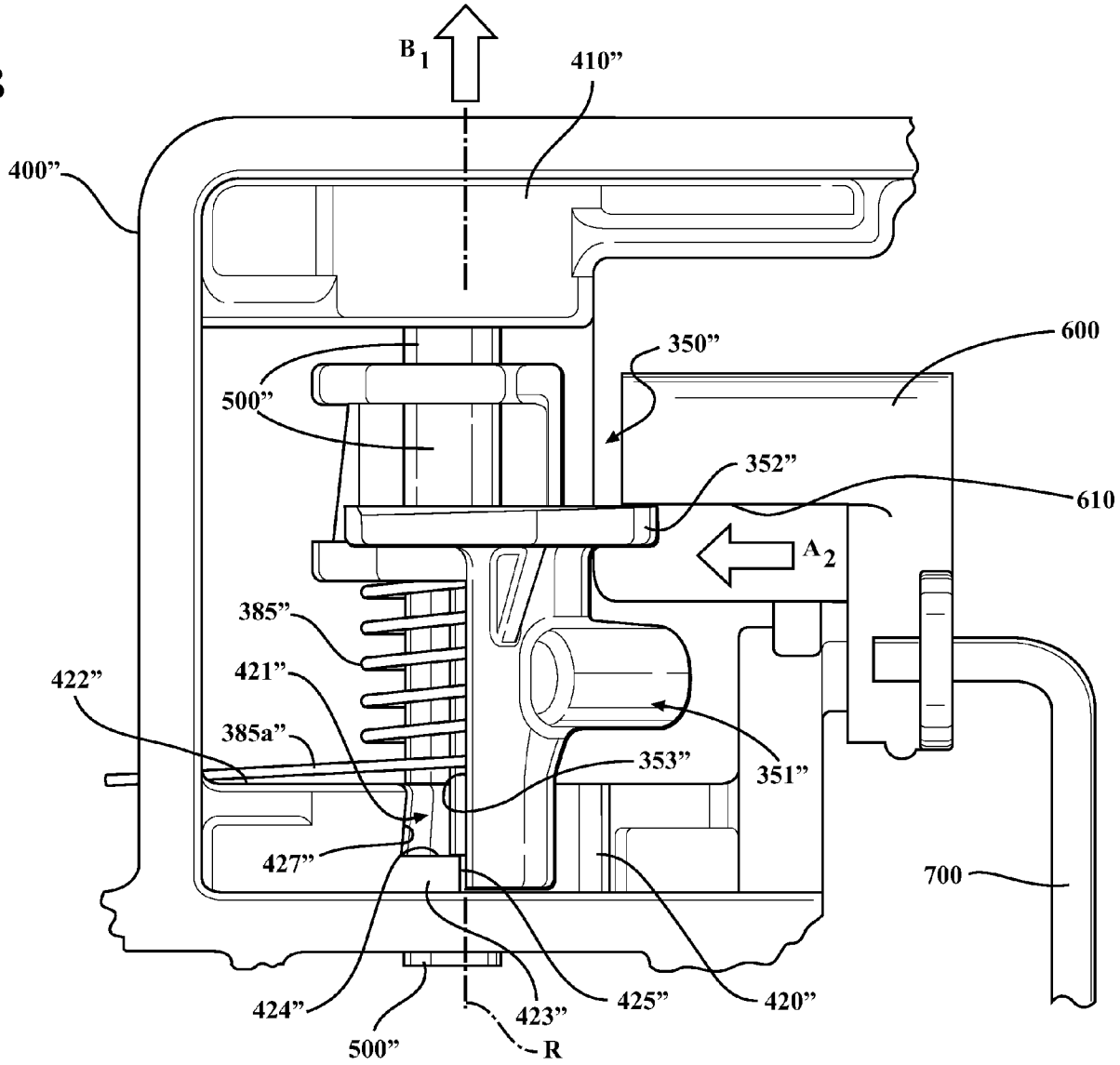
Figure 31C:
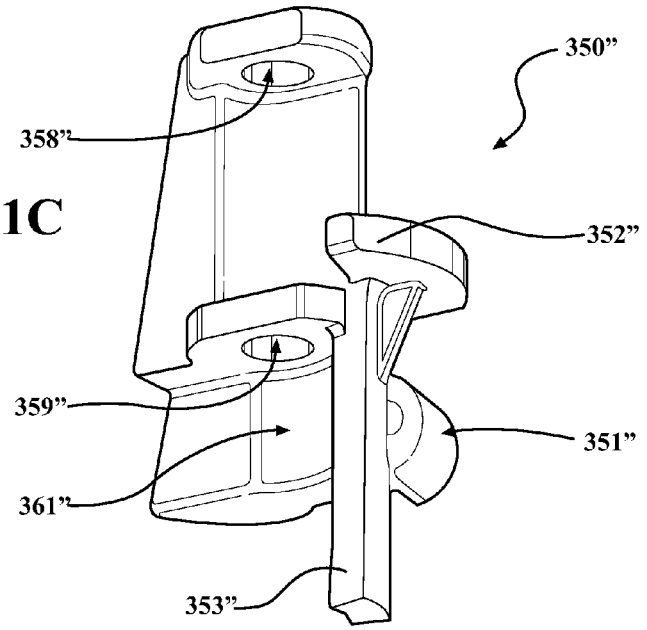
FIG. 31C is a perspective view of the blocking member of FIGS. 31A and 31B.
Figure 31D:
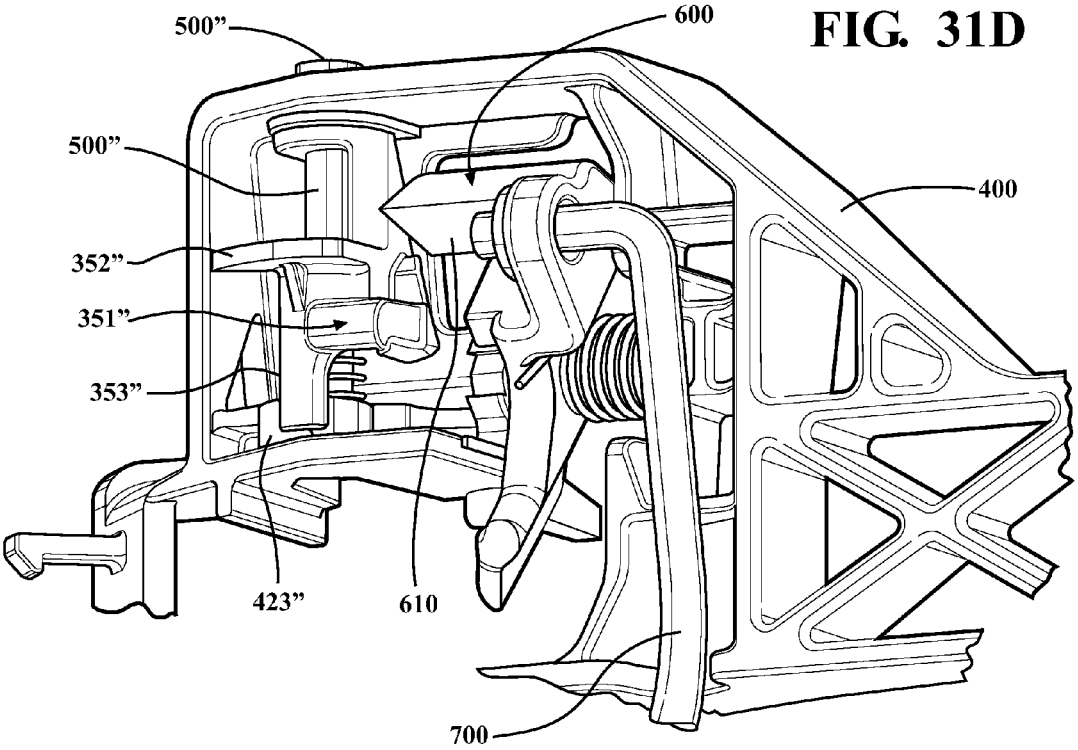
FIG. 31D is a perspective view of the blocking member subassembly of FIGS. 31A-31C, shown in the at-rest position of the blocking member.

As with the preceding embodiment, the blocking member 350" defines a cavity or cut-out 361" between the lower surface of the interference portion 352" and the lower support feature 420" for disposition of a biasing element or member 385" (see FIG. 31C). According to the embodiment of FIGS. 31A through D, the biasing element 385" biases the blocking member 350" into the at-rest position of FIG. 31A by urging the blocking member upwardly in the direction of arrow $B_1$ and away from engagement with the second recess 426", and thereby bringing the upper surface of the blocking member and the opposing, lower surface of the upper support feature into contact.

As described below, the force of the biasing element 385"—which, in the illustrated embodiment, comprises a helical torsion spring—is selected to be sufficiently weak so as (i) to not prevent the blocking member 350" from moving (in the direction of arrow $B_2$) to the engaged position (FIG. 31B), and (ii) to urge the blocking member 350" to the at-rest position (FIGS. A and D) thereof only after the acceleration force has attenuated sufficiently so that interposition of the blocking member 350" in the engaged position is no longer necessary.

As a result of the acceleration force acting on the blocking member 350" center of gravity (as defined by the counterweight portion), the blocking member 350" is rotationally (shown by the arrow $A_1$) moved from the at-rest position (FIG. 31A) toward the engaged position (FIG. 31B). As blocking member 350" rotates past the transition edge of step 423" between the first 421" and second 426" recesses, interference portion 352" moves into a rotational position where the interference portion 352" is disposed in the path of travel of the bell crank 600 and, more particularly, confronts and opposes interference portion 610 to prevent normal downward movement of the bell crank 600. As the bell crank 600 rotates due to the force of the impact event, interference portion 610 moves downwardly, acting upon the interference portion 352" to urge the blocking member 350" downwardly in the direction of arrow $B_2$. This downward movement brings the lower portion of the blocking member 350" into the second recess 426", against the biasing force of the biasing element 385" (see FIG. 31B). In this engagement position, the sidewall 425" also confronts and opposes the contact surface 353" of blocking member 350" to thereby prevent rotational movement of the blocking member in the direction of arrow $A_2$ (i.e., back to the at-rest position).

Upon sufficient attenuation of the acceleration force—e.g., at the end of the impact event—when the bell crank 600 is no longer being urged to act against the interference portion 352" of the blocking member 350", the biasing force of the biasing element 385" urges the blocking member 350" translationally upwardly (i.e., in a direction arrow $B_1$) and out of the second recess 426". As will be appreciated from the foregoing description, this upward motion may also move the bell crank 600 upwardly as interference portion 352" acts upon interference portion 610 (to the extent that the bell crank 600 is not otherwise already returned to its default position by other means). Concurrently, the biasing member 385" biases—such as, in the illustrated embodiment, through the torsional force exerted in the direction of arrow $A_2$ by the helical spring—the blocking member 350" rotationally in the direction of arrow $A_2$ and back to the at-rest position (in which sidewall 427' confronts and opposes the contact surface 353" of blocking member 350", as shown best in FIG. 31B).

Alternatively, it will be appreciated from the disclosure hereinabove in respect of other embodiments of the present invention that the biasing force of the biasing element may be insufficient to automatically return the blocking member to the at-rest position following attenuation of the acceleration force and, instead, that the blocking member may be retained in the engaged position until disengagement thereof by manual actuation of the release handle assembly, such as in the manner described elsewhere herein.

The inertial blocking member subassembly described and illustrated herein can be readily utilized in vehicle door release handle assemblies. Modest modifications to the release handle assembly and the inertial blocking member subassembly can be developed to enable the release handle assembly to be incorporated into virtually any vehicle. The inertial blocking member subassembly comprises a minimum of components, thereby optimizing the repeatability and effectiveness of the safety action, and minimizing fabrication and installation costs. The inertial blocking member subassembly can be incorporated into a release handle assembly for movement about a horizontal axis or a vertical axis. In either configuration, the inertial blocking member subassembly engages during the acceleration phase, and engagement continues into and after the deformation phase of an impact event to maintain the door handle grip in a disabled condition until all acceleration forces have dissipated and/or the door handle grip is pulled.

Relatedly, and as noted elsewhere above, it will be appreciated that the inertial blocking member subassembly may be adapted to interfere with any suitable component or components of a given door latch assembly, including, as disclosed herein, the bell crank and/or bell crank actuator components of the bell crank assembly.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention in which an exclusive property or privilege is claimed is defined as follows:

1. An inertial blocking member subassembly for a vehicle-door release handle mechanism on a vehicle door, the release handle mechanism including a release handle framework supporting a bell crank assembly and a manually actuatable door handle grip, the door handle grip operatively coupled to the bell crank assembly such that actuation of the door handle grip activates the bell crank assembly to unlatch the vehicle door, the inertial blocking member subassembly comprising:

an inertial blocking member associated with the release handle assembly framework, the blocking member having a center of gravity which is offset from an axis of rotation, and the blocking member being rotationally and translationally movable between an at-rest position, in which the blocking member does not prevent actuation of the door handle grip to activate the bell crank assembly to unlatch the vehicle door, and an engaged position, in which the blocking member prevents the actuation of the door handle grip to activate the bell crank assembly to unlatch the vehicle door, wherein the at-rest position is further characterized in that the blocking member is not in motion toward the engaged position;

a biasing element associated with the blocking member, the biasing element loaded in the at-rest position of the blocking member so as to urge translational movement of the blocking member into the engaged position; and a blocking member retainer;

whereby, as a result of an acceleration force acting on the blocking member center of gravity and the biasing element urging the blocking member, the blocking member is rotationally and translationally moved from the at-rest position to the engaged position, and in the engaged position, the blocking member is retained by the blocking member retainer until the blocking member retainer and blocking member are disengaged from each other so as to permit the blocking member to move to the at-rest position.

2. The inertial blocking member subassembly of claim 1, wherein, in the engaged position of the blocking member, the center of gravity of the blocking member is approximately aligned with a vector of the acceleration force and the axis of rotation.

3. The inertial blocking member subassembly of claim 1, wherein the biasing element is a helical torsion spring.

4. The inertial blocking member subassembly of claim 1, wherein the blocking member intercepts and prevents activation of the bell crank assembly by the actuation of the door handle grip when the blocking member is in the engaged position, and permits activation of the bell crank assembly by the actuation of the door handle grip when the blocking member is in the at-rest position.

5. The inertial blocking member subassembly of claim 1, wherein disengagement of the blocking member retainer and the blocking member from each other is effected by actuation of the door handle grip.

6. The inertial blocking member subassembly of claim 1, wherein the blocking member retainer is associated with each of the release handle framework and the blocking member.

7. The inertial blocking member subassembly of claim 6, wherein the blocking member retainer comprises each of a projection provided on one of the release handle framework or the blocking member, and a recess provided on the other of the release handle framework or the blocking member, the projection being at least partially received in the recess in the engaged position of the blocking member.

* * * * *